US012746449B1

(12) United States Patent
Joseph

(10) Patent No.: US 12,746,449 B1
(45) **Date of Patent: *Sep. 29, 2026**

(54) BASKETBALL LAUNCHING APPARATUS PROVIDING MULTIPLE TYPES OF BASKETBALL PASSES, RELATED SYSTEMS AND METHODS

(71) Applicant: Shoot-A-Way, Inc., Upper Sandusky, OH (US)

(72) Inventor: John G Joseph, Upper Sandusky, OH (US)

(73) Assignee: Shoot-A-Way, Inc., Upper Sandusky, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/249,473

(22) Filed: Jun. 25, 2025

Related U.S. Application Data

(63) Continuation-in-part of application No. 18/971,838, filed on Dec. 6, 2024, which is a continuation-in-part (Continued)

(51) Int. Cl.

| | |
|---|---|
| ***A63B 69/40*** | (2006.01) |
| ***A63B 63/00*** | (2006.01) |
| ***A63B 63/08*** | (2006.01) |
| ***A63B 69/00*** | (2006.01) |
| ***A63B 71/06*** | (2006.01) |

(52) U.S. Cl.
CPC ..... *A63B 69/408* (2013.01); *A63B 63/083* (2013.01); *A63B 69/0071* (2013.01); *A63B 71/0622* (2013.01); *A63B 2063/001* (2013.01); *A63B 2071/0675* (2013.01)

(58) Field of Classification Search
CPC . A63B 69/406; A63B 69/0071; A63B 69/408; A63B 63/083; A63B 71/0622; A63B 2063/001; A63B 2071/0675
See application file for complete search history.

(56) References Cited

U.S. PATENT DOCUMENTS

| | | | | |
|---|---|---|---|---|
| 5,776,018 A * | 7/1998 | Simpson | ..... | A63B 24/0021 473/480 |
| 6,186,133 B1 * | 2/2001 | Battersby | ..... | G09B 19/0038 124/78 |

(Continued)

*Primary Examiner* — John E Simms, Jr.
*Assistant Examiner* — Amir A Klayman
(74) *Attorney, Agent, or Firm* — Standley Law Group LLP; Jeffrey S. Standley; Adam J. Smith

(57) ABSTRACT

A basketball launching system, apparatus, and methods are disclosed which provide multiple types of basketball passes. A controller is in electronic connection with a user interface and a throwing mechanism supported by a structural framework. The controller generates prompt(s) at the user interface requesting a user to select pass receipt locations and option(s) for the user to select a pass type. The controller receives data from the user interface indicating user input provided in response to the prompt(s) and any selection of the option(s). The controller commands the throwing mechanism to launch at least one basketball to each of the user selected pass receipt locations, and causes the basketballs to be launched in accordance with the selection of the one or more options regarding the pass type, where provided.

19 Claims, 49 Drawing Sheets

Related U.S. Application Data of application No. 18/818,678, filed on Aug. 29, 2024, which is a continuation of application No. 17/547,338, filed on Dec. 10, 2021, now Pat. No. 12,478,852, which is a continuation of application No. 17/238,930, filed on Apr. 23, 2021, now Pat. No. 12,076,632.

(60) Provisional application No. 63/142,570, filed on Jan. 28, 2021, provisional application No. 63/014,765, filed on Apr. 24, 2020.

(56) References Cited

U.S. PATENT DOCUMENTS

| | | | | |
|---|---|---|---|---|
| 6,224,503 | B1 * | 5/2001 | Joseph | A63B 63/083 473/436 |
| 7,766,770 | B2 * | 8/2010 | Cucjen | A63B 69/406 124/78 |
| 9,555,307 | B1 * | 1/2017 | Lewis | A63B 65/12 |
| 10,471,330 | B1 * | 11/2019 | Hart | A63B 69/406 |
| 10,596,436 | B1 * | 3/2020 | Campbell | A63B 69/0071 |
| 12,303,759 | B1 * | 5/2025 | Joseph | A63B 69/408 |
| 12,508,485 | B1 * | 12/2025 | Pan | A63B 69/0071 |
| 2014/0305420 | A1 * | 10/2014 | Deese | A63B 69/406 124/78 |
| 2016/0325168 | A1 * | 11/2016 | Campbell | A63B 69/408 |
| 2017/0095716 | A1 * | 4/2017 | Lewis | A63B 69/40 |
| 2017/0282044 | A1 * | 10/2017 | Moore | A63B 47/02 |
| 2023/0053992 | A1 * | 2/2023 | Krivak | A63B 69/0071 |
| 2025/0032878 | A1 * | 1/2025 | Adams | A63B 63/083 |
| 2025/0325875 | A1 * | 10/2025 | Marty | A63B 69/40 |

* cited by examiner 256
258
276
277
278
271
272
273
274
275
279
START
END
START
END
START
END PHOTO ZONE
CONTINUE
PHOTO ZONE
CONTINUE
1
2
3
4
5
1 meter
1 meter
1 meter

256

260

BASKETBALL LAUNCHING APPARATUS PROVIDING MULTIPLE TYPES OF BASKETBALL PASSES, RELATED SYSTEMS AND METHODS

CROSS-REFERENCE TO RELATED APPLICATIONS

This application is a continuation-in-part of U.S. application Ser. No. 18/971,838 filed Dec. 6, 2024, which is a continuation-in-part of U.S. application Ser. No. 18/818,678 filed Aug. 29, 2024, which is a continuation of U.S. application Ser. No. 17/547,338 filed Dec. 10, 2021, which is a continuation of U.S. application Ser. No. 17/238,930 filed Apr. 23, 2021, which claims the benefit of U.S. Provisional Application Ser. No. 63/014,765 filed Apr. 24, 2020, and U.S. Provisional Application Ser. No. 63/142,570 filed Jan. 28, 2021, the disclosures of all of which are hereby incorporated by reference as if fully restated herein.

TECHNICAL FIELD

Exemplary embodiments relate generally to a basketball launching apparatus providing multiple types of basketball passes as well as related systems and methods.

BACKGROUND AND SUMMARY OF THE INVENTION

Traditionally, basketball players desiring to practice their shooting were required to gather a number of basketballs, shoot the basketballs towards a basketball goal, and subsequently gather the scattered basketballs from their shooting attempts in order to make additional shooting attempts. In recent years, basketball rebounding machines have emerged which facilitate the gathering and passing of basketballs to a player at various locations on a basketball playing area to facilitate repetitive shooting attempts. Some such rebounding machines utilize ramps or otherwise rely on gravity to return the basketballs to the user. Other such rebounding machines utilize passing devices to launch the basketballs to various locations on the basketball playing area. Examples of rebounding machines utilizing such passing devices include THE GUN® from Shoot-A-Way of Upper Sandusky, Ohio (https://shootaway.com/) and DR. DISH from Airborne Athletics of Minneapolis, Minnesota (https://www.drdishbasketball.com/). What is needed is a basketball launching device which is reliable, cost effective to manufacture, and/or mimics a human basketball pass.

A basketball launching device which is reliable, cost effective to manufacture, and/or mimics a human basketball pass is provided. A motor may turn a drive shaft coupled to a linkage. A ram may be connected to one or more arms forming the linkage. The linkage may be connected to a rotation device such that turning of the motor is translated into a back and forth swinging motion of the ram. The ram may cycle between engaging and pushing a first portion of a catapult arm and engaging and pushing an engagement arm.

As the ram engages and pushes the catapult arm, the catapult arm may be forced to rotate about the rotation device into a second position where an attachment portion on the catapult arm is received within a notch of the engagement arm. In the second position, the catapult arm may extend primarily in a horizontal direction. A spring may be attached to a second portion of the catapult arm and may increase in length, and thus tensioning forces, as the catapult arm is moved into the second position. A basketball may be positioned onto a basketball holder, which may be located at a first portion of the catapult arm.

The ram may subsequently contact and push the engagement arm, thereby releasing the attachment portion from the notch, and thus release the catapult arm. The spring may force the catapult arm to rapidly rotate. A stop bar may arrest the catapult arm from rotation beyond a first position where the catapult arm extends primarily in a vertical direction such that the basketball is launched to a user. The motor may continue to turn, thus repeating the cycle any number of times.

The spring may be connected to a tension adjustment member. The tension adjustment member may be secured in one of a number of positions along a post to adjust the tensioning forces in the spring, and thus the throwing force of the catapult arm and the throwing distance of the basketball.

In exemplary embodiments, a user interface may be provided. The user interface may be in electrical communication with the aforementioned launching mechanism, or another launching mechanism, directly or by way of one or more intermediate components such as, but not limited to, a controller. The user interface may be configured to receive a user selection of locations for the launcher to pass the basketballs to, timing between such launches, order of such launches, distance of such launches, combinations thereof, or the like. The user interface may comprise a touch screen or electronic display. A visual depiction of various components of a traditional basketball playing area may be provided at the user interface, such as but not limited to a baseline, key, and/or three-point line. The locations may be displayed and updated as they are selected by the user. Such updates may include illumination, highlighting, colorization, changing or other alteration of the displayed graphic, combinations thereof, or the like. Alternatively, no such locations may be displayed and the user's touch at a given point may cause a location to be displayed as the user selections are made. For example, an icon or the like may appear approximately where selected by the user. The user interface may be configured to permit the user to create any number of custom practice arrangements.

The user interface may be configured to permit revision of the selected locations after their initial selection, such as before the custom practice arrangement begins, during the practice session, or after the practice session is completed. In exemplary embodiments, the selected locations may be moved, such as but not limited to by a tap and drag technique, to move them from an initial location to a new location. In some embodiments, the order of the selected locations within the custom practice arrangement may be left unchanged. In other embodiments, the order of the selected locations within the custom practice arrangements may by automatically renumbered such that the basketballs are always passed in a particular order, such as but not limited to from right to left or left to right, closest to furthest, further to closest, etc.

In exemplary embodiments, the user interface may be configured to record the distance the selected location is from the launcher. For example, without limitation, some of the selected locations may be provided in front of the visual depiction of the three-point arc, while others may be provided behind. The user interface may be configured to note such distances.

The user interface may be configured to communicate the selected locations forming the custom practice arrangements to the launcher, such as but not limited to, by way of the controller. For those locations further from the launcher, the launcher may be configured to automatically launch basketballs with greater force (thus causing their normal passing distance to increase). Likewise, for those locations closer to the launcher, the launcher may be configured to automatically launch basketballs with less force (thus causing their normal passing distance to decrease). Such distance adjustment may be performed manually and/or by an automatic distance adjustment mechanism.

Alternatively, or additionally, the controller and/or user interface may be configured to assign points to each shooting attempt based on the distance from the launcher and/or basketball goal. For example, without limitation, those locations located behind the visual depiction of the three-point line may be assigned three points while those locations located in front of the three-point arc may be assigned two points. Such points may only be determined and/or recorded by the user interface, controller, or another component upon detection of a successfully made shot corresponding with a pass of a basketball to the respective location.

In exemplary embodiments, the automatic distance adjustment mechanism may comprise a movement imparting mechanism connected to a flexible member, such as a wire, rope, cable, or the like. The flexible member may travel about a pulley, or multiple pulleys (e.g., in one or more blocks), to a first linkage member. The first linkage member may be pivotally connected to a support member or platform. The first linkage member may be configured for counterclockwise movement upon retraction of said flexible member. A second linkage member may be pivotally connected to a support frame or platform, such as but not limited to a post extending therefrom.

The second linkage member may comprise a protrusion or guide extending from a second end thereof. The guide or protrusion may be configured to physically interact with at least a portion of the first linkage member. In exemplary embodiments, counterclockwise movement of said first linkage member may be configured to cause clockwise movement of said second linkage member, such as by way of contact with said guide or protrusion. The tensioning spring may be connected to the second linkage member such that movement of the second linkage member results in increased or decreased forces on said tensioning spring, thereby increasing or decreasing forces on the catapult arm and thus the forces the basketballs are launched with and the distance the basketballs travel if otherwise unimpeded. In exemplary embodiments, clockwise rotation of said second linkage member may be configured to increase tensioning forces on said tensioning spring.

Particularly as basketball launching devices are increasingly capable of providing relatively complex passing arrangements, and users desire increasingly complex passing arrangements as part of practice drills, it becomes increasingly difficult for users to remember where they should be located on the court and/or what actions they should take as part of a programmed drill. Basketball launching devices are disclosed which provides next pass indications. The next pass indications may include an icon, provided in isolation from other icons and/or in highlighted form, at a location at a visual representation of the playing area, which may correspond to (e.g., match) the visual representation used to select pass locations, corresponding to the user selected or otherwise programmed next pass location. Optionally, the next pass indications may include descriptive labels, each corresponding to a user selected or otherwise programed user action to be performed (e.g., pre- and/or post-pass skills exercise). The next pass indications may each be generated at an electronic display in response to commands by a controller, such as before and/or while the controller commands the launching device to launch the respective next pass. In exemplary embodiments, without limitation, the electronic display (e.g., with the next pass indications) is provided to face users of the basketball launching device (e.g., players), such as by mounting or otherwise connecting to a forward facing surface of a housing of the launching device. Alternatively, or additionally, the next pass indicator(s) may be provided at a user interface display for programming the basketball launching device.

To simulate game conditions, provide varying practice options, and/or for other reasons, it is desirable to provide multiple, different types of basketball passes. Such types of passes may include, by way of example, approximately chest level passes (e.g., between an average height player's knees and head; also referred to as a chest pass) or passes which strike the ground, such as approximately half to three-quarters of the way of an intended target delivery point at approximately chest level (also referred to as a bounce pass) to a desired, candidate location, by way of non-limiting example. The type of pass delivered may remain consistent across candidate locations, or vary, such as based on use preferences, manual assignment (e.g., of pass type) to all locations, on a location-by-location specific basis, and/or for a group of locations, randomized variations, default selection, combinations thereof, or the like.

One or more user interfaces may be generated, such as at and/or by way of the controller local to the basketball machine, and/or at and/or by way of a remote electronic device (e.g., tablet, smartphone, computer, or the like). The user interface(s) may include various prompts selecting pass receipt locations and/or pass type. User input data received in response to generation of the user interface(s) and/or prompt(s) may be used for programming the machine, such as by way of the local controller. The pass type selection, in exemplary embodiments without limitation, is made separately from a pass location selection. The pass location selection may include angular position and/or linear distance relative to the machine. Such position information may be determined by position of indicated (e.g., touched) locations at a rendering of part of a basketball playing surface (e.g., one or more court lines) and/or of the basketball launching machine relative to one or more reference points at the interface, which may be one or more of the rendered items or otherwise.

Where a bounce type pass is selected for one or more pass locations, the controller may command the launching device accordingly, such as in accordance with one or more predetermined algorithms. In exemplary embodiments, without limitation, where a bounce type pass is selected, the controller may command the launching device to provide half of a speed and/or force the launching device would normally provide for a chest type pass for a given location. Such adjustments may be made by way of a distance control mechanism, which may operate the actuator to adjust a spring load force on a catapult type throwing arm, in exemplary embodiments, without limitation.

The amount of adjustment may be predetermined. For example, without limitation, the controller may comprise, and/or be in electronic communication with, a table of actuator positions and/or adjustment criteria (e.g., number of turns, time of operation, actuator end position, position of another portion of the actuator, combinations thereof, or the like) to achieve various launching forces and/or speeds. A position of the actuator, spring, throwing arm, and/or other component(s) of the launching mechanism and/or distance adjustment device may be, alternatively or additionally, determined based on data from the actuator and/or one or more sensors (e.g., optical sensors).

While a discussion is sometimes made herein of a catapult type launching mechanism and/or actuator based distance adjustment mechanism, the pass type adjustment and control feature(s) shown and/or describe herein may be utilized with other types and/or kinds of launching mechanisms and/or distance adjustment devices. For example, without limitation, such adjustments may include adjusting an air pressure to piston which strikes the basketball or causes the basketball to be struck, adjustment to a spring load force on a basketball striking arm (immediately and/or open operation of the throwing mechanism), adjustment to a speed of one or more motors connected to wheels for launching basketballs, combinations thereof, or the like.

By way of non-limiting example, a lookup table of actuator positions, speeds, pressures, spring positions, combinations thereof, or the like, may be queried based on a desired position of the pass, which may be derived from position of touched location at the user interface or otherwise. The result may be adjusted in accordance with an algorithm, such as to an equivalent half or other distance location, where a bounce pass is selected. Alternatively, the algorithm may be applied to adjust the position prior to the lookup so that the result may be used. Other factors may, alternatively or additionally, be included in the analysis, such as scaling values, court type, player height, drag values, combinations thereof, or the like. These factors may be applied through one or more compensation values and/or multi-factor equation(s). This analysis may provide a repeatable, game-like pass. These values may be subject to maximum and minimum operational parameters, such as for safety, machine capabilities, combinations thereof, or the like.

One or more intermediary components may be utilized between the various mechanical components described herein, such as but not necessarily limited to, levers, linkages, cables, chains, sprockets, cams, wheels, gears, combinations thereof, or the like.

In exemplary embodiments, without limitation, the machine may default to chest passes unless a specific selection is made by a user to alter a pass to another type, such as a bounce pass.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
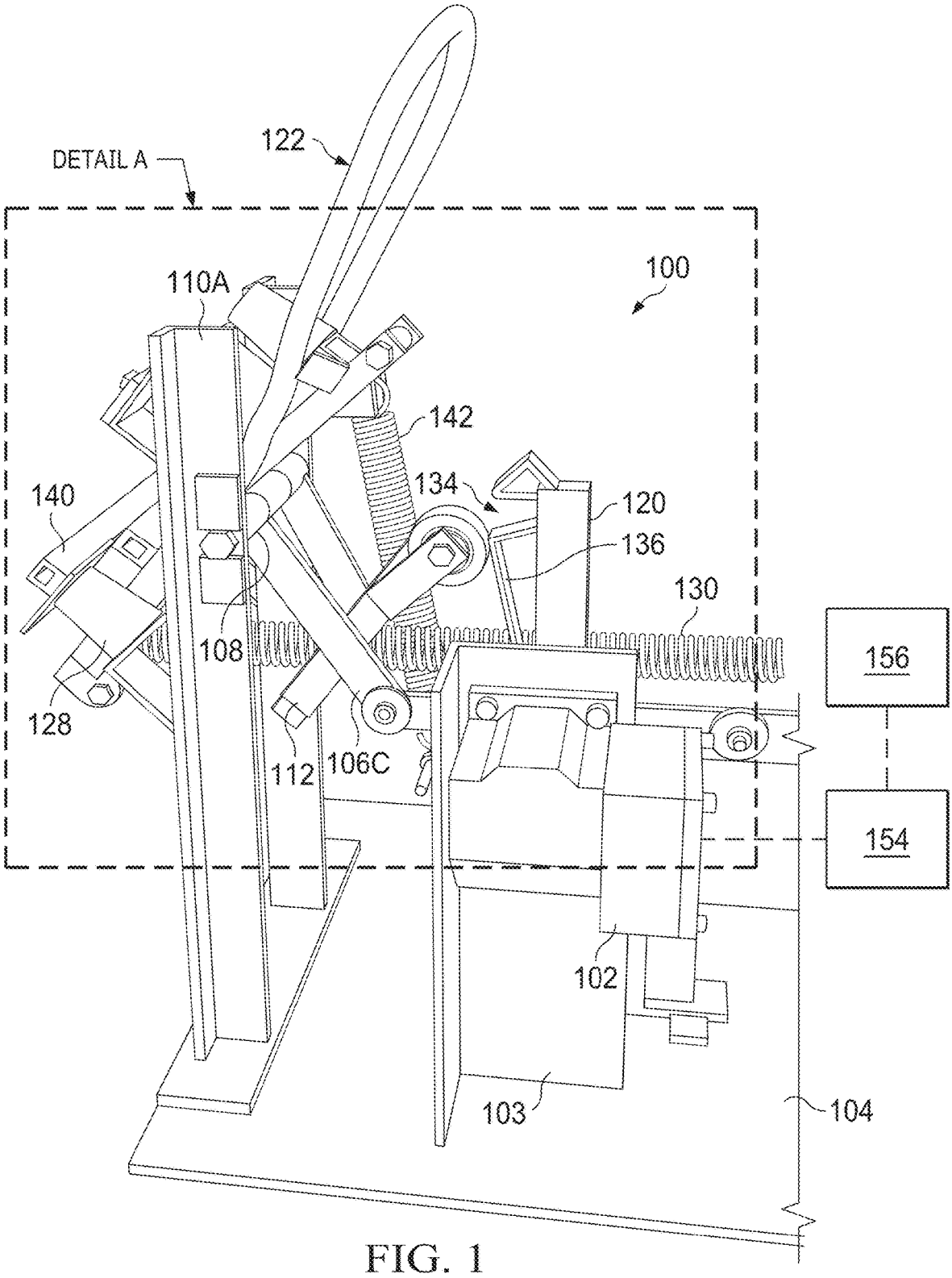
FIG. 1 is a side view of an exemplary basketball launching device in accordance with the present invention where the basketball launching device is in a first position.
Figure 2:
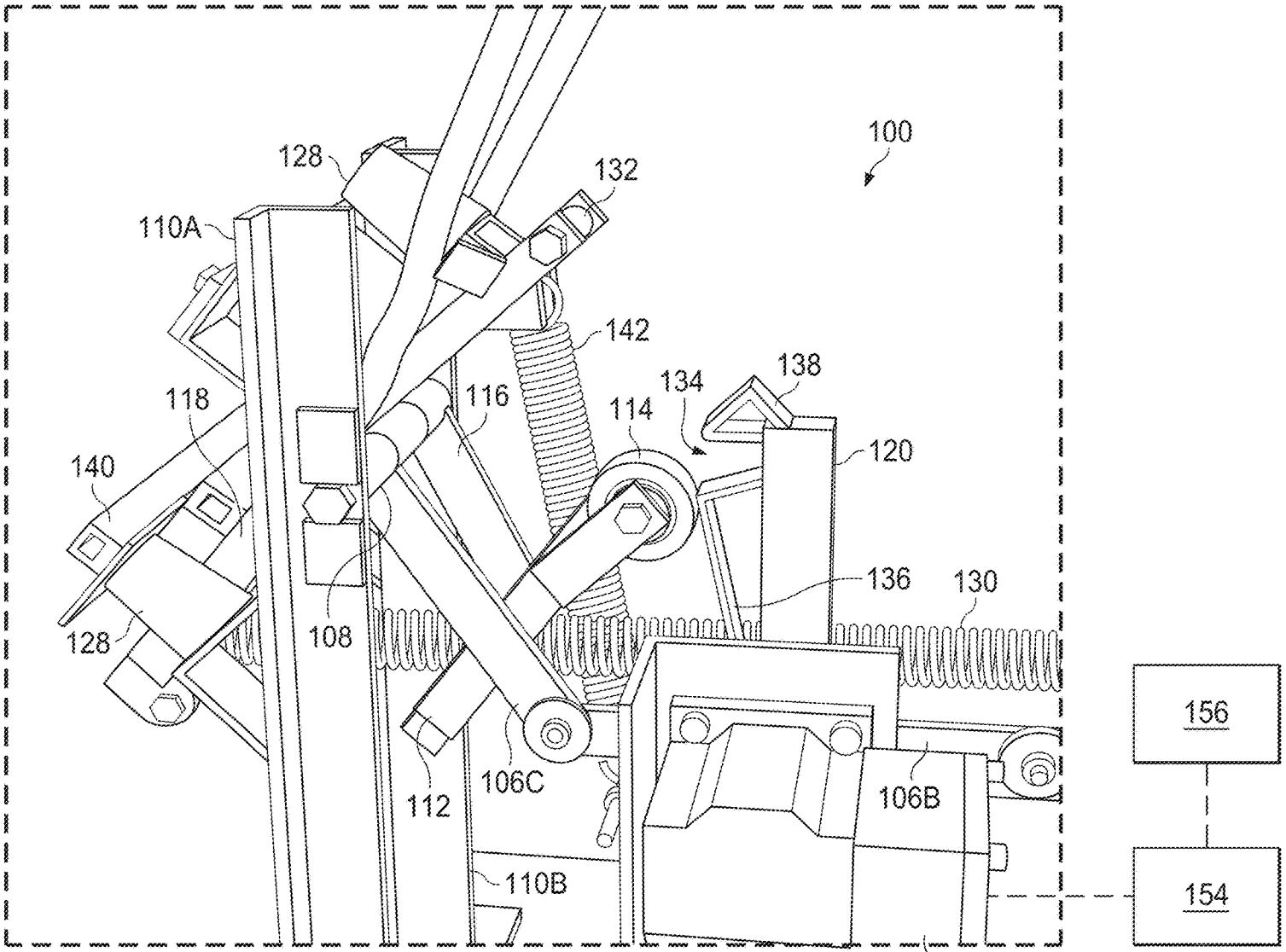
FIG. 2 is an enlarged side view of Detail A indicated in FIG. 1.
Figure 3:
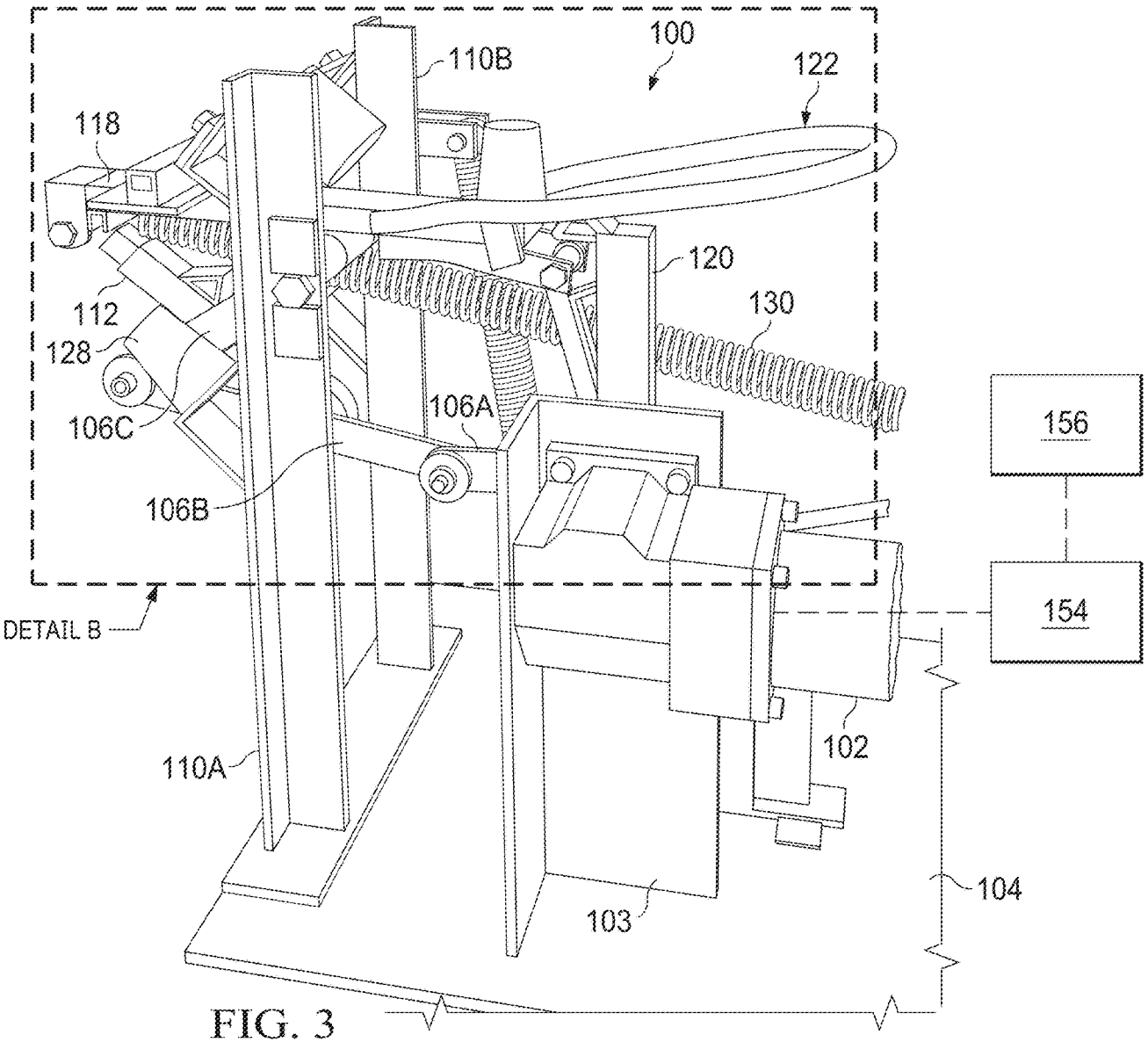
FIG. 3 is a side view of the basketball launching device of FIG. 1 in a second position.
Figure 4:
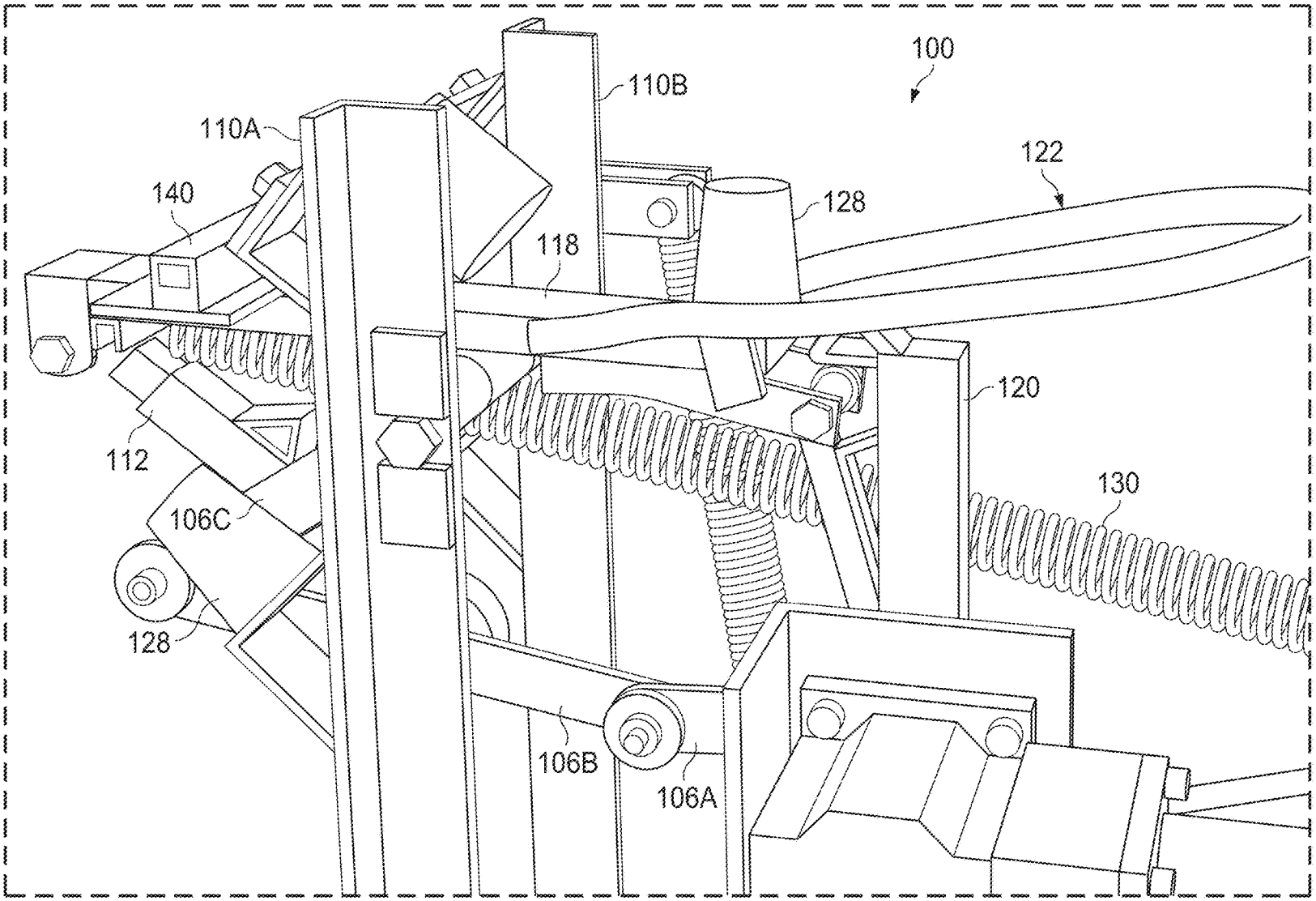
FIG. 4 is an enlarged side view of Detail B indicated in FIG. 3.
Figure 5:
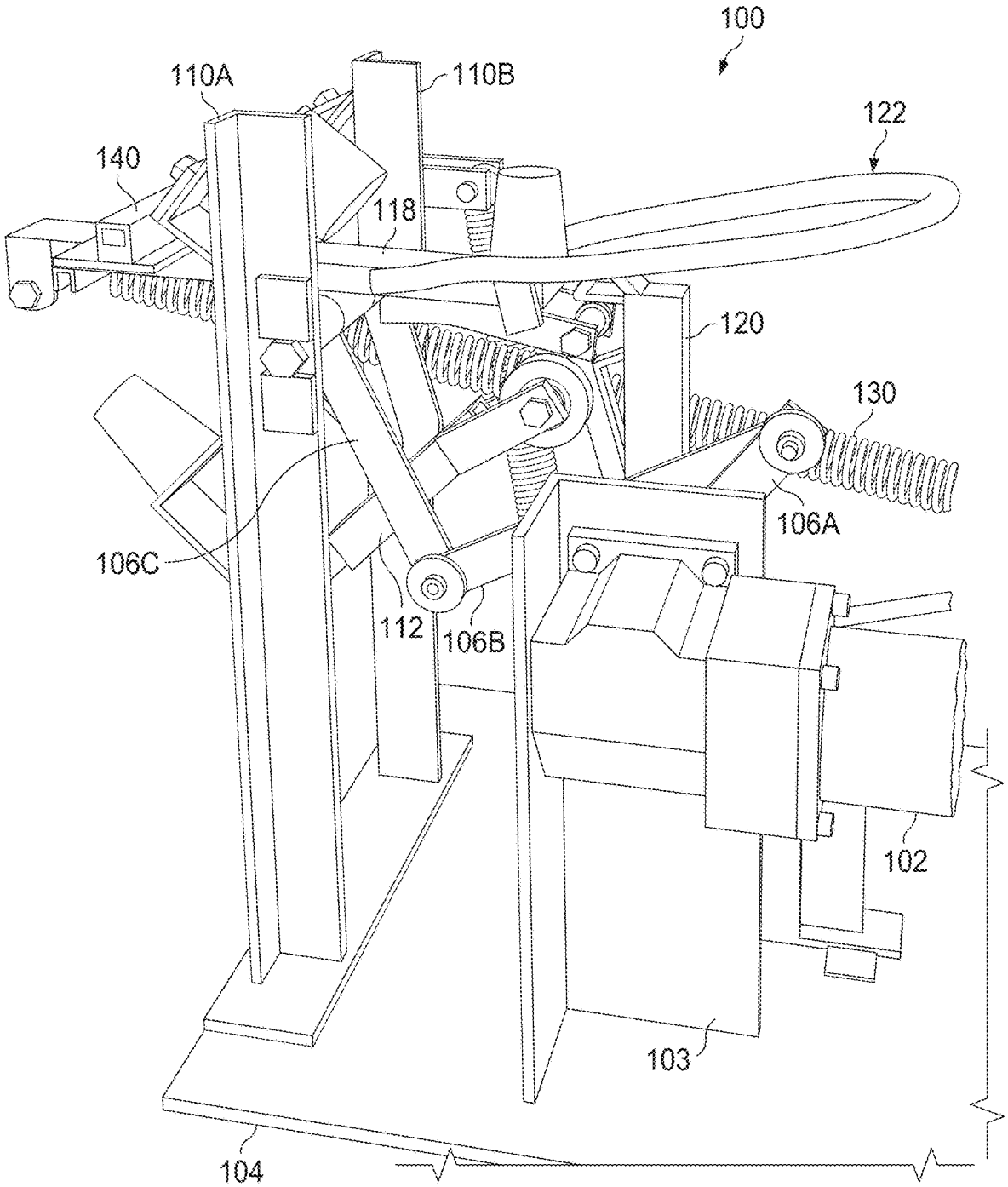
FIG. 5 is a side view of a portion of the basketball launching device of FIG. 1 in the second position.
Figure 6:
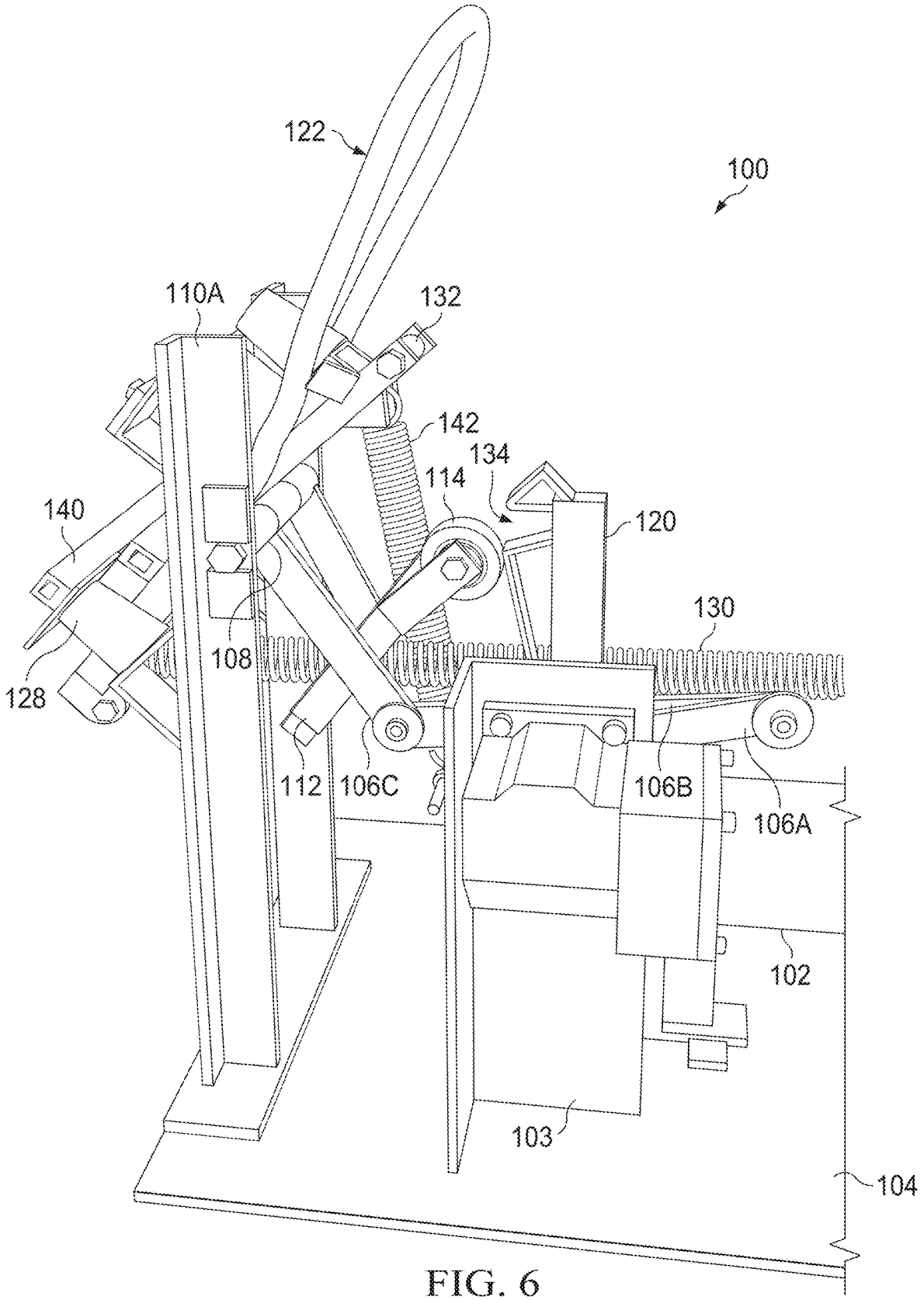
FIG. 6 is a side view of a portion of the basketball launching device of FIG. 1 in the first position.
Figure 7:
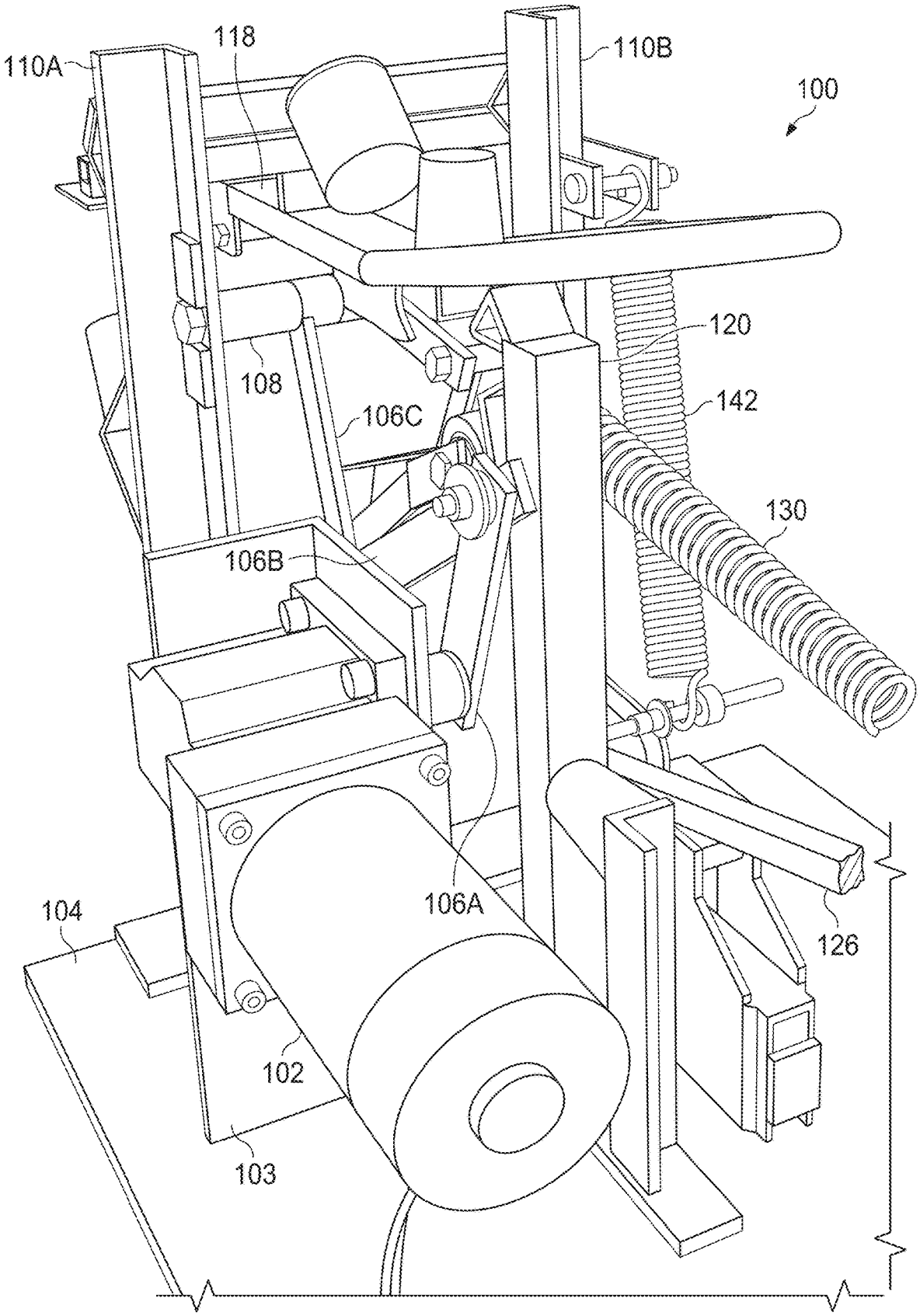
FIG. 7 is a rear view of a portion of the basketball launching device of FIG. 1 in the second position.
Figure 8:
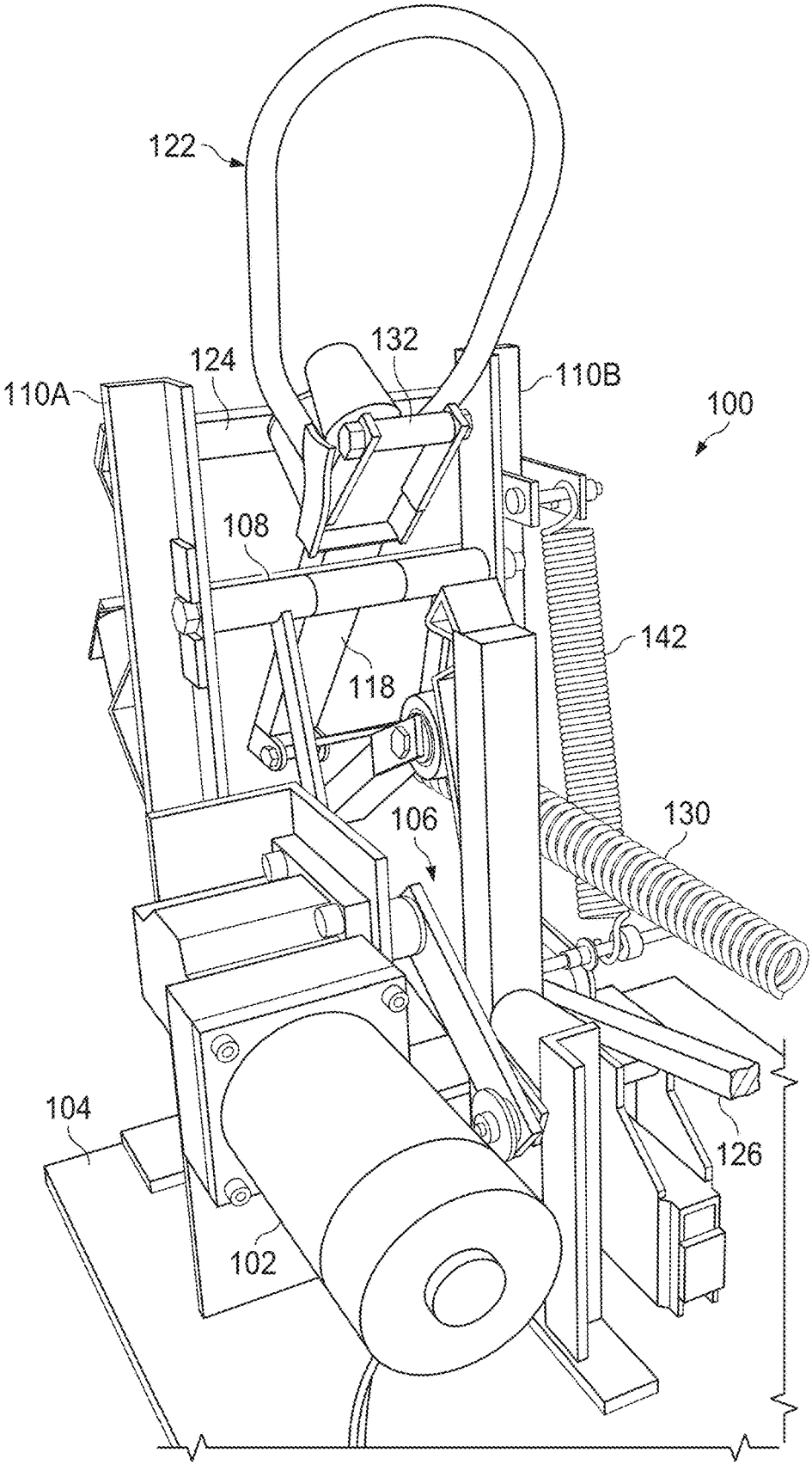
FIG. 8 is a rear view of a portion of the basketball launching device of FIG. 1 in the first position.
Figure 9:
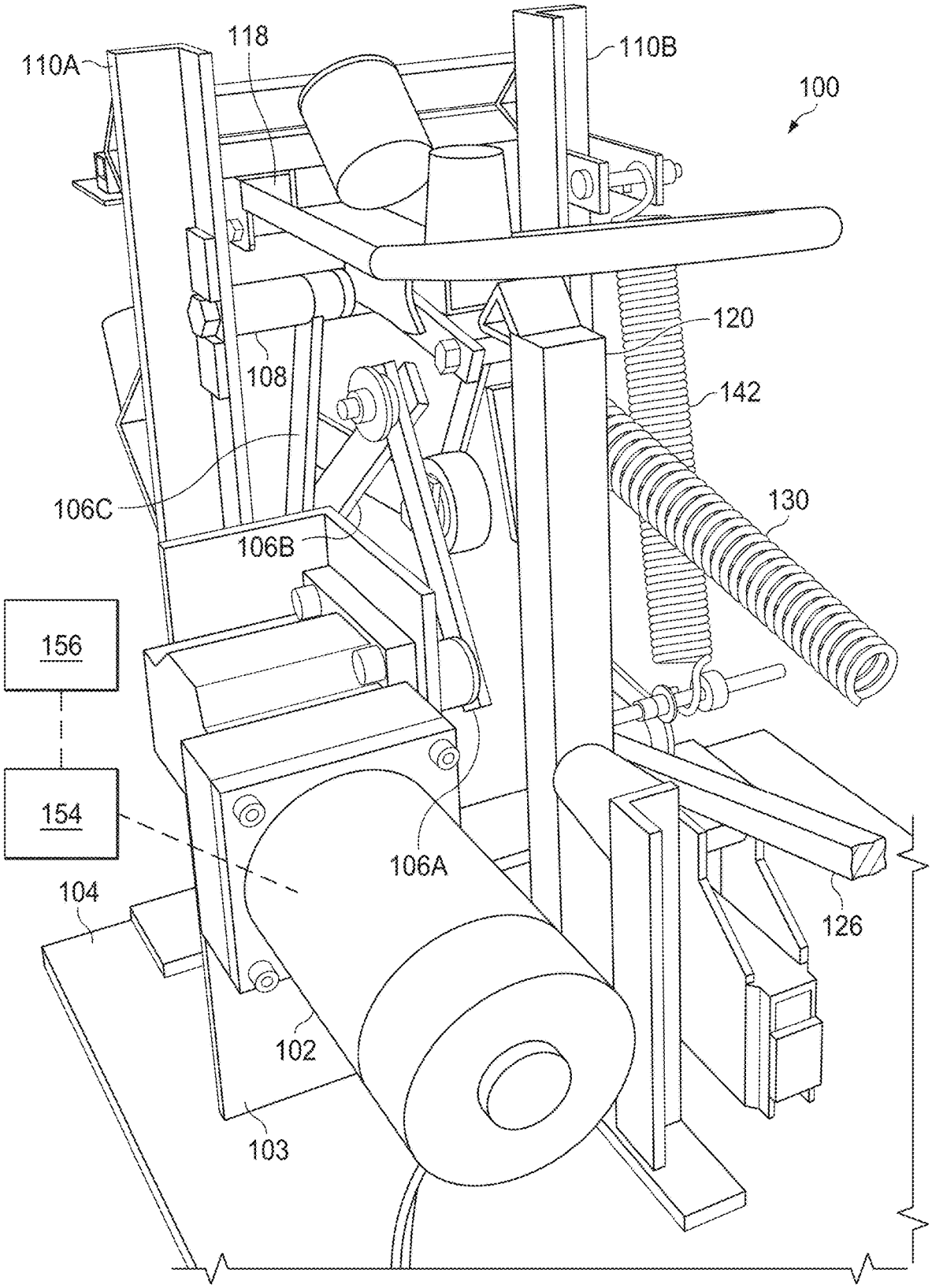
FIG. 9 is a rear perspective view of a portion of the basketball launching device of FIG. 1 in the second position.
Figure 10:
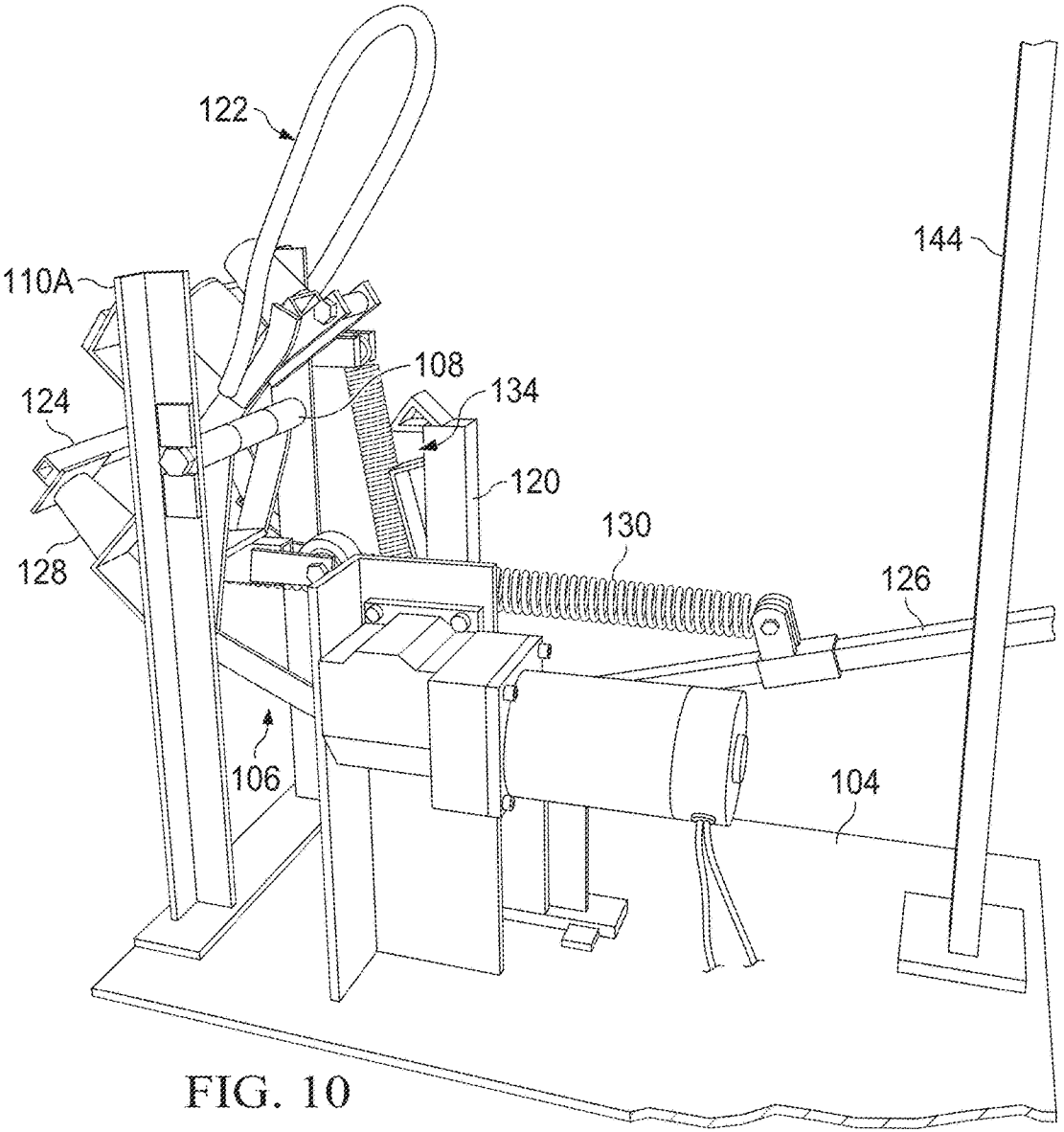
FIG. 10 is a side view of the basketball launching device of FIG. 1 in the first position.

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

FIG. 1 through FIG. 10 illustrates various views of an exemplary basketball launching device 100. A motor 102 may be mounted to a mounting structure 104. The mounting structure 104 may comprise one or more platforms, members, combinations thereof, or the like. However, the motor 102 may be mounted to any surface, such as but not limited to a frame, post, member(s), some combination thereof, or the like. In exemplary embodiments, the mounting structure 104, or one or more components attached thereto, may be configured for rotational and/or pivoting movement such that a direction of the basketball launching device 100, or components thereof, may be adjusted. The motor 102 may be mounted at an elevated position above the mounting structure 104 by way of one or more brackets 103, though such is not required. The mounting structure 104 may comprise a flat surface and/or a series of members forming a framework. The mounting structure 104 may comprise one or multiple surfaces and/or members.

The motor 102 may be coupled to a linkage 106. In exemplary embodiments, the linkage 106 may comprise three rigid, straight-line arms 106A, 106B, and 106C, though any number of arms or any type or kind, or other components, may be utilized. A proximal portion of a first arm 106A may be coupled to a drive shaft of the motor 102 such that the first arm 106A extends therefrom. In this way, the first arm 106A may act as a crank. A proximal portion of the second arm 106B may be connected to a distal portion of the first arm 106A. A distal portion of the second arm 106B may be connected to a proximal portion of the third arm 106C. A distal portion of the third arm 106C may be connected to a rotation device 108. The rotation device 108 may comprise an axle extending between the supports 110A, 110B. The connections between the first, second, and third arms 106A, 106B, and 106C may permit rotation relative to one another. For example, without limitation, a pin may be passed through the connection point between the first arm 106A and the second arm 106B as well as the connection point between the second arm 106B and the third arm 106C. The third arm 106C may be fixed to the rotation device 108 in a way which facilitates rotation of the third arm 106C. The linkage 106 may be configured to translate turning of the drive shaft of the motor 102 into movement of the three arms 106A, 106B, and 106C. In exemplary embodiments, the rotation device 108 may comprise a cylinder extending between support posts 110A and 110B. The rotation device 108 may, alternatively or additionally, comprise one or more screws, pins, posts, cams, cylinders, some combination thereof, or the like. Any device configured to permit rotational movement may be utilized. The third arm 106C may be connected to a sleeve extending about the cylinder of the rotation device 108.

A ram 112 may be mounted to the linkage 106. In exemplary embodiments, the ram 112 may be mounted to the third arm 106C. The ram 112 may comprise a rigid member. The ram 112 may be configured to exert a force on a catapult arm 118, and separately on an engagement arm 120 when moved. For example, without limitation, the ram 112 may be mounted at a non-zero angle relative to a longitudinal axis of the respective linkage 106 member, such as but not limited to the third arm 106C. In exemplary embodiments, the ram 112 may be mounted substantially perpendicular to the third arm 106C, though other non-zero angles may be utilized. A wheel 114 may be mounted to a distal portion of the ram 112 for movement along at least a portion of the engagement arm 120. The linkage 106 may be configured to translate turning of the drive shaft of the motor 102 into a back-and-forth swinging motion of the ram 112, for example without limitation, about the rotation device 108. When operated, the ram 112 may alternate between contacting and exerting force on the catapult arm 118 and the engagement arm 120. For example, without limitation, the ram 112 may contact each of the catapult arm 118 and the engagement arm 120 once during a single cycle of the motor 102.

In exemplary embodiments, a support arm 116 may extend between the ram 112 and the rotation device 108 for added support. The support arm 116 may be connected to a sleeve extending about an axle of the rotation device 108, for example without limitation. The support arm 116 may extend substantially parallel to the third arm 106C, though such is not required.

The catapult arm 118 may be placed in a first position. In the first position, a longitudinal axis of the catapult arm 118 may extend in a primarily vertical direction. However, other angles of the longitudinal axis of the catapult arm 118 may be utilized such as, but not limited to, between 35 degrees and 105 degrees. The catapult arm 118 may comprise a basketball holder 122. The basketball holder 122 may be located at a proximal portion of the catapult arm 118, such as a portion which extends rearward of the rotation device 108. In exemplary embodiments, the basketball holder 122 may comprise one or more members formed into an oblong shape creating an area for a basketball to rest. The basketball holder 122 may be comprised of one or more bended tube members, though such is not required.

A first stop bar 124 may extend between distal portions of the support posts 110A and 110B. The catapult arm 118 may be rotatably mounted between the support posts 110A and 110B, such as by way of the rotation device 108. In exemplary embodiments, the catapult arm 118 may be mounted to the rotation device 108 in a manner which facilitates rotational movement of the catapult arm 118 about the rotation device 108. While the catapult arm 118 and the linkage 106 may be connected to the same rotation device 108 in exemplary embodiments, it is contemplated that separate rotation devices 108 may be utilized.

The stop bar 124 may be configured to arrest the catapult arm 118 from rotation beyond the stop bar 124. The catapult arm 118 may be rotated forward, such as in a counterclockwise direction. In exemplary embodiments, a spring 130 may be secured to the catapult arm 118 to provide forces which cause such rotation of the catapult arm 118 when released from the engagement arm 120. For example, the spring 130 may be fixed at a first end thereof, and mounted to a second portion of the catapult arm 118 extending forward of the rotation device 108. The first end of the spring 130 may be fixed to the mounting structure 104, or one or more components extending therefrom. One or more stoppers 128 may be mounted to the catapult arm 118 and/or the stop bar 124. In exemplary embodiments, the stoppers 128 may comprise rubber protrusions placed between the catapult arm 118 and the stop bar 124 to cushion impact between the catapult arm 118 and the stop bar 124.

In exemplary embodiments, a first end of the spring 130 may be attached to a tension adjustment member 126. The attachment location of the spring 130 to the tension adjustment member 126 may be adjusted to increase or decrease the amount of tension in the spring 130, and thus the amount of force exerted on the catapult arm 118. The tension adjustment member 126 may be pivotally mounted to the mounting structure 104 at a proximal portion thereof such that the vertical placement of a distal portion of the tension adjustment member 126 may be adjusted to adjust forces exerted by the spring 130. Stated another way, the tension adjustment member 126 may act as a lever arm. In exemplary embodiments, the vertical placement of the distal portion of the tension adjustment member 126 may be moved between one of a number of positions along a post 144 to increase or decrease the amount of tension in the spring 130, and thus the amount of force exerted on the catapult arm 118. The positions along the post 144 may be defined by vertically spaced protrusions, slots, some combination thereof, or the like. The post 144 may extend vertically from the mounting structure 104. While one spring 130 is discussed, multiple spring 130 of the same or different type may be used.

As the motor 102 cycles, a first portion of the ram 112 may be placed into contact with a distal portion of the catapult arm 118. The first portion of the ram 112 may be driven forward, after contacting the catapult arm 118, to rotate the catapult arm 118 into a second position. The second position may place the catapult arm 118 in a primarily horizontal orientation. However, other positions such as between −45 and 45 degrees may be utilized. This may increase the tension forces in the spring 130. A proximal portion of the catapult arm 118 may comprise an attachment portion 132. In exemplary embodiments, the attachment portion 132 may comprise a cylinder extending between two spaced apart arms. The catapult arm 118, such as but not limited to the attachment portion 132, may be temporarily secured within a notch 134 of the engagement arm 120, such as but not limited to, when the catapult arm 118 is placed in the second position.

The engagement arm 120 may extend primarily in a vertical direction from the mounting structure 104. The engagement arm 120 may be configured to provide limited rotational or other movement of the engagement arm 120 relative to the mounting structure 104. In exemplary embodiments, such limited movement may be caused by flex in the engagement arm 120 and/or the mounting structure 104. In other exemplary embodiments, a pin, rotational device, or other movement mechanism may be utilized.

The engagement arm 120 may comprise a guide 136. The engagement arm 120 may comprise a securement portion 138. The notch 134 may be defined by the engagement arm 120, the guide 136, and/or the securement portion 138. In exemplary embodiments, the guide 136 may comprise a ramp. The guide 136 may extend from, or form part of, a front surface of the engagement arm 120 (e.g., divot, channel, protrusion, combinations thereof, or the like). The guide 136 and the securement portion 138 may extend from the engagement arm 120 as protrusions or may extend into the engagement arm 120 as depressions, some combination thereof, or the like.

As the catapult arm 118 is moved into the second position, the attachment portion 132 may be secured within the notch 134, thus securing the catapult arm 118 in the second position. During such time, a basketball may be moved into the basketball holder 122. For example, without limitation, a basketball may be rolled down a ramp onto the basketball holder 122. A stopper 128 or other protrusion may be positioned on the catapult arm 118 and extend within the basketball holder 122 to assist in holding the basketball in place.

Upon further movement of the motor 102, the ram 112 may be moved away from the catapult arm 118. The second portion of the ram 112 may be moved towards the engagement arm 120. The second portion of the ram 112 may contact the engagement arm 120 and cause sufficient movement of the engagement arm 120 to release the attachment portion 132 from the notch 134. In exemplary embodiments, the wheel 114 may travel along the ramp surface of the guide 136, thereby causing rotational movement of the engagement arm 120. Regardless, once the attachment portion 132 is freed from the notch 134, the forces from the spring 130 may cause the catapult arm 118 to rapidly move into the first position. Upon arrest of the catapult arm 118 at the stop bar 124, the basketball may be thrown from the basketball holder 122, thus resulting in a basketball passing motion to a user.

In exemplary embodiments, a second stop bar 140 may be mounted to a distal portion of catapult arm 118. The second stop bar 140 may be configured to impact stoppers 128 positioned along the support posts 110A and 110B, or the support posts 110A and 110B themselves, so as to further arrest the catapult arm 118 from rotational movement beyond the first position. The second stop bar 140 may be mounted substantially perpendicular to the longitudinal axis of the catapult arm 118, though such is not required. In exemplary embodiments, only the first or second stop bars 124, 140 may be utilized.

A support spring 142 may extend between one of the support posts 110A and 110B and the mounting structure 104. The support spring 142 may be configured to provide rigidity and stability to the support posts 110A and 110B. Additional support springs 142 or other stabilizing devices and/or members may be mounted to the support posts 110A and 110B or other components of the launching device 100.

As the motor 102 is cycled, the catapult arm 118 may be moved between the first and second positions. Each cycle of the motor 102 may be configured to result in one basketball pass, with the launching device 100 continuously resetting itself for the next basketball pass. The disclosed launching device 100 may provide one or more advantages including, for example without limitation, mimicking of a human basketball pass, reduced manufacturing costs, greater reliability, and a more compact design.

The connections, mounting, couplings, and the like described herein may be accomplished by press fits, welding, bonding, adhesives, fasteners, friction fittings, some combination thereof, or the like.

Figure 11:
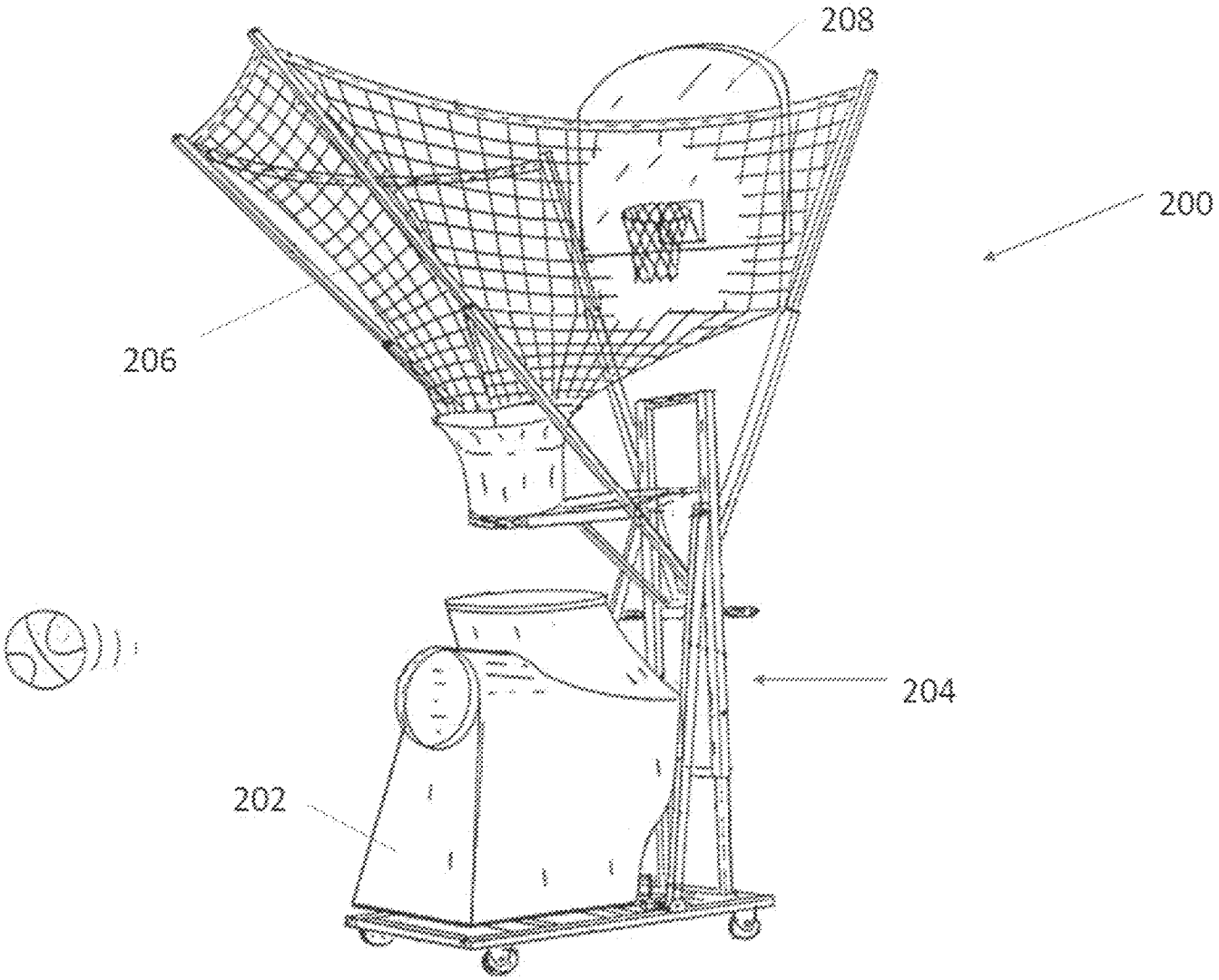
FIG. 11 is an exemplary basketball rebound machine for the basketball launching device of FIGS. 1-10.

FIG. 11 illustrates an exemplary basketball rebound machine 200 for use with the launching device 100. This basketball rebound machine 200 is provided for example and is not intended to be limiting. The basketball launching device 100 may be located within a housing 202. A portion of the frame 204 may extend behind the housing 202. A portion of the frame 204 may extend above the housing 204. The frame 204 may support a net 206. The net 206 may be configured to capture made shots and at least some missed shots and direct the basketballs to the basketball launching device 100. The frame 204 may be adjustable. The basketball rebound machine 200 may be positioned adjacent to a basketball goal 208 when operated. The net 206 may form a funnel shape about a portion of the basketball 208.

Figure 12:
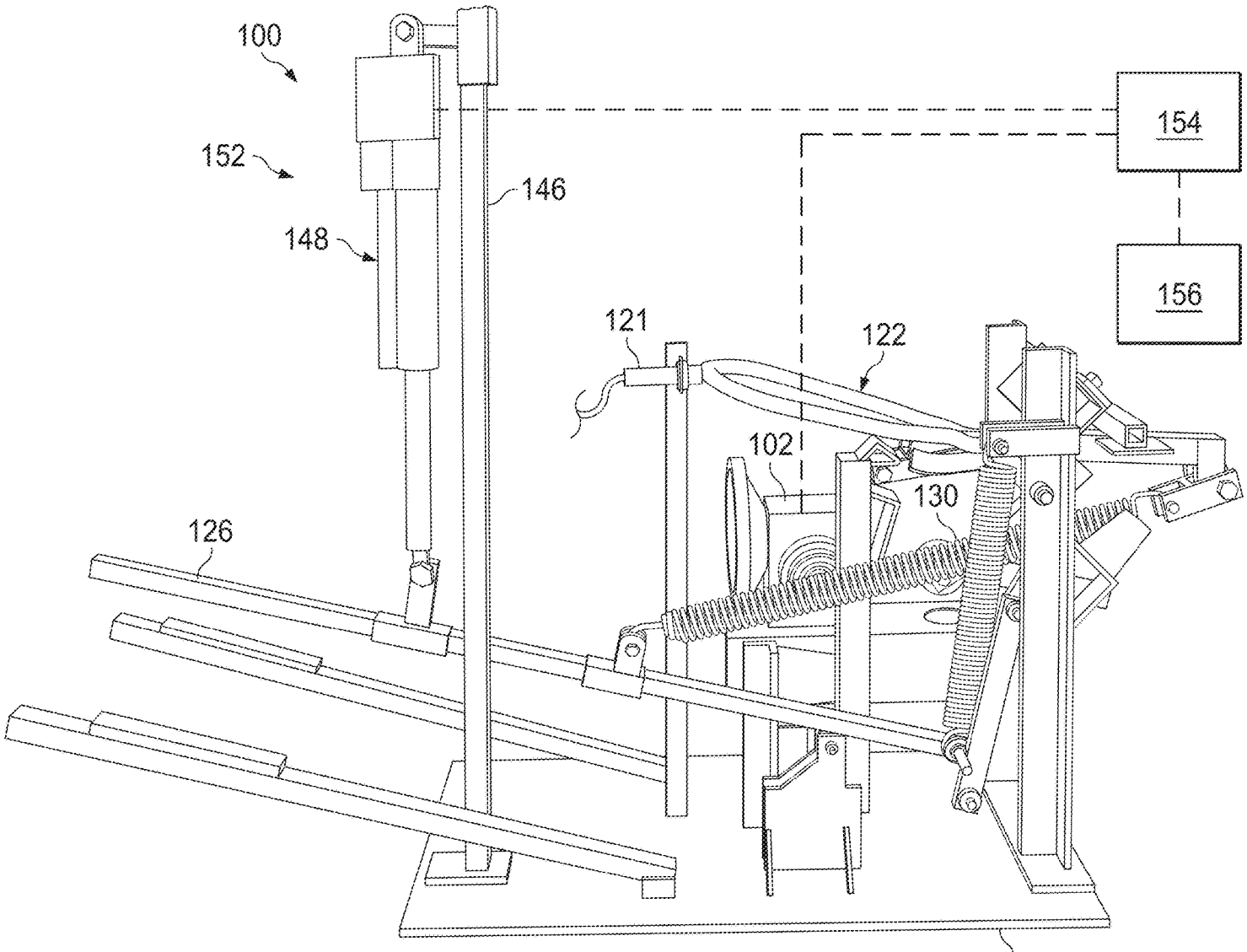
FIG. 12 is a side view of the basketball launching device of FIG. 1 with an exemplary distance adjustment mechanism.
Figure 13:
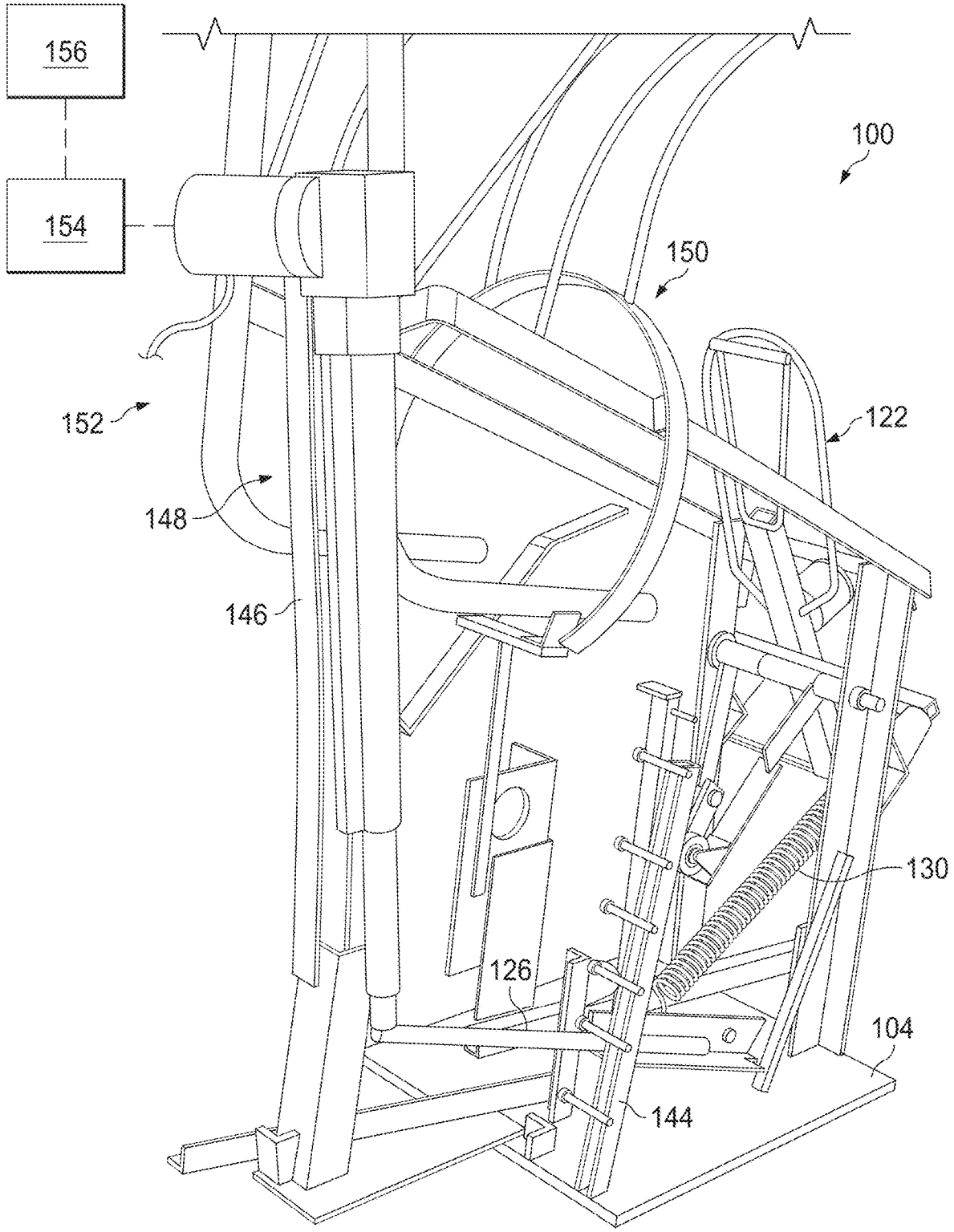
FIG. 13 is a rear perspective view of the device of FIG. 12.
Figure 14:
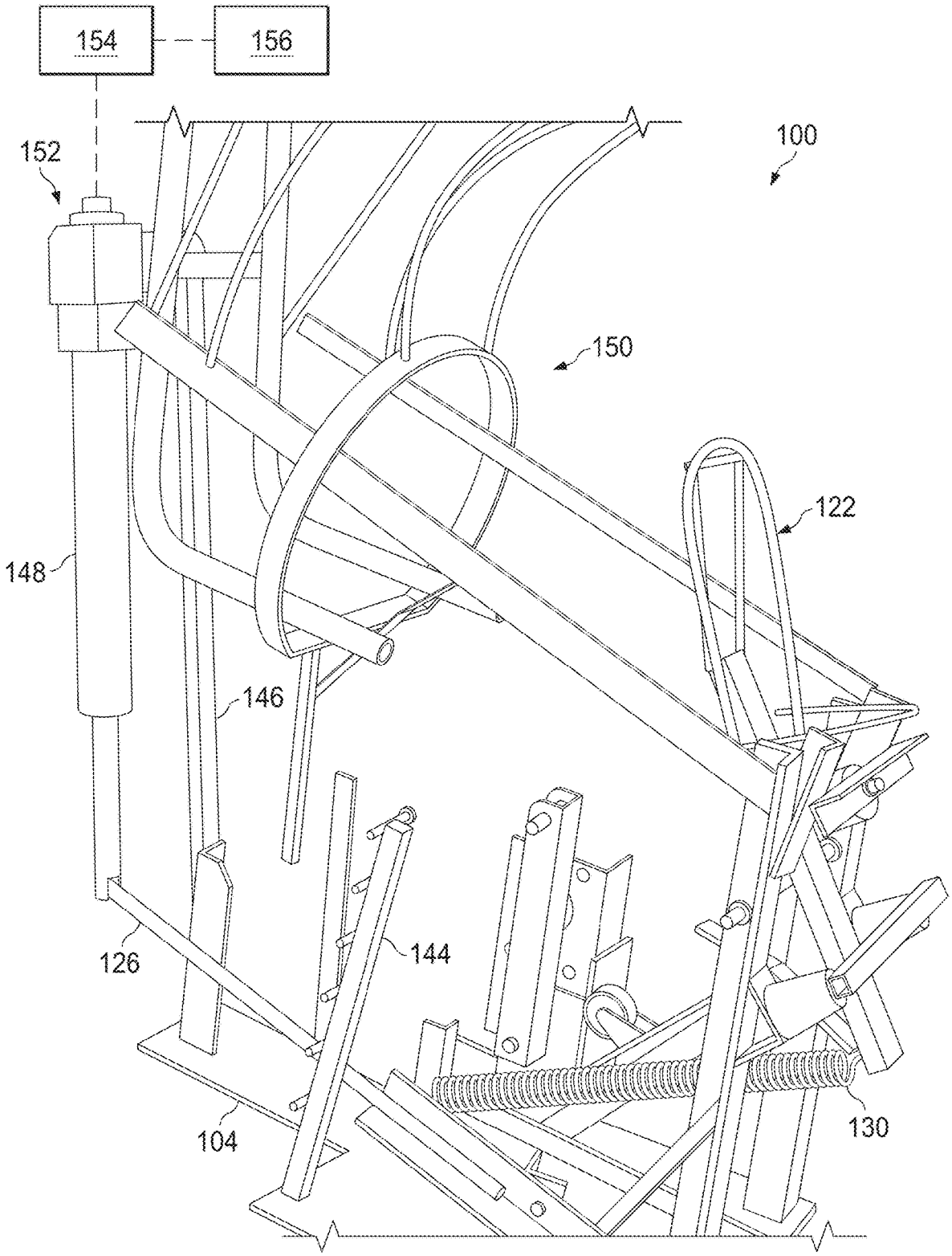
FIG. 14 is a front perspective view of a portion of the device of FIG. 12.

FIG. 12 through FIG. 14 illustrate the basketball launching device 100 with an automatic distance adjustment mechanism 152. The automatic distance adjustment mechanism 152 may be provided in addition to, or alternatively to, the post 144 which permits manual distance adjustment. The automatic distance adjustment mechanism 152 may comprise a support member 146. The automatic distance adjustment mechanism 152 may comprise a movement imparting mechanism 148, such as but not limited to, a movement imparting mechanism, piston, motor, actuator, screw, combinations thereof, or the like. The support member 146 may extend from the mounting structure 104 primarily in a vertical direction, though the support member 146 may extend in any direction. Multiple support members 146 may be utilized to provide adequate bracing. The movement imparting mechanism 148 may be secured to the support member 146. The movement imparting mechanism 148 may comprise a motor and a driver. The motor may be configured to move the driver in a particular direction, such as but not limited to, away from or towards the motor. Any type of movement imparting mechanism 148 or other movement imparting mechanism may be utilized. The movement imparting mechanism 148 may be installed to the support member 146 such that said movement imparting mechanism 148 is configured for movement in a vertical direction. The moving portion of the movement imparting mechanism 148 may be secured to the tension adjustment member 126. Other driving mechanisms and/or mechanical linkages may be interposed between the movement imparting mechanism 148 and the tension adjustment member 126 such as but not limited to, linkages, levers, gears, cams, slots, grooves, some combination thereof, or the like.

The movement imparting mechanism 148 may be configured for vertical movement which is translated into pivoting movement of the tension adjustment member 126, which results in increased or decreased tension forces placed on the spring 130. The increase of tension on the spring 130 may result in the basketball being thrown a greater distance and/or with greater force. The decrease of tension on the spring 130 may result in the basketball being thrown a reduced distance and/or with a reduced amount of force.

A directing device 150 may be provided adjacent to the basketball launching device 100. The directing device 150 may be configured to direct basketballs towards the basketball holder 122. The directing device 150 may form part of the rebounding machine 200.

One or more sensors 121 may be provided adjacent to one or more components of the basketball launching device 100. In exemplary embodiments, a limit switch 121 may be positioned adjacent to the location of the basketball holder 122 when the basketball holder 122 is in the second position. The sensors 121 may be in electronic communication with the controller 154 to determine the position, operating status, or the like, of the basketball holder 122 or other components. Any number of sensors 121 of any kind for any number of components may be utilized.

Figure 15:
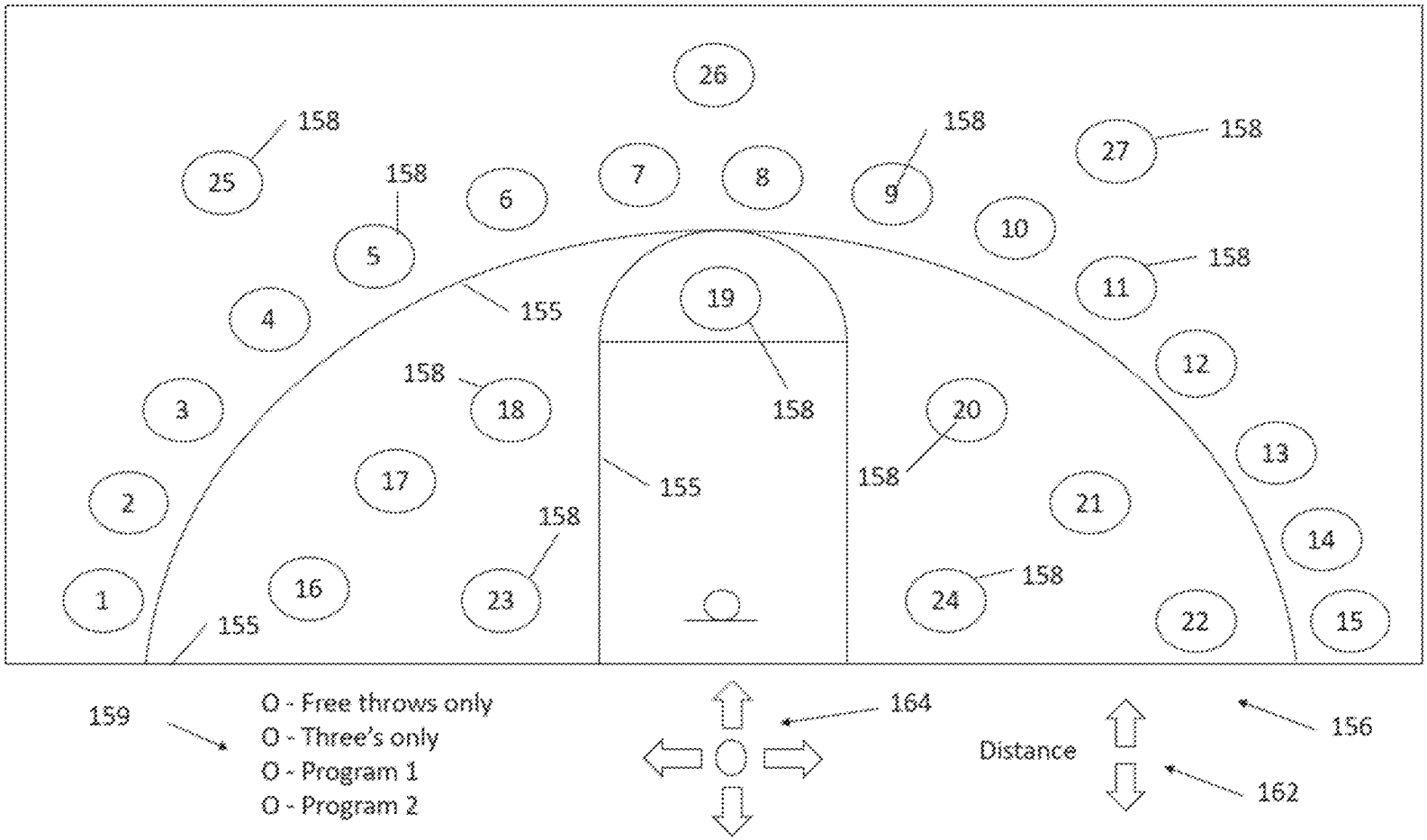
FIG. 15 is a plan view of an exemplary user interface for use with the basketball launching device and/or the distance adjustment mechanism of FIGS. 1-14.
Figure 16:
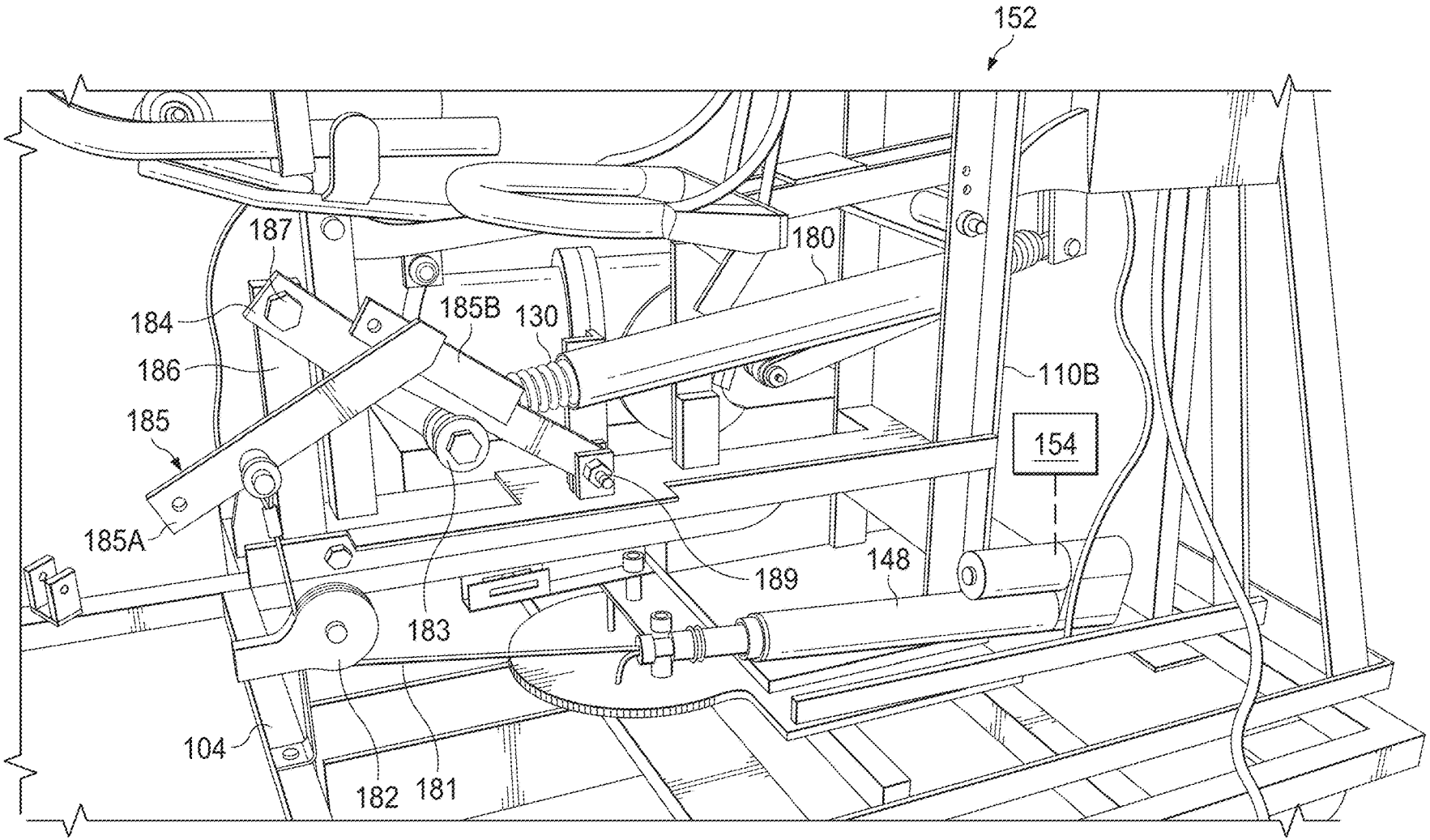
FIG. 16 is a left side view of a portion of the basketball launching device of FIG. 1 with another exemplary distance adjustment mechanism in a first position.
Figure 17:
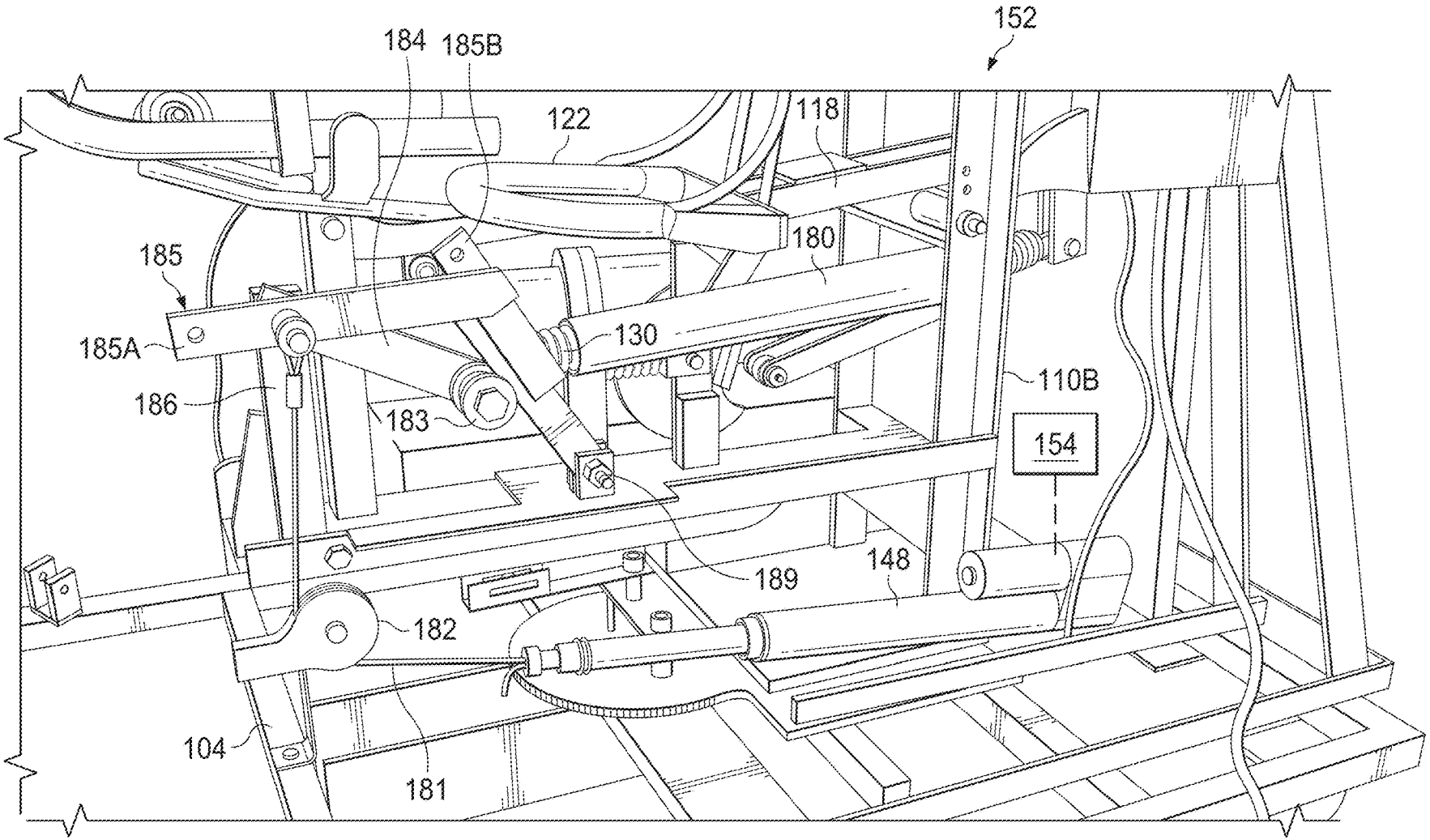
FIG. 17 is a left side view of a portion of the basketball launching device and distance adjustment mechanism of FIG. 16 in a second position.
Figure 18:
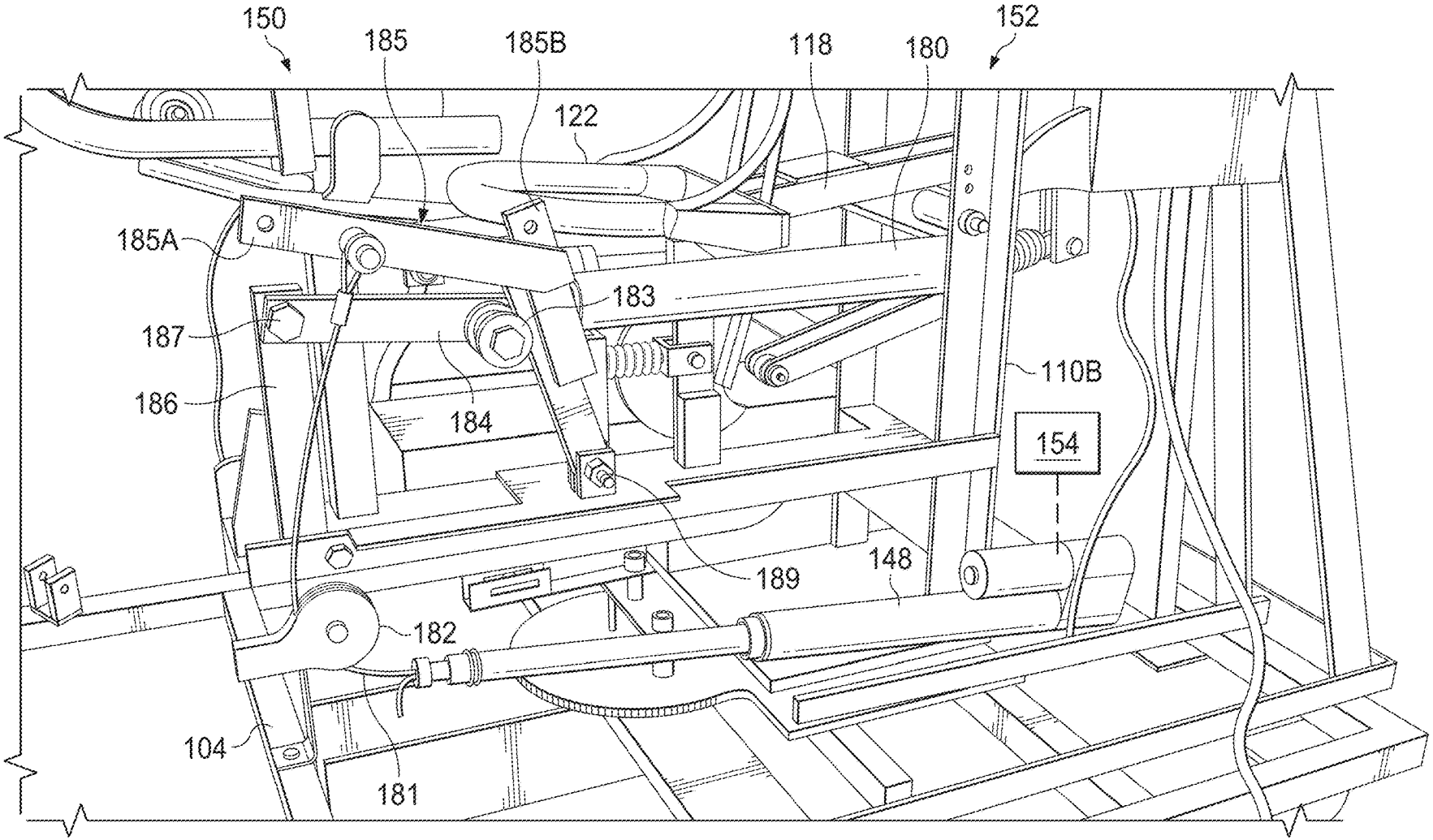
FIG. 18 is a left side view of a portion of the basketball launching device and distance adjustment mechanism of FIG. 16 in a third position.
Figure 19:
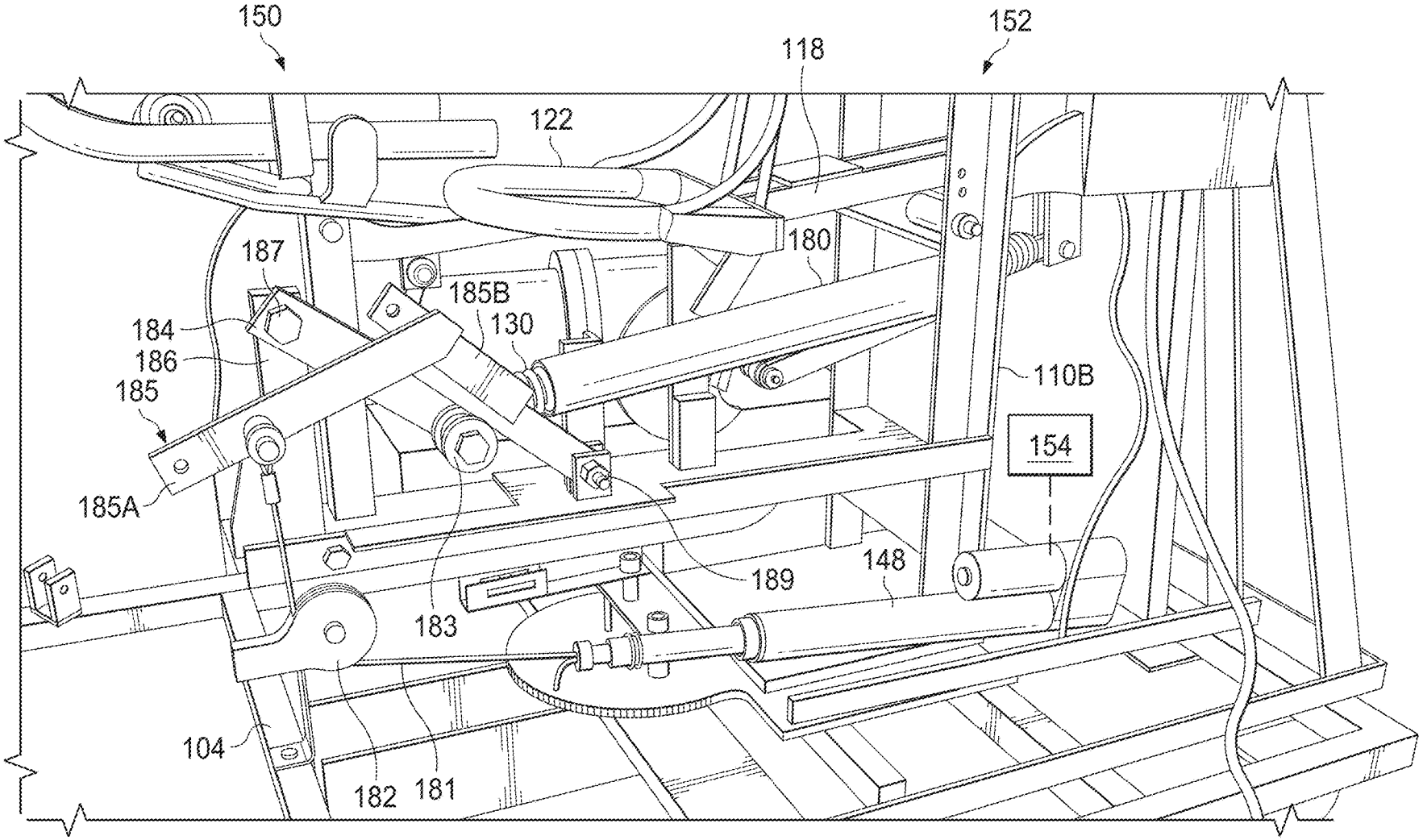
FIG. 19 is a left side view of a portion of the basketball launching device and distance adjustment mechanism of FIG. 16 in a fourth position.
Figure 20:
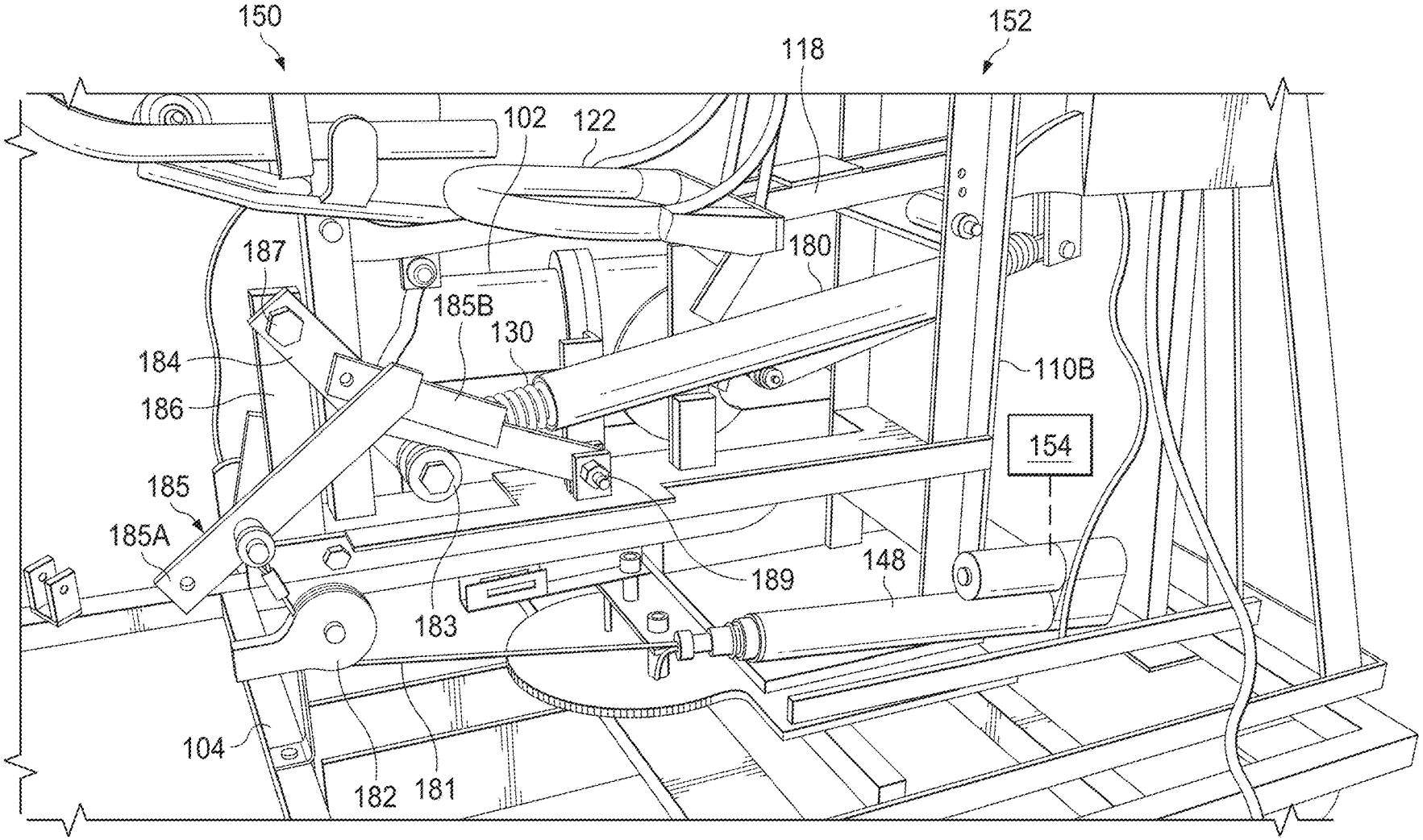
FIG. 20 is a left side view of a portion of the basketball launching device and distance adjustment mechanism of FIG. 16 in a fifth position.
Figure 21:
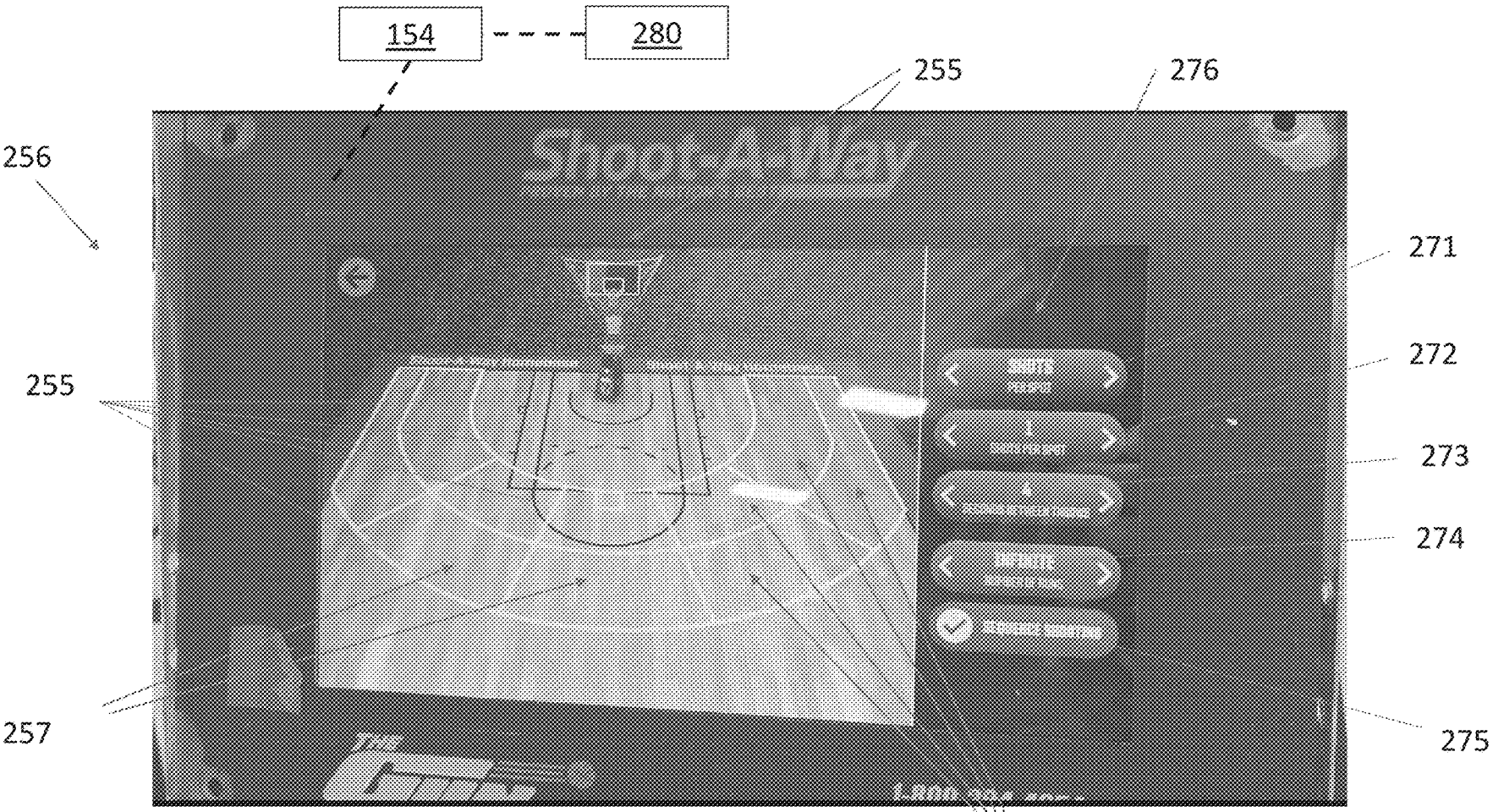
FIG. 21 is a front view of another exemplary user interface for use with the basketball launching device and/or the distance adjustment mechanism of FIGS. 1-20.
Figure 22:
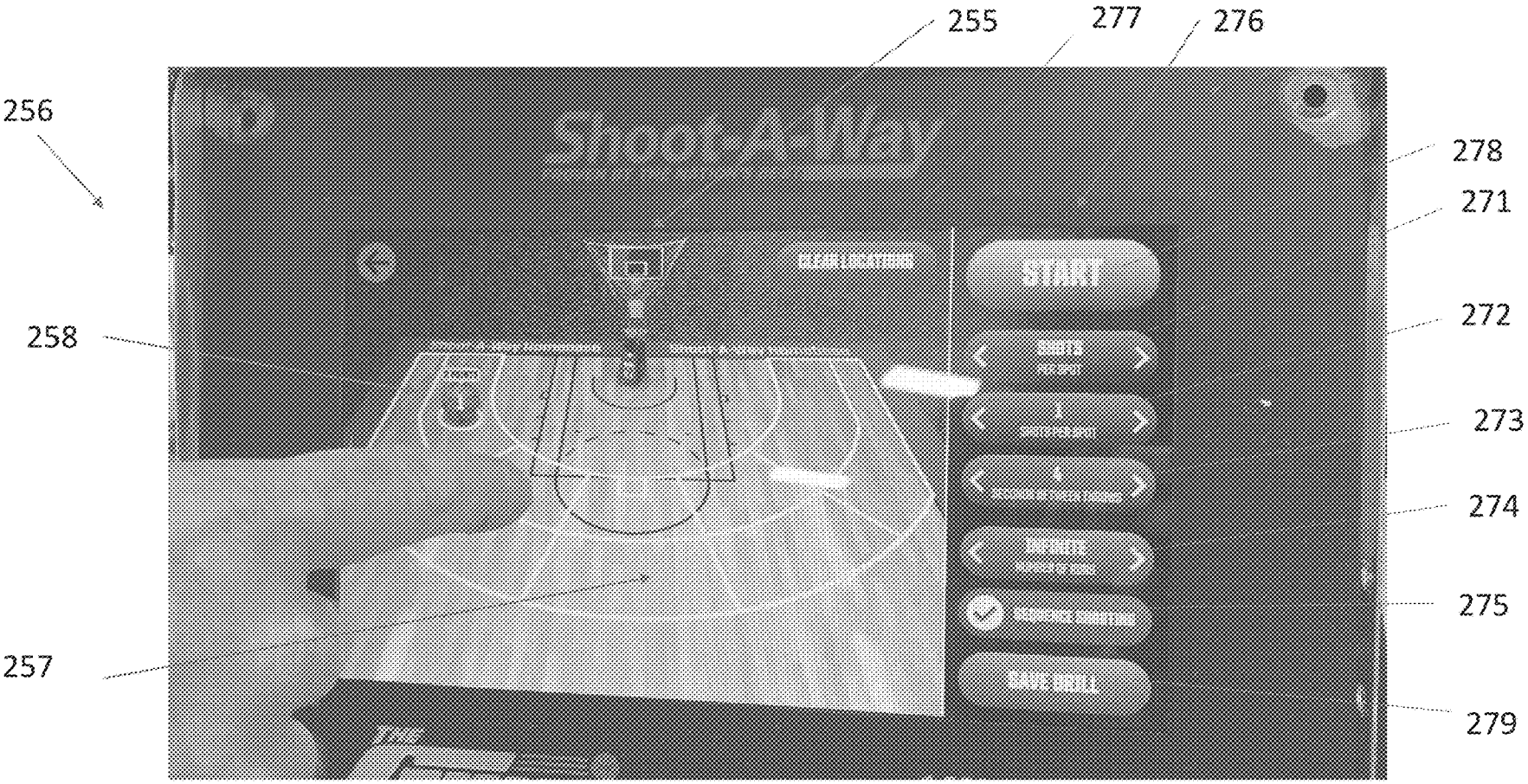
FIG. 22 is a front view of the exemplary user interface of FIG. 21 displaying results of exemplary user interaction.
Figure 23:
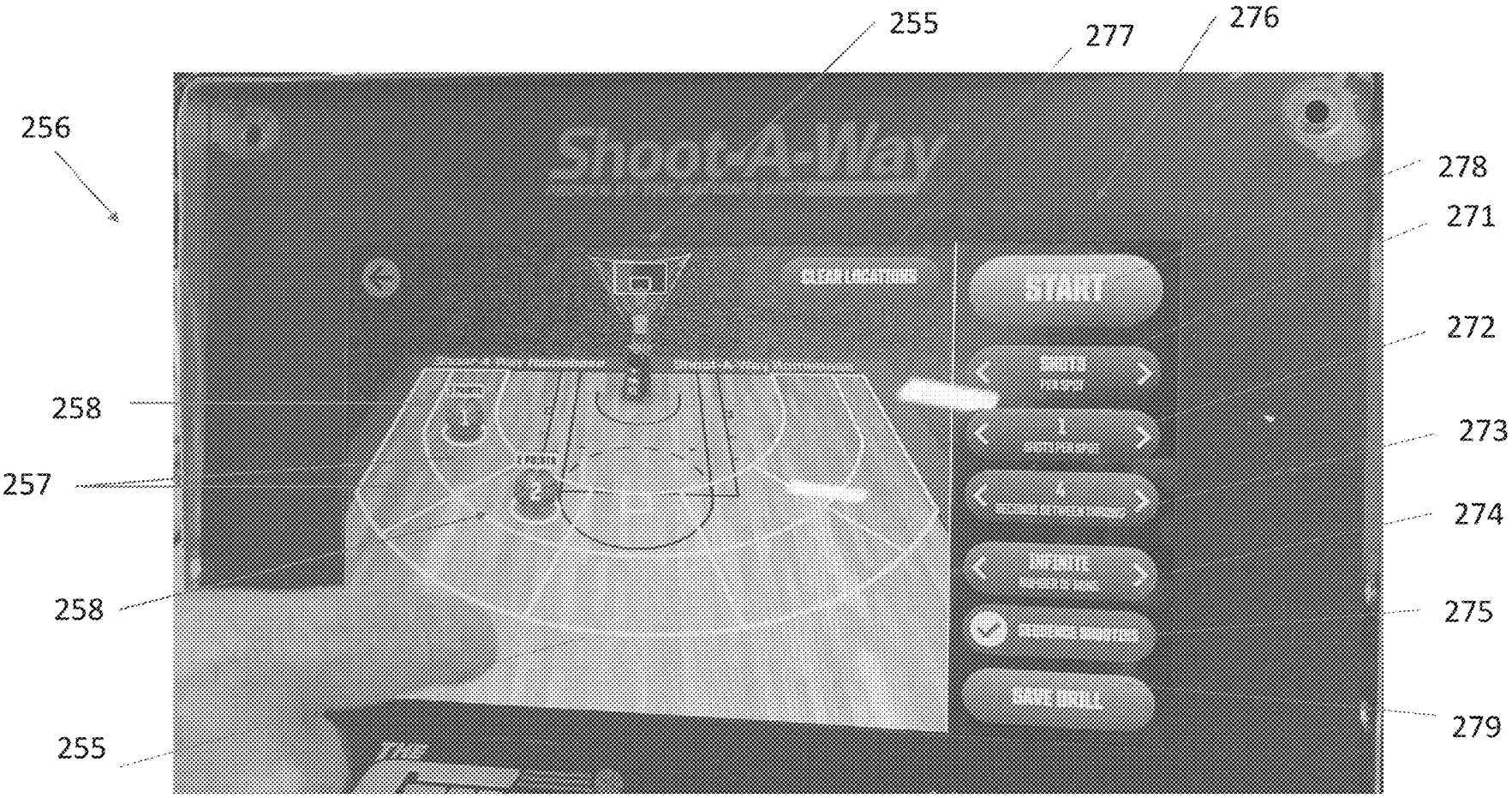
FIG. 23 is a front view of the exemplary user interface of FIG. 21 following exemplary user interaction.
Figure 24:
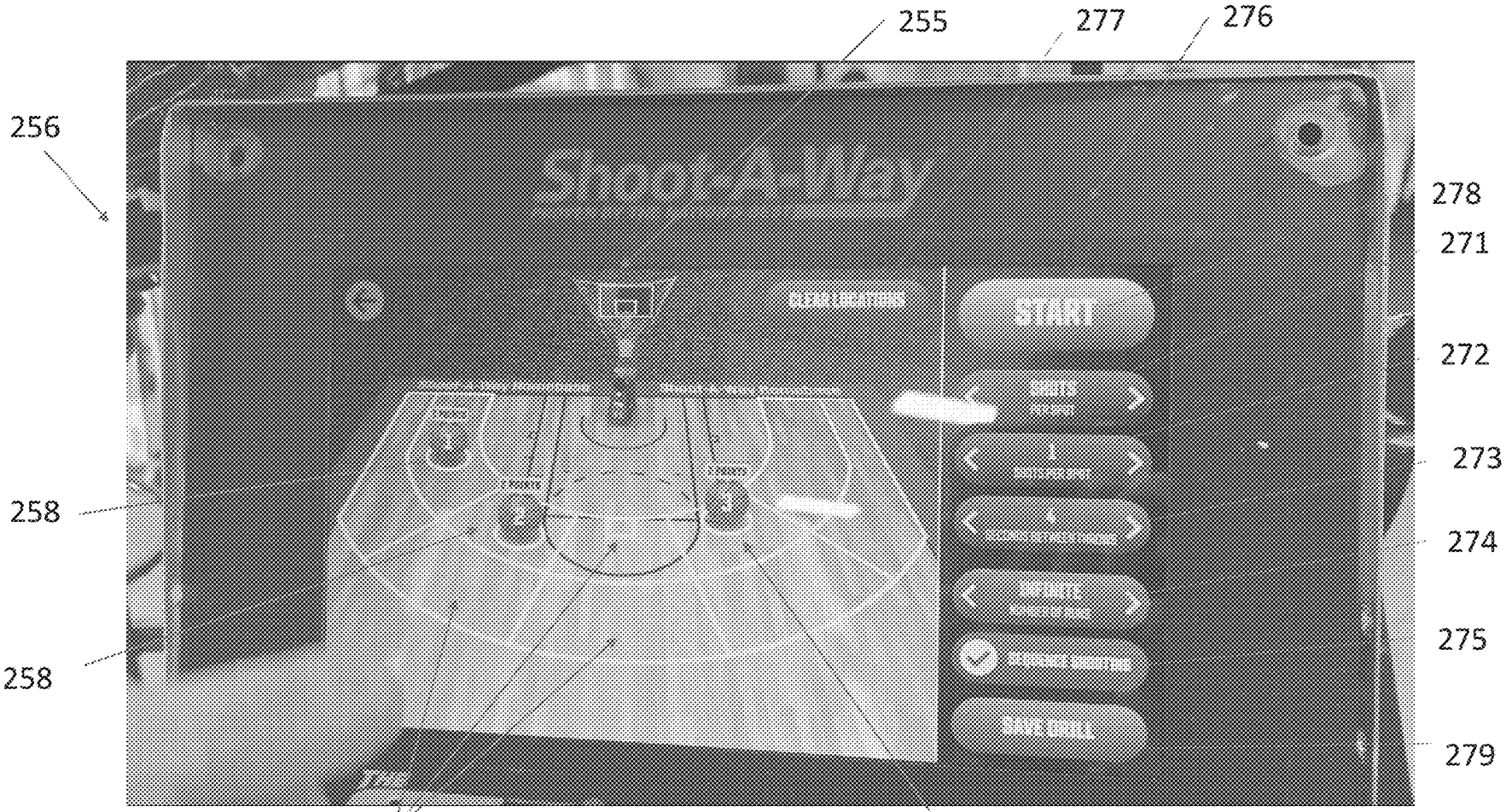
FIG. 24 is a front view of the exemplary user interface of FIG. 21 following exemplary user interaction.

FIG. 15 illustrates an exemplary user interface 156 for use with the basketball launching device 100 and/or the automatic distance adjustment mechanism 152. The movement imparting mechanism 148 may be in electronic communication with a controller 154. Alternatively, or additionally, the motor 102 may be in electronic communication with the controller 154. The controller 154 may be in electronic communication with a user interface 156.

The user interface 156 may be configured to receive user input regarding a basketball practice routine. The user input may be used to program the rebounding machine 200. For example, without limitation, the user input may indicate one or more locations on a basketball playing area the user desires to receive basketball passes. In exemplary embodiments, the user interface may comprise a number of selectable pass receipt locations 158. The user interface 156 may comprise a rendering 155 of a basketball playing area. The rendering 155 may comprise, for example without limitation, a baseline, a half court line, a key, a free throw line, a basketball hoop, one or more sidelines, some combination thereof, or the like. The selectable pass receipt locations 158 may be arranged about the rendering 155, though such is not required. The user input may comprise selection of one or more of the selectable pass receipt locations 158. The user input received at the user interface 156 may be transmitted to the controller 154 which may program the basketball launching device 100 and/or the automatic distance adjustment mechanism 152 to launch basketballs according to the received user input.

Alternatively, or additionally, the user interface 156 may be configured to permit selection of one or more pre-programmed collections of pass receipt locations 158. For example, without limitation, a collections selector 159 may permit for certain pre-programmed exercises to be quickly programmed. The collections selector 159 may comprise options for selecting custom routines created by user input at the selectable pass receipt locations 158, such as but not limited to, frequently used or preferred practice routines for quick access by the user.

The user interface 156 may be configured to permit the user to select the distance the basketballs are to be passed. The distance selection may be made by way of the selectable pass receipt locations 158 such that the basketballs are thrown relatively further when a selectable pass receipt location 158 located a relatively further distance is selected, and relatively closer when a selectable pass receipt location 158 located a relatively closer distance is selected. Proximity may be determined in relation to a rendering of the basketball hoop, the rebound machine 200, the baseline, or other location of the user interface 156. Alternatively, or additionally, a distance selection tool 162 may be provided.

User input may be received at the use interface 156 and transmitted to the controller 154. The controller 154 may transmit instructions to the basketball launching device 100 for launching the basketballs based on the received user input. The controller 154 may transmit instructions to the automatic distance adjustment mechanism 152 to adjust the tension in the spring 130 based on the received user input so as to adjust the distance the basketballs are launched.

The user interface 156 may comprise a panel. The selectable pass receipt locations 158 may comprise mechanical buttons. In other exemplary embodiments, the user interface 156 may comprise a touch panel. The selectable pass receipt locations 158 may comprise marking or indicia at the touch panel. In other exemplary embodiments, the selectable pass receipt locations 158 may comprise lights or other indicatable marking, selection of which is made by way of a selection tool 164. In such embodiments, the user interface 156 may comprise a panel and/or an electronic display. Each of the selectable pass receipt locations 158 may be marked with a number or other indicator, though such is not required. The illustrated user interface 156, including but not limited to, the type, shape, size, number, and location of the selectable pass receipt locations 158, the rendering 155, the distance selection tool 162, the selection tool 164, the collections selector 159, are merely exemplary and are not intended to be limiting. Any type, shape, size, number, and location of such features may be utilized.

FIG. 16 through FIG. 20 illustrate another exemplary automatic distance adjustment mechanism 152. The movement imparting mechanism 148 may be connected to the spring 130 by way of one or more linkages. In exemplary embodiments, the spring 130 may be partially or fully encased within a sleeve 180. The sleeve 180 may help to prevent the spring 130 from catching on other components of the basketball launching device 100, such as when the spring 130 is compressed and/or stretched. The sleeve 180 may further comprise lubricating materials configured to help preserve and/or facilitate movement of the spring 130.

The spring 130 may be connected to the catapult arm 118 at a first end. The spring 130 may be connected to a first linkage 184 at a second end. The first linkage 184 may be pivotably connected to the mounting structure 104 at a first pivoting connector 187. In exemplary embodiments, the first linkage 184 is connected to the mounting structure 104 at a post 186. The first pivoting connector 187 may comprise one or more pins, bearings, fasteners, combinations thereof, or the like. The first linkage 184 may comprise a rigid, straight line member though any size, shape, type, and number of members may be utilized. In exemplary embodiments, the first linkage member 184 may serve as the tension adjustment member 126.

The spring 130 may be connected to the first linkage 184 at a first end thereof. In exemplary embodiments, the spring 130 may be connected to the first linkage 184 at a protrusion 183, though such is not required. The protrusion 183 may be configured for mechanical interaction with a second linkage 185, such as during movement of said first linkage 184 and/or said second linkage 185. The protrusion 183 may comprise a guide, wheel, post, or the like which contacts and may move and/or guide movement of the second linkage 185.

The second linkage 185 may be pivotally connected to the mounting structure 104 at a first end, such as by way of a second pivoting connector 189. The second pivoting connector 189 may comprise one or more pins, bearings, fasteners, combinations thereof, or the like. The second linkage 185 may comprise two or more rigid members connected to one another at a non-linear angle, such as but not limited to, substantially 135 degrees though any non-linear angle may be utilized. The second linkage 185 may provide a surface for the protrusion 183 to physically interact with and/or travel. The second linkage 185 may, alternatively or additionally, provide an upper barrier to prevent the protrusion 183 from traveling too far. In exemplary embodiments, the second linkage 185 may comprise at least a first component 185A and a second component 185B. The first and second components 185A, B may be fastened, welded, bonded, adhered, or otherwise joined together. The first and second components 185A, B may be joined together at said non-linear angle, such as but not limited to substantially 135 degrees, though any non-linear angle may be utilized. Any number of components at the same or different linear or non-linear angles may be utilized to form the first and/or second linkages 184, 185.

A flexible member 181 may be connected to a second end of the second linkage 185. The flexible member 181 may comprise a cable, rope, spring, wire, combination thereof, or the like. One or more pulleys 182 may be connected to the support structure 104 or another member. The pulley(s) 182 may be configured to redirect movement of the flexible member 181 from a substantially vertical direction to a substantially horizontal direction. The pulley(s) 182 may change directions of the force and/or provide mechanical advantages. In exemplary embodiments, the pulley(s) 182 may be provided as one or more blocks and multiple loops of the flexible member 181 may extend between the movement imparting mechanism 148 and the pulley(s) 182 and/or the second pivoting linkage 185 to provide certain mechanical advantages.

A second end of the flexible member 181 may be connected to the movement imparting mechanism 148. The movement imparting mechanism 148 may be positioned substantially horizontally, such as along a lower portion of the basketball launching device 100. This may provide a more compact design for the basketball launching device 100. In other exemplary embodiments, other linkages may be used such as but not limited to chains and gears, levers, cams, combinations thereof, or the like. Alternatively, a direct connection between the movement imparting mechanism 148 and the second pivoting linkage 185 may be provided.

In exemplary embodiments, the movement imparting mechanism 148 may be selectively lengthened, thereby allowing the second linkage 185 to advance, such as in a clockwise fashion about the second pivoting connector 189, which permits the first linkage 184 to advance, such as in a counterclockwise fashion about the first pivoting connector 187, from a first position (see FIG. 16) to a second (see FIG. 17) and third position (see FIG. 18) which results in the spring 130 decreasing in length. This decreases the amount of force applied by the spring 130 against the catapult arm 118, thereby decreasing the distance the basketball is launched if otherwise unimpeded. Similarly, the movement imparting mechanism 148 may be shortened, thereby causing the second linkage 185 to retract, such as in a counterclockwise fashion about the second pivoting connector 189, which permits the first linkage 184 to retract, such as in a clockwise fashion about the first pivoting connector 187, from the third position (see FIG. 18) to a fourth (see FIG. 19) and fifth position (see FIG. 20) which results in the spring 130 increasing in length. This increases the amount of force applied by the spring 130 against the catapult arm 118, thereby increasing the distance the basketball is launched if otherwise unimpeded. Control of the movement imparting mechanism 148 may be accomplished by the controller 154 which may be in electronic communication (wired or wireless) with the movement imparting mechanism.

The various linkage members shown and/or described herein, such as but not limited to, the first linkage 184 and/or the second linkage 185 may be formed from multiple connected members or a single, integrally formed member. For example, without limitation, where multiple members are used, such members may be fastened, welded, bonded, adhered, combinations thereof, or the like.

FIG. 21 through FIG. 30 illustrates another exemplary user interface 256. The user interface 256 may be configured for use with the rebound machine 200, such as but not limited to, for use with the basketball launching device 100 and/or the automatic distance adjustment mechanism 152. The controller 154 may be in electronic communication with a user interface 256, which may place the user interface 256 in electronic communication with the movement imparting mechanism 148 and/or the motor 102 to control where the basketballs are launched on the basketball playing area. Other power sources may be used as alternatives to, or in addition to, the movement imparting mechanism 148 and/or the motor 102. The power source may be sufficient to cock and release a throwing mechanism for a basketball and/or adjust the distance a basketball is launched.

The user interface 256 may comprise a touch screen in exemplary embodiments. In other exemplary embodiments, the user interface 256 may comprise an electronic display, panel, combinations thereof, or the like. The user interface 256 may comprise one or more visual depictions 255 of certain elements of the basketball playing area, including but not limited to, a court, sidelines, a base line, key, foul line, restricted area arc, lane lines, combinations thereof, or the like. The visual depictions 255 may reflect any now developed or future developed court designs, regulations, or the like. The visual depictions 255 may, alternatively or additionally, comprise renderings of the rebound machine 200 and/or a basketball goal. The visual depictions 255 may be configured to provide a realistic simulation of an exemplary basketball playing surface including any such elements thereof, though cartoons or other graphical representations may be utilized.

A number of selection areas 257 may be positioned about the user interface 256 and may be defined, at least in part, by the visual depictions 255. The user interface 256 may be configured to receive user input indicating selection of pass receipt locations where the user desires to receive basketball passes as part of a custom basketball practice routine. In exemplary embodiments, each such pass receipt location and/or selection of the same may be represented by an icon 258 displayed at the user interface 256. For example, without limitation, the pass receipt locations may be represented by icons 258 which are displayed to represent pass receipt locations available for selection by the user. As another example, without limitation, the visual depictions 255 may be provided at the user interface 256 without the icons 258, and the icons 258 may instead be generated upon selection of an area of the user interface 256 corresponding to a location at the playing area the user desires to receive a basketball pass.

In exemplary embodiments, user selection anywhere within a given one of the selection areas 257 may cause the user interface 256 to record the user's desire to receive a pass at the given selection area 257. Upon such selection, an icon 258 may be generated and displayed at substantially the position selected by the user. The icon 258 may indicate the approximate position of the user selection. The icon 258 may indicate to the user where to stand to receive a corresponding basketball pass from the rebound machine 200.

The icon 258 may be provided in the form a graphic of a basketball, though any type or kind of icon 258 may be utilized. The same or different icons 258 may be used for each location and/or selection. The icon 258 may comprise pass and/or shooting information including, for example without limitation, a number of points associated with shots taken in association with the programmed pass, the number of the pass or position within the shooting sequence or program (e.g., the first location where one or more basketballs will be set, the second such location, etc.), a type of basketball shot to be taken at the location (e.g., jumper, stationary, off dribble, layup, fade away, or the like).

In exemplary embodiments, without limitation, user selection of any point within a given selection area 257 may be configured to cause the rebound machine 200 to launch a basketball to a single, common point on the basketball playing area corresponding with the given selection area 257. So, for example without limitation, if two pass receipt locations are selected within the given selection area 257, two passes may be made to substantially the same pass receipt location at the basketball playing area, even if two separate icons 258 are provided at two different locations. In this way, programming and operation of the rebound machine 200 may be simplified.

In other exemplary embodiments, the selection areas 257 may be provided solely for user convenience and reference and the basketballs may be passed approximately to their respective location on the basketballs playing area corresponding with selected pass receipt locations. So, for example without limitation, if two pass receipt locations are selected within a given selection area 257, two passes may be made to different locations within the same pass receipt location at the basketball playing area, such as to substantially where the icons 258 appear. In this way, programming and operation of the rebound machine 200 may be made more precise.

The user interface 256 may be configured to receive a user selection of pass receipt locations on the basketball playing surface for the launcher to pass the basketballs to. User selection may be made by direct, physical touch, such as by use of a touch screen or a panel with physically depressible buttons, or by way of one or more tools, such as but not limited to, the selection tool 164 shown and/or described with respect to FIG. 15. Various pass receipt locations about the user interface 256 may be selected by the user. The pass receipt locations may be selected with reference to one or more elements of the visual depiction 255 and may be graphically represented by icons 258 so that the user knows where to stand on the actual basketball playing area to receive the corresponding passes. For example, without limitation, if the user selects a pass receipt location near the foul line, one of the icons 258 may be generated on the user interface 256 near the foul line, and the user may then stand near the foul line (real or imaginary) to receive a corresponding pass. Any number and pass receipt locations may be selected to create one or more customized basketball practice routines.

The pass receipt locations selected by the user may be displayed as icons 258 and updated as they are selected. For example, without limitation, the icons 258 may be already displayed and may be illuminated, colorized, highlighted, changed, or otherwise altered upon selection. Alternatively, no icons 258 may be displayed and the user's touch at a given point may cause an icon 258 to be displayed upon selection. For example, without limitation, the icon 258 may appear upon selection.

The icons 258 may comprise a number, alphanumeric character, or other representation corresponding to the order in which the passes will be made (e.g., the first pass going to the icons 258 labeled with a "1", "A", or the like, the second pass to the icon 258 labeled "2", "B", or the like, and so forth). Initially, the icons 258 may be labeled with an order based on the order they were selected. The icons 258 may be labeled with a corresponding score to be recorded if a shot is successfully made from a pass associated with the icons 258. In exemplary embodiments, the points vary based on distance from the visual depiction 255 of the rebound machine 200 and/or the basketball goal. For example, without limitation, two points may be recorded for all pass receipt locations in front of the visual depiction 255 of the three-point line and three points may be recorded for all pass receipt locations behind the visual depiction 255 of the three-point line, though any scoring scheme may be utilized. In exemplary embodiments, such a determination may be made by which of the selection areas 257 are selected. The selection areas 257 may be physically or electronically separated, however, in exemplary embodiments such is not required.

FIGS. 21-30 illustrate exemplary programming of three exemplary pass receipt locations at the user interface 256. The user interface 256 may be configured to permit revision of the pass receipt locations after their initial selection, such as before the rebound machine 200 begins launching the basketballs, during the practice session, or after the practice session is completed. For example, without limitation, a given one of the icons 258 may be moved from an initial pass receipt location to a new pass receipt location. Such movement may be accomplished by a touch and drag technique. Such movement may, alternatively or additionally, be accomplished by a tap and drag technique, taping motion, swipe, click and drag technique, press and drag technique, combinations thereof, or the like. Regardless, the movement may be reflected by moving the icons 258 at the user interface 256.

Figure 25:
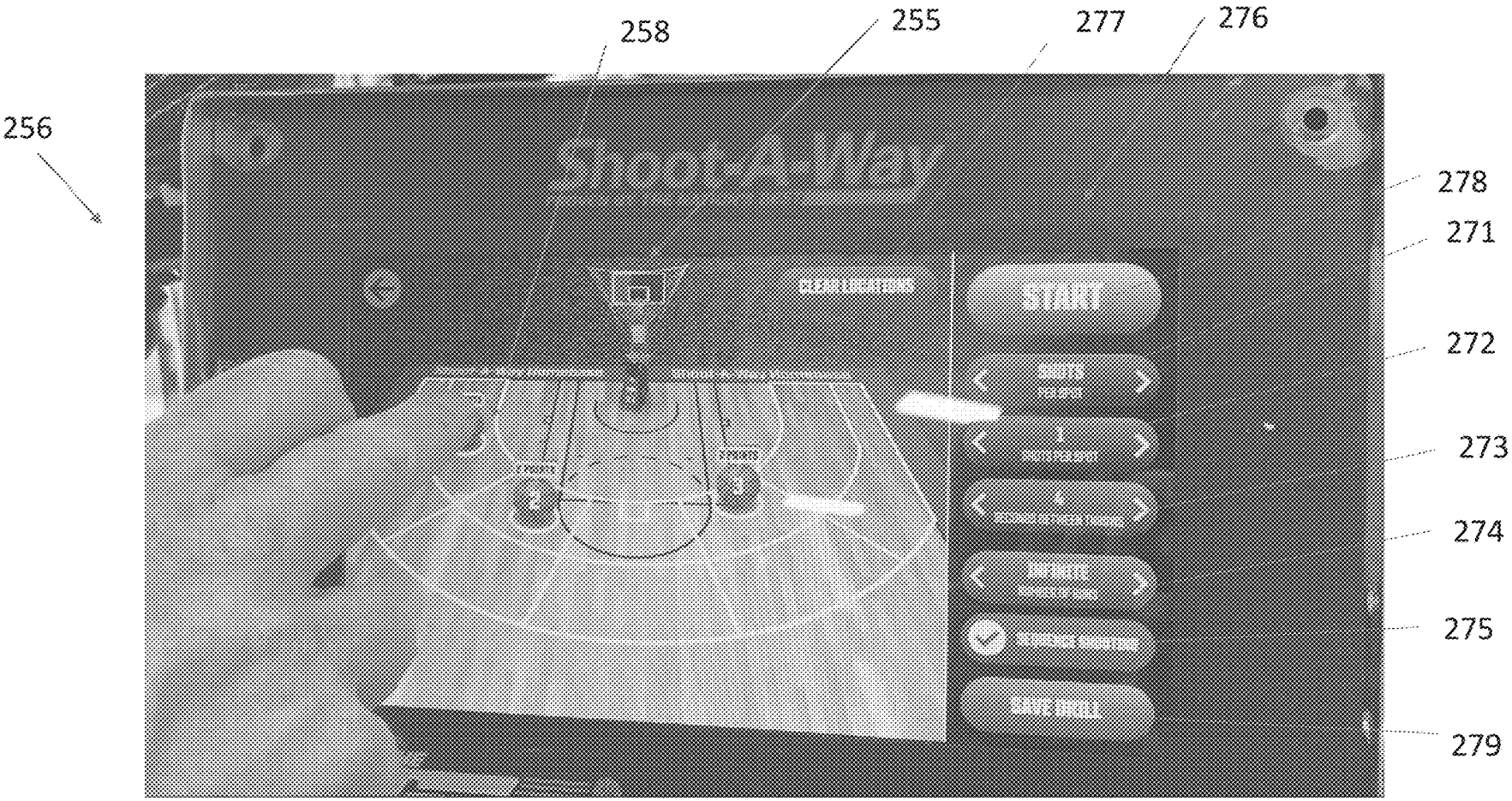
FIG. 25 is a front view of the exemplary user interface of FIG. 21 following exemplary user interaction.
Figure 26:
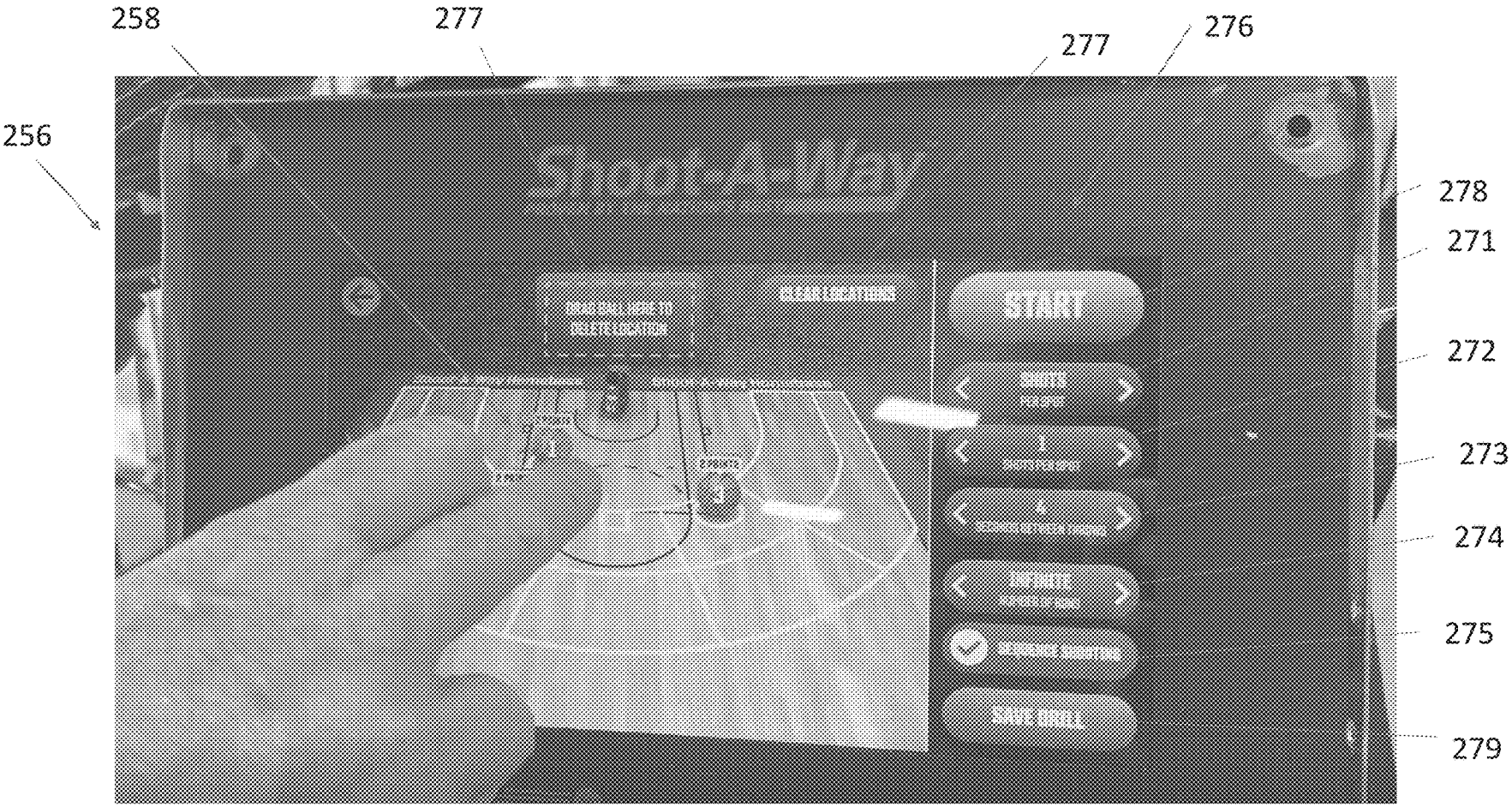
FIG. 26 is a front view of the exemplary user interface of FIG. 21 following exemplary user interaction.
Figure 27:
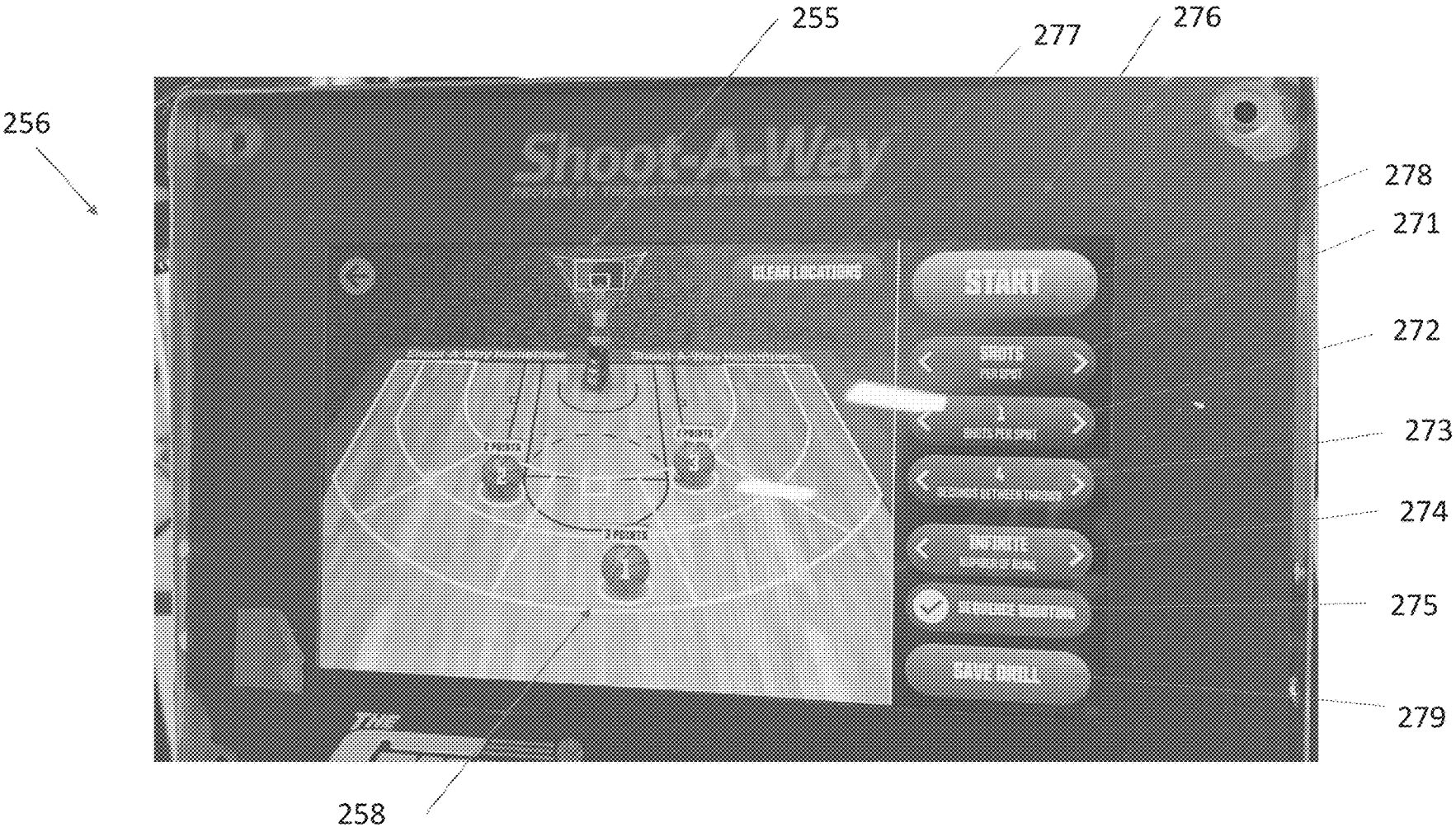
FIG. 27 is a front view of the exemplary user interface of FIG. 21 following exemplary user interaction.
Figure 28:
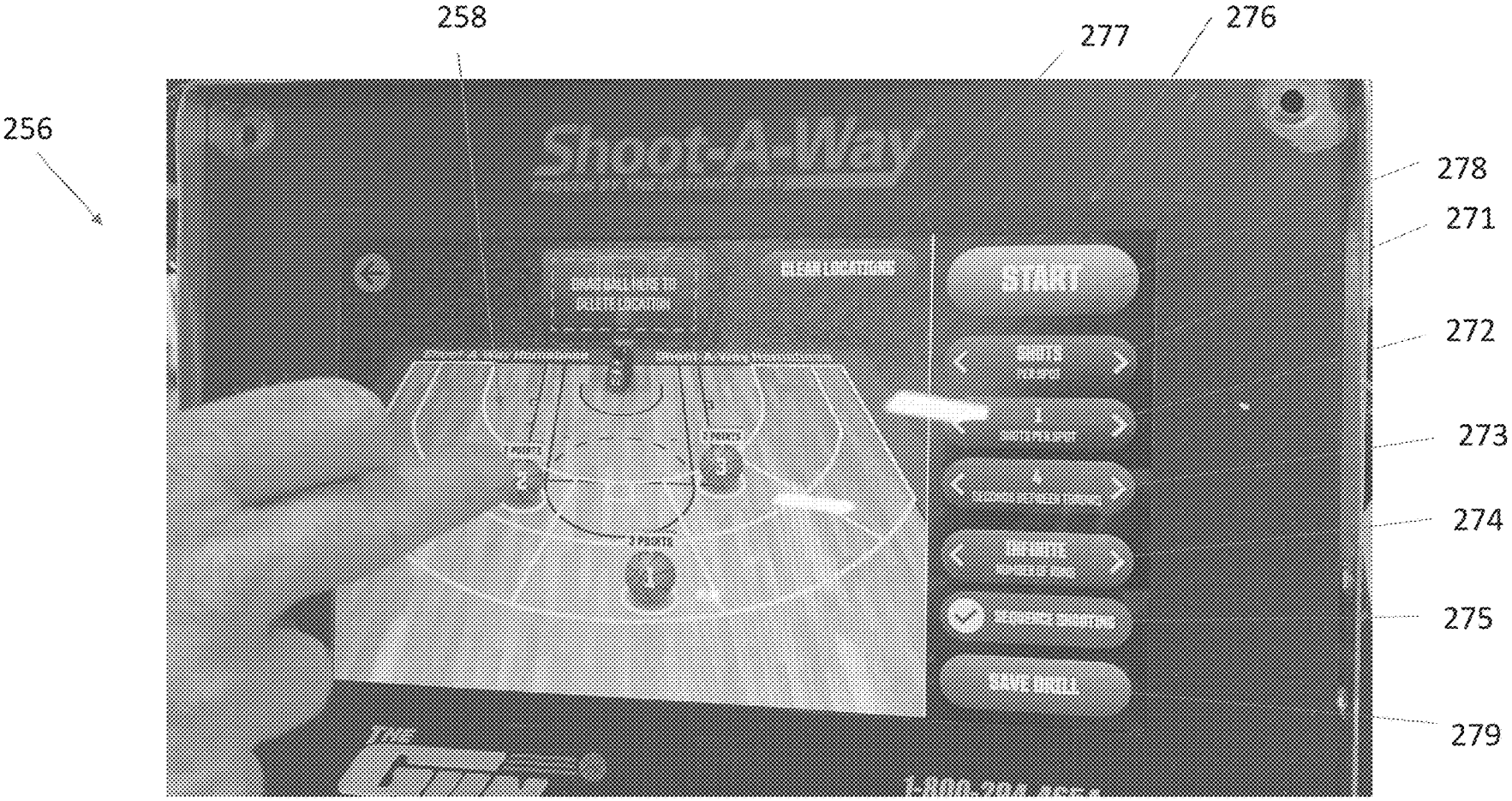
FIG. 28 is a front view of the exemplary user interface of FIG. 21 following exemplary user interaction.
Figure 29:
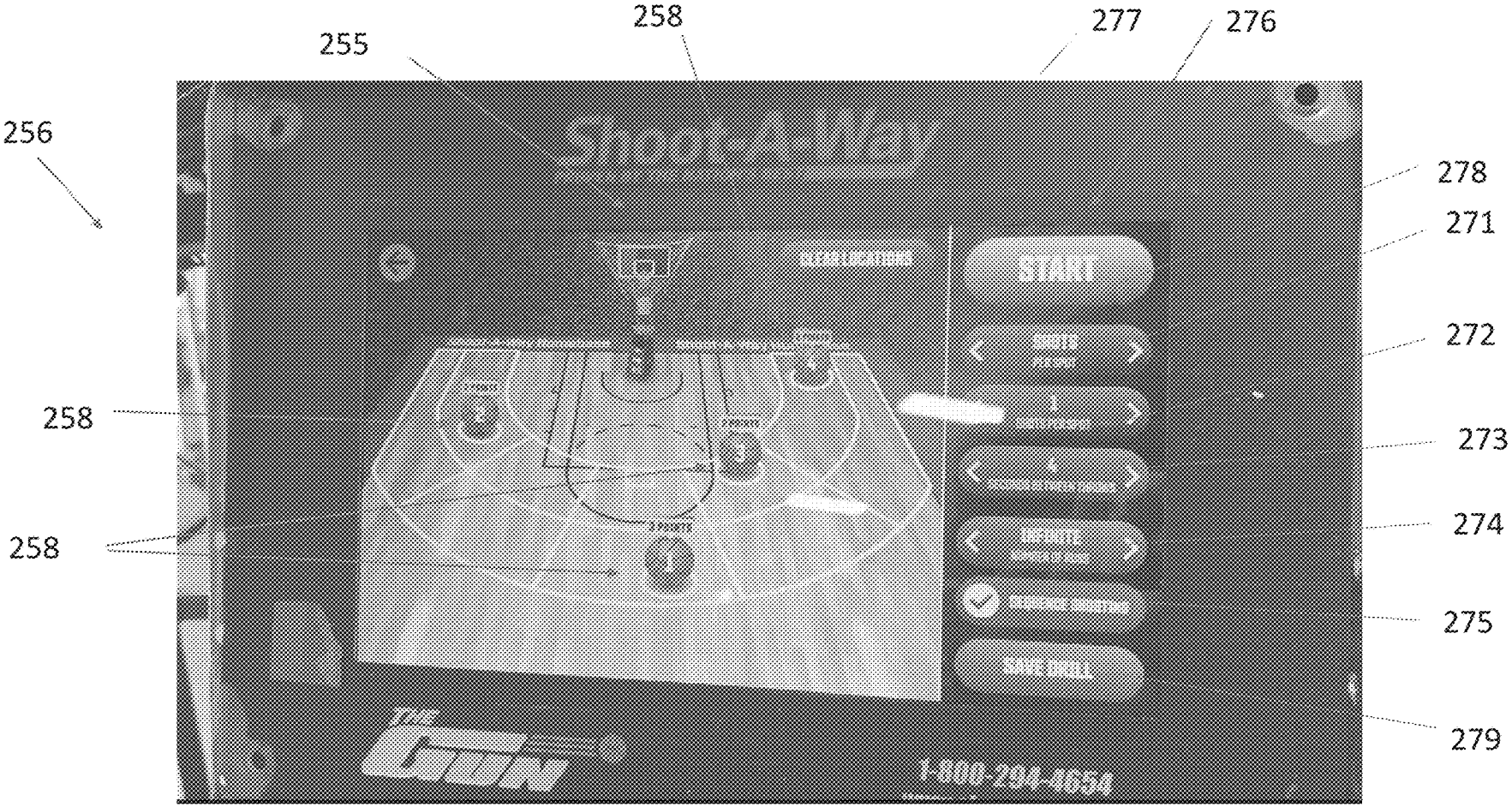
FIG. 29 is a front view of the exemplary user interface of FIG. 21 following exemplary user interaction.

FIGS. 25-27 show the movement of a first pass receipt locations, as represented by one of the icons 258, from an initial spot on the left side of the key to a new spot near the top of the key. FIGS. 25-27 illustrate the user interface 256 updating the first pass receipt locations from two points to three points based on the locations of the representative icon 258 relative to the visual depictions 255. FIGS. 28-29 illustrate, for example without limitation, movement of a second one of the pass receipt locations and addition of a fourth pass receipt locations, as represented by the icons 258. Any technique for moving the pass receipt locations may be utilized. The user interface 256 may be used to create a vast number of custom practice routines.

A delete tool 277 may be provided to remove the selected one of the pass receipt locations. The delete tool 277 may be displayed or otherwise provided only upon selection of one or more of the icons 258 in exemplary embodiments through such is not required. The delete tool 277 may comprise a defined area where the icons 258 for the pass receipt locations may be moved and result in its removal from the custom practice routine. In other exemplary embodiments, the delete tool 277 may normally be displayed or otherwise provided.

An options menu 276 may be provided at the user interface 256. In exemplary embodiments, the options menu 276 may be positioned adjacent to the visual depictions 255, though any location may be utilized. The options menu 276 may comprise a practice style option 271. The practice style option 271 may permit the user to choose between a number of programming options including, but not limited to, creation of a custom drill, use of a pre-programmed drill, a shots per location option, a makes in a row option, a made shots options, or the like. In the makes option, the controller 154 may program the rebound machine 200 to require indication of a number of shots made at a given selected pass receipt location before the rebound machine 200 moves to the next selected pass receipt locations. In the makes in a row option, the controller 154 may program the rebound machine 200 to require indication of a number of shots in a row at a given selected pass receipt locations before the rebound machine 200 moves to the next selected pass receipt locations. In the shots per location option, the controller 154 may program the rebound machine 200 to launch the number of passes selected at a shots per location option 272 to a given one of the selected pass receipt locations before moving to the next selected pass receipt location. The shots per location option 272 may be updated to a number of made shots or number of made shots in a row option depending on the user selection made at the practice style option 271.

The indication of shots made or missed may be made by way of one or more detectors 280. The detector(s) 280 may be in electronic communication with the user interface 256 and/or the controller 154. The detector(s) 280 may be selectively associated with the basketball goal, such as but not limited to, attachable to the post, rim, backboard, combination thereof, or the like. Alternatively, or additionally, the detector(s) 280 may be mounted to portions of the basketball rebound machine 200. The detector(s) 280 may comprise photo eyes, microphones, cameras, image recognition software, combinations thereof, or the like. In exemplary embodiments, some or all of the sensors 121 may serve as the detector(s) 280.

The options menu 276 may comprise a timing option 273. The timing option 273 may permit the user to select a time delay between passes.

The options menu 275 may comprise a number of runs options 274. The number of runs options 274 may permit the user to select a number of times the rebound machine 200 progresses through all of the selected pass receipt locations before terminating the practice session.

The options menu 275 may comprise a sequence shooting option 275. The sequence shooting option 275 may permit the user to select between automatic renumbering of the order of the selected icons 258 or ability to program a non-serial order of the selected pass receipt locations, as represented by the icons 258. Where the sequence shooting option 275 is not selected, for example, the order of the pass receipt locations within the custom practice arrangements may by automatically renumbered, and the icons 258 updated accordingly, such that the basketballs are always passed in a particular order, such as but not limited to from right to left, left to right, closest to furthest, further to closest, etc. Where the sequence shooting option 275 is selected, the order of the pass receipt locations within the custom practice arrangement may remain unchanged such that they may be provided in a non-serial order.

After one or more pass receipt locations are selected, such as represented by the icons 258, a save option 279 may be provided at the options menu 276. The save option 279 may permit the user to save the created program for subsequent use. After one or more pass receipt locations are selected, such as represented by the appearance or selection of the icons 258, a start option 278 may be provided at the options menu 276. The start option 278 may permit the user to initiate the created program. In exemplary embodiments, selection of the start option 278 may cause the user interface 256 to communicate the selected pass receipt locations forming the custom practice arrangements to the launcher 100 and/or other components of the rebound machine 200, such as but not limited to, by way of the controller 154.

For those pass receipt locations further from the rebound machine 200, such as represented by the icons 258 further from the visual depiction 255 of the launcher or basketball goal, the rebound machine 200 may be configured to automatically launch basketballs with greater force (thus causing their normal passing distance to increase), such as by way of the automatic distance adjustment mechanism 152. Likewise, for those pass receipt locations closer to the rebound machine 200, such as represented by the icons 258 further from the visual depiction 255 of the launcher or basketball goal, the rebound machine 200 may be configured to automatically launch basketballs with less force (thus causing their normal passing distance to decrease), such as by way of the automatic distance adjustment mechanism 152.

Figure 30:
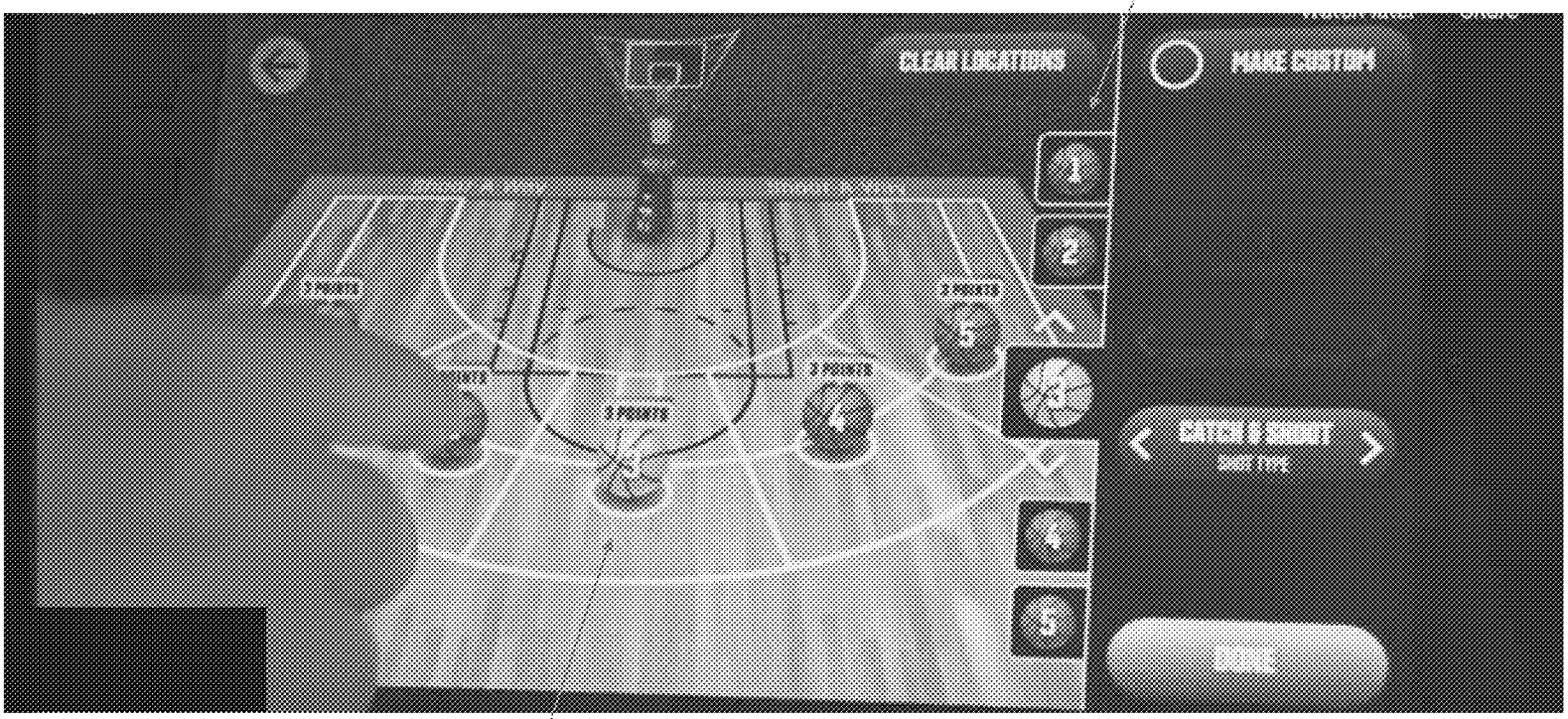
FIG. 30 is a front view of the exemplary user interface of FIG. 21 following exemplary user interaction.

FIG. 30 illustrates an exemplary highlighting of a selected one of the icons 258. In exemplary embodiments, the user interface 256 may be configured to highlight any of the icons 258 selected by user, such as by direct interaction (e.g., touch) or indirect selection. Any type or kind of highlighting, including color changes, symbol type or appearance changes, illumination, combinations thereof, or the like may be used.

Upon such selection of one of the icons 258, an order menu 259 may be provided at the user interface 256. The order menu 259 may be configured to permit the user to manually select the order of the selected ones of the pass receipt locations as represented by the selected ones of the icons 258. For example, without limitation, the order menu 259 may comprise the numbers 1-N, where N is the number of pass receipt locations selected as the user interface 256, such as represented by the number of the icons 258 displayed. The numbers may be vertically stacked, though such is not required.

Figure 31:
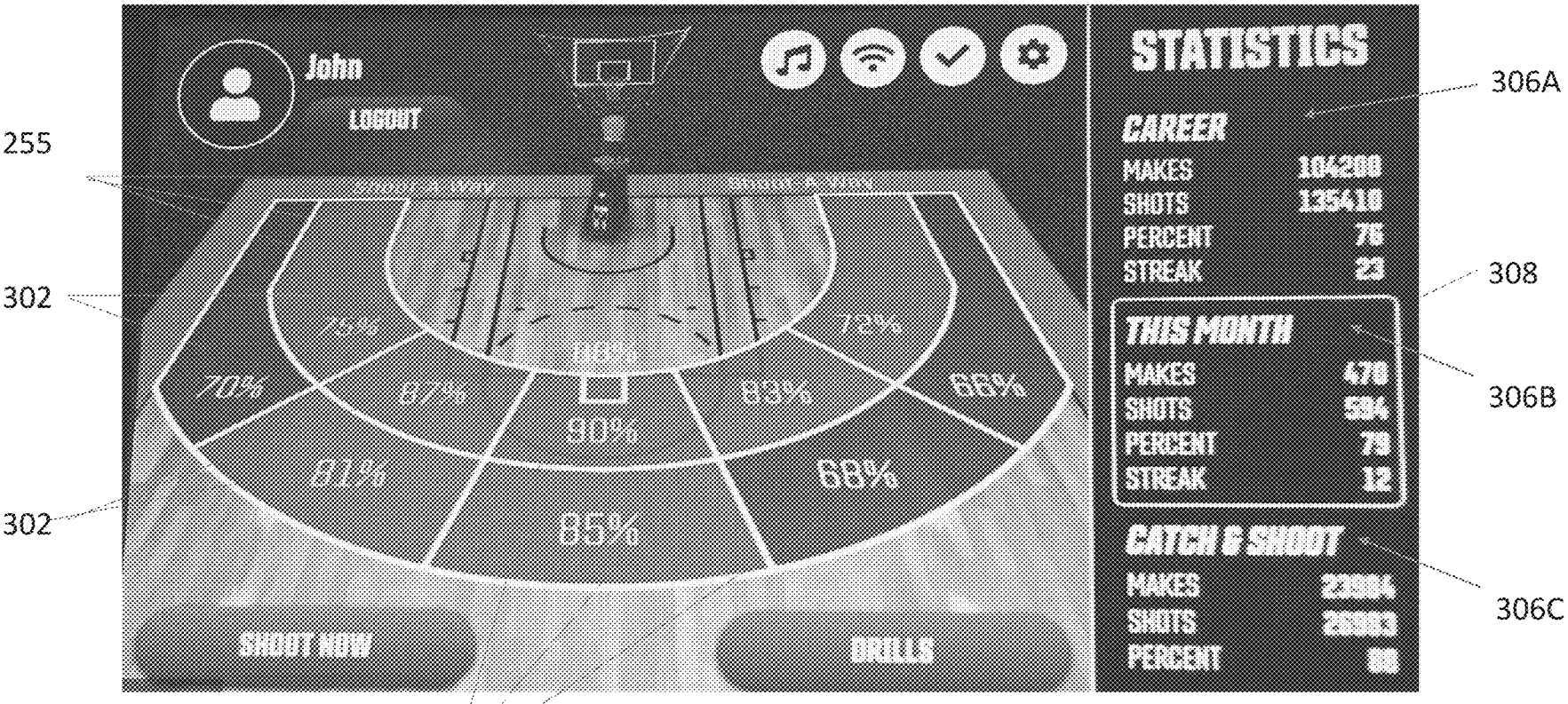
FIG. 31 is a front view of an exemplary performance report in accordance with the present invention.
Figure 32:
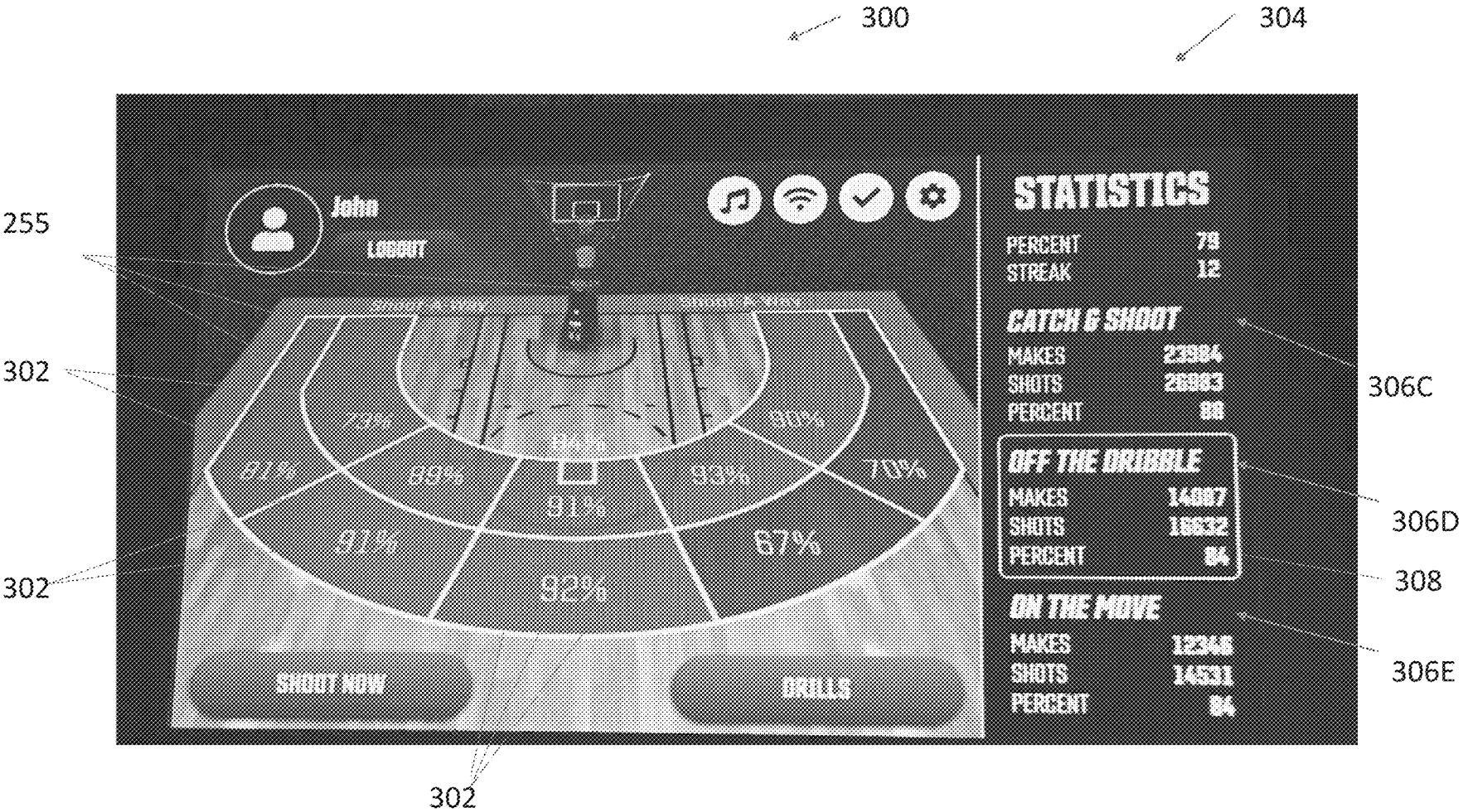
FIG. 32 is a front view of another exemplary embodiment of the performance report of FIG. 31.

FIG. 31 and FIG. 32 illustrate an exemplary performance report 300. The performance report 300 may be provided at the user interface 256, at other electronic devices (e.g., smartphone, tablet, laptop, or the like) in electronic communication with the basketball rebound machine 200, combinations thereof, or the like. Such electronic communication may be made by way of, for example without limitation, wireless or wired electronic communication, including but not limited to by way of the internet and one or more network communication devices. The report 300 may comprise the same or similar visual depiction 255 as provided for selecting the pass receipt locations and displaying the icons 258, though such is not required. The performance report 300 may be generated at the controller 154, the user interface 256, the other electronic devices, some combination thereof, or the like. The receiver of the report 300 may be the user who makes the selections at the user interface 256 or another party such as, a friend, parent, coach, assistant, player, or the like.

The report 300 may be generated based on data received from the user interface 256 regarding pass receipt locations selected, for example without limitation, and data received form the detector(s) 280 regarding shots made or missed, for example without limitation. The report 300 may comprise feedback 302 provided about the visual depiction 255 in approximate correspondence to the location where a basketball pass was sent and/or a basketball shot was taken.

The feedback 302 may comprise a number, percentage, combination thereof, or the like of made shots for each of the selection areas 257. For example, without limitation, all pass receipt locations (such as represented by the icons 258) selected within a given one of the selection areas 257 may be grouped into a common feedback 302 statistic, though such is not required. The feedback 302 may be color coded to indicate feedback above or below a predetermined threshold. For example, in the example provided in FIGS. 31-32, feedback above 70% is indicated with a red area while feedback at or below 70% is indicated in blue. Some of all of the feedback 302 may not be color coded.

A feedback category selectable area 304 may be provided as part of, or separate from, the performance report 300. A number of categories 306 for feedback 302 to be displayed at the feedback category selectable area 304 may be provided. The various categories 306 may be selected by a user, such as shown by selection indicator 308, and the corresponding category 306 of feedback 302 may be generated for display at the performance report 300. The selection indicator 308 may be, for example without limitation, a box around a selected category 306.

Such categories 306 may include, for example without limitation, career 306A (e.g., lifetime cumulative statistics for a given user), monthly 306B, catch and shoot 306C, off of the dribble 306D, on the move 306E, combinations thereof, or the like. In exemplary embodiments, the various categories 306 may be accessed by swiping, such as where the performance report 300 is provided on a touch screen, though other techniques may be utilized. In exemplary embodiments, the various categories 306 may be selected by touching, such as where the performance report 300 is provided on a touch screen, though other techniques may be utilized. In exemplary embodiments, off of the dribble shooting may be shooting attempts made following dribbling drills. On the move shooting may be shooting attempts made while the player is not stationary, but not necessarily following a dribble drill. The on the move shooting may include off the dribble shooting, or vice-versa, though such is not required.

Such off the dribble and/or on the move shooting may include, for example and without limitation, where the player takes a shot after performing a pre-shooting basketball move and/or performing such a pre-shooting basketball move immediately before receiving a pass and taking a shot. Such pre-shooting basketball moves may include any athletic, basketball related movements other than movements between the various pass receipt locations of the shooting drill. For example, without limitation, such pre-shooting basketball moves may include performing a simulated cut between pass receipt locations but exclude simply walking, jogging, running, or otherwise directly moving between the pass receipt locations.

Such off the dribble shooting may include, for example without limitation, types of basketball shots to be taken such as, but not limited to, layups (e.g., reverse layup, finger roll, tear drop, power layup, double clutch, combinations thereof, or the like), bank shot, putback and tip in, jump shots, slam dunks, fade away jumpers, combinations thereof, or the like. Such off of the dribble shooting may include, for example without limitation, other basketball actions taken pre- or post-receiving the pass, such as, but not limited to, movements (e.g., simulated or actual pick drill, roll, dodge, euro step, pro-hop, pro-hop euro step, power up, over-the head, combinations thereof, or the like) passing to another player or location (e.g., bounce pass, chest pass, over the head pass, touch pass, baseball pass, jump pass, blind pass, behind the back pass, combinations thereof, or the like), dribbling (e.g., cross over, between the legs dribble, behind the back dribble, wraparound, in and out dribble, v dribble, different heights dribble, ankle breaker dribble, hesitation move, combinations thereof, or the like), triple threat positions (e.g., pivot, jab step, pump fake, drawings contact, shuffle, combinations thereof, or the like), posting up (e.g., up and under, hook shot, drop step, power move, spin and dive, sikma move, dream shake, combinations thereof, of the like), two person games (e.g., give and go, dribble pitch or handoff, pick and roll, backdoor, alley-oop, combinations thereof, or the like), various combinations of the foregoing, or the like. Such off of the dribble shooting may include, for example without limitation, various drills incorporating one or more of the same. One or more of the foregoing examples may constitute a basketball move, for example without limitation. One or more of the foregoing examples, except for the types of basketball shots examples, may constitute a pre-shooting basketball move, for example without limitation. In exemplary embodiments, without limitation, such pre-shooting basketball moves comprise dribbling after receiving a pass from the launching device but before making a shooting attempt. Alternatively, or additionally, without limitation, such pre-shooting basketball moves comprise athletic movements of the user after making a shooting attempt at a first one of the pass receipt locations, but before making a shooting attempt at a second one of the pass receipt locations, that is not direct movement between the first and second one of the pass receipt locations and/or movement solely intended for transportation of the player between the first and second one of the pass receipt locations. Such pre-shooting basketball moves may be made immediately before and/or after receiving a pass at a pass receipt location.

In exemplary embodiments without limitation, such pre-shooting basketball moves may be those which are configured to simulate game conditions and may exclude exercise-related movements. For example, without limitation, the pre-shooting basketball move may be performed to simulate game conditions such as dribbling to get open, performing a juke, pick and roll, running off a pick, combinations thereof, or the like. As a further example, without limitation, such pre-shooting basketball moves may exclude purely exercise-related movements such as line drills, jogging laps, pushups, crunches, weightlifting, combinations thereof, or the like.

Such off the dribble shooting may be in contrast to stationary shots such as, but not limited to, free throws, planted feet shots, stationary catching and shooting attempts, combinations thereof, or the like. Such off of the dribble shooting may more realistically simulate game conditions, provide an increased workout, combinations thereof, or the like. However, particularly in an environment where shooting statistics are tracked and reported for the player or a third party to view, such as but not limited to, in a ranking across a team, group, multiple sessions, for a coach, parent, or other third party to view, the user may be reluctant to incorporate such off of the dribble shooting practice as their shooting performance statistics are likely to decrease due to the increased difficulty of such shooting attempts.

A prompt or option to designate one or more basketball passes received from the launcher 100 as being associated with an off the dribble and/or on the move shooting attempt may be provided at the interface 156. Such a prompt or option may be provided upon selection of an icon 285, selection of an area of the interface 156, or as a separate option or menu area of the interface 156. Designation of a pass and/or a pass receipt location as being associated with an off the dribble and/or on the move shooting attempt may be relayed to the controller 154 which may be configured to cause all made/missed data received from the detectors 280 to be recorded with an indication that such data is associated with off the dribble and/or on the move shooting attempts. This may permit the separate tracking and display of statistics related to such off the dribble and/or on the move shooting attempts.

In exemplary embodiments, off of the dribble shooting may be shooting attempts made following dribbling drills (e.g., catch the basketball, dribble it an amount, distance, time, combinations thereof, or the like, and then make a shooting attempt). On the move shooting may be shooting attempts made while the player is moving immediately before catching the basketball, and do not necessarily involve dribbling (e.g., running off a simulated or actual screen, pick and roll drill, cutting drill, combinations thereof, or the like). The on the move shooting may include off the dribble shooting, or vice-versa, though such is not required.

Cumulative feedback 302 for a given category 306 may be provided in association with each category 306. In exemplary embodiments, each category 306 may comprise at least a title, a cumulative number of made shots for the category, a cumulative number of shots taken for the category 306, and a percentage of made shots for the category 306. However, any number, type, kind, organization, and the like of such feedback 302 and such categories 306 may be utilized.

Figure 33:
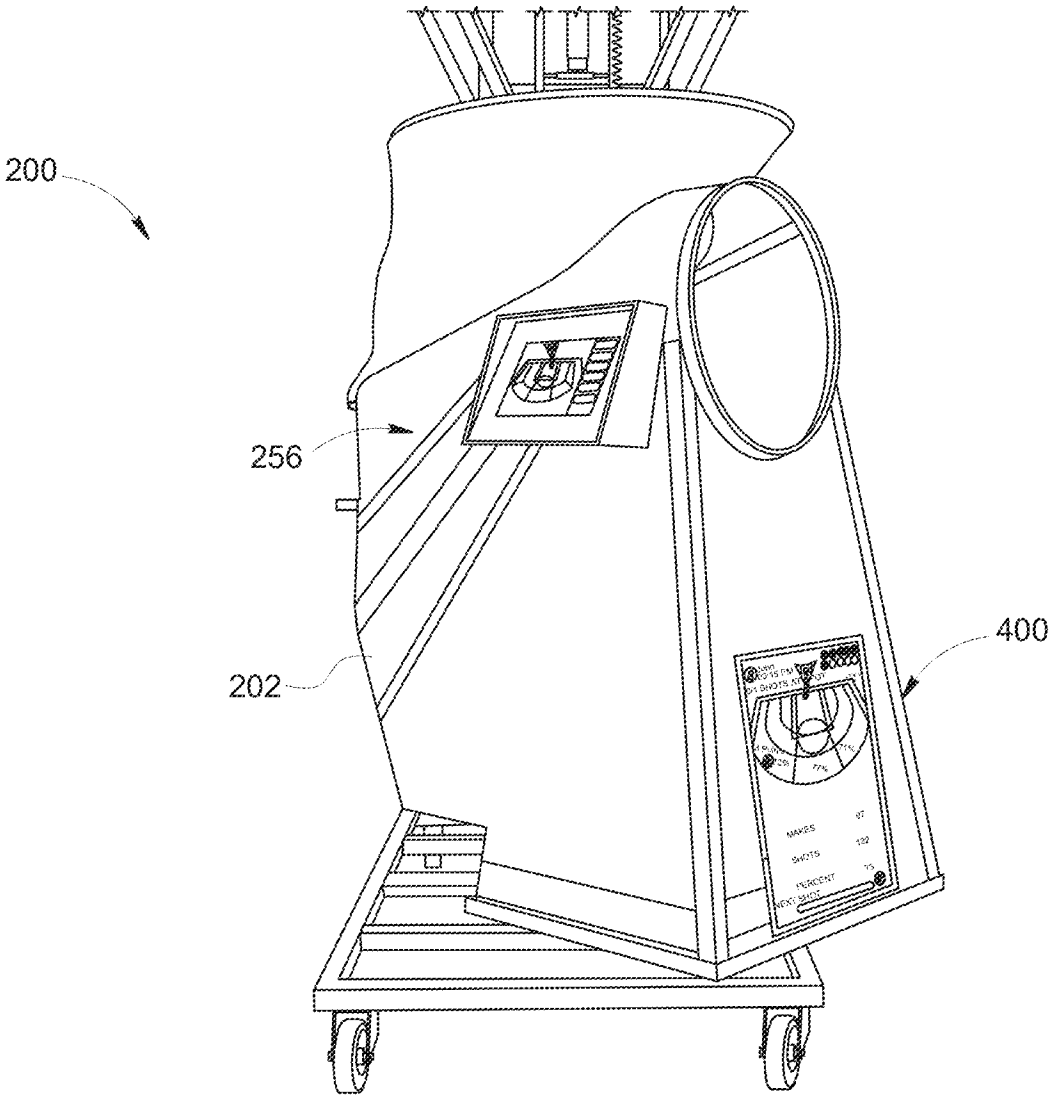
FIG. 33 is a detailed perspective view of an exemplary embodiment of the basketball rebound machine of FIG. 11.

FIG. 33 illustrates a detailed view of an exemplary embodiment of a portion of the rebound machine 200. The user interface 256 may be mounted to, fixed to, or otherwise associated with a first portion of the housing 202. A status display 400 may be mounted to, fixed to, or otherwise associated with a second portion of the housing 202. In exemplary embodiments, the user interface 256 is mounted to a side of the housing 202, while the status display 400 is mounted to a front portion of the housing 202, though the user interface 256 and/or the status display 400 may be located at any portion of the rebound machine 200. One or more apertures may be provided in the housing 202 for accepting basketballs from the collection net 206 and/or facilitating the passage of basketballs launched by the launching device 100. In other exemplary embodiments, the user interface 256 and/or the status display 400 may be mounted to the frame 204 and/or various members or structures extending therefrom. In yet other exemplary embodiments, the user interface 256 and/or the status display 400 may be remote from the rebound machine 200 and in wired or wireless communication with the rebound machine 200. For example, without limitation, the status display 400 may be provided as a scoreboard for a facility which displays certain shooting statistics for one or more such rebound machines 200 from one or more such facilities.

Figure 34:
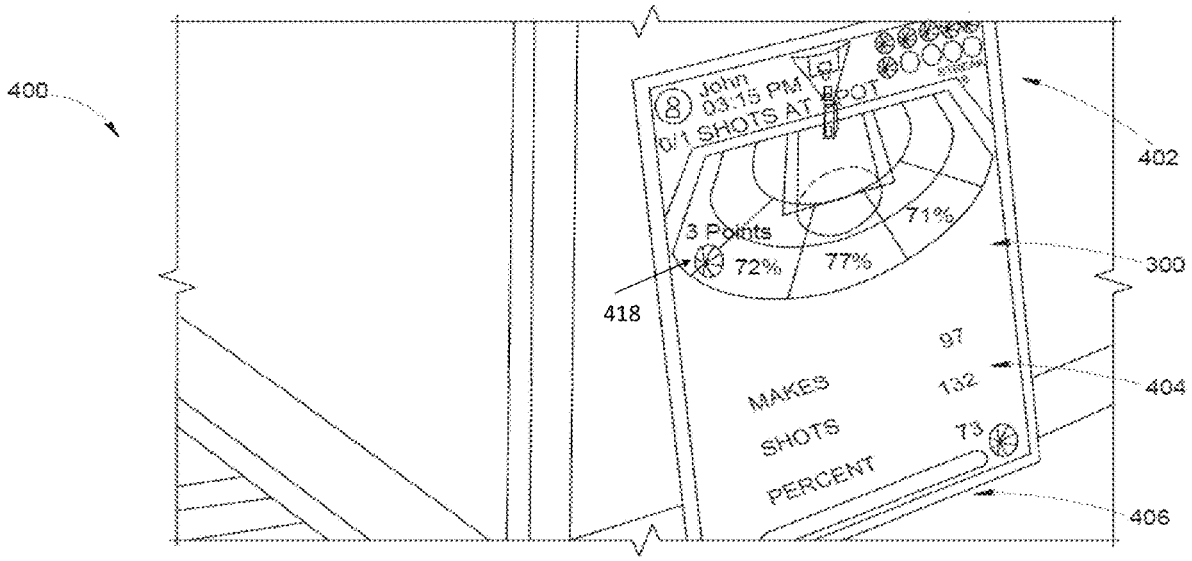
FIG. 34 is a detailed perspective view of a front display of the basketball rebound machine of FIG. 33.

FIG. 34 is a detailed view of the status display 400. The status display 400 may be in electronic communication with the controller 154, the user interface 256, the detector(s) 280, combinations thereof, or the like. The status display 400 may be configured to display one or more of: a streak display 402, the performance report 300 (including some or all of the various components thereof, such as but not limited to, the visual depictions 255, the feedback 302, the selection areas 257, combinations thereof, or the like), a cumulative statistics display 404, and a next pass status display 406. The status display 400 may, alternatively or additionally, comprise some or all elements of the user interface 256 display such as, but not limited to, the visual depictions 255, the icons 258, combinations thereof, or the like. The content displayed at the status display 400 may be controlled at the status display 400, the controller 154, combinations thereof, or the like.

In exemplary embodiments, the status display 400 may be provided, alternatively or additionally, elsewhere, such as but not limited to, at one or more remote electronic devices in electronic communication with the rebound machine 200.

The cumulative statistics display 404 may comprise a graphical representation of a number of made shots (e.g., as detected by the detectors 280), number of shots attempted (e.g., as determined by the number of passes launched by the launching device 100), and an overall percentage of made or missed shots for a given practice session (e.g., as determined by the controller 154 based on the aforementioned data points). In exemplary embodiments, the streak display 402 is provided along an upper edge of the status display 400, the performance report 300 is provided below the streak display 402, the cumulative statistics display 404 is provided below the performance report 300, and the next pass status display 406 is provided below the performance report 300, though any arrangement of the status display 400 and items displayed thereon may be utilized.

The status display 400 may include a next pass indicator 418. In exemplary embodiments, without limitation, the next pass indicator 418 comprises a representation of a basketball, though other symbols may be utilized. For example, without limitation, the next pass indicator 418 may optionally take the form of the icons 258. The next pass indicator 418 may be provided at a graphical representation of a basketball playing area at a location visually corresponding to the programmed location of the next pass. In this way, a user knows where to stand to receive the next pass. Preferably, but optionally, the graphical representation at least substantially (e.g., at least 75%), or more preferably entirely, matches the representation provided at the user interface 256, such as for selecting pass locations.

The next pass indicator 418 may be displayed without other pass indicators, such as the icons 258. Alternatively, or additionally, the next pass indicator 418 may be highlighted, such as to stand out from the other icons 258 which may also optionally be displayed.

The next pass indicator 418 may be provided as part of and/or with the performance report 300, though such is not required. For example, without limitation, the next pass indicator 418 may be provided at the graphical representation without the performance information (e.g., shots made/missed statistics). However, the statistics and/or other information may optionally be also provided, such at locations at the graphical representations visually corresponding to where the relevant passes were provided and/or where the relevant shots were indicated to be taken.

The next pass indicator 418 may be generated by way of instruction from the controller 154. The controller 154 may be configured to determine placement of the next pass indicator 418 based on stored passing drill information, such as received as part of the user input at the user interface 256 for programming the passing drill. The next pass indicator 418 may optionally be part of the status display 400.

Figure 34B:
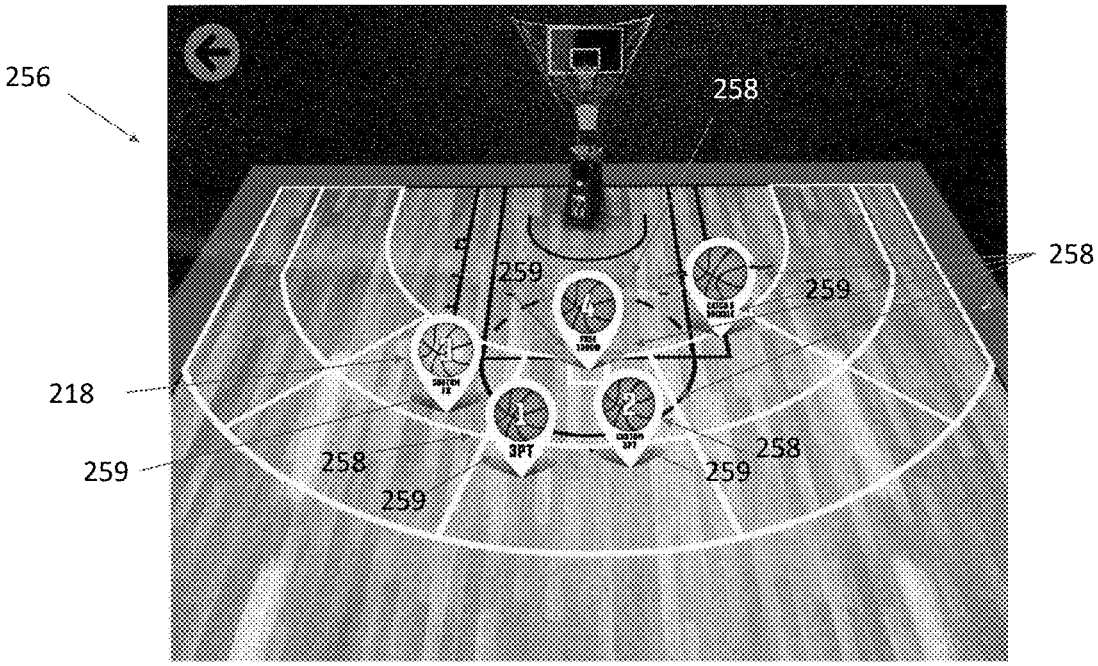
FIG. 34B is a detailed perspective view of another exemplary embodiment of the user interface of the basketball rebound machine of FIGS. 33 and/or 21.

As illustrated with particular regard to FIG. 34B, a next pass indicator 218 may alternatively, or additionally, be provided at, or as part of, the user interface 256. The next pass indicator 218 may comprise a highlighted or otherwise altered form of the icon(s) 258. In other exemplary embodiments, the next pass indicator 218 is displayed (in highlighted/altered form or otherwise) without the other icons 258. The next pass indicator 218 may be provided by way of instruction from the controller 154 such as at, or part of, the user interface 256.

The icons 258 and/or next pass indicator 218 may comprise descriptive labels 262. The descriptive labels 262 may comprise instructions for a player to follow before and/or after receiving a pass. The labels 262 may be provided in accordance with a programmed passing drill. The descriptive labels 262 may include point values and/or indicate where a shot should be taken from (e.g., field goal, 3 PT, 2 PT, free throw, by way of non-limiting example) and/or actions to be taken (e.g., catch and dribble, catch and shoot, dribble left, dribble right, jump shot, placed shot, by way of non-limiting example). The descriptive labels 262 may be provided in accordance with user input received for programming the passing drill, such as received at the user interface 256.

Figure 35:
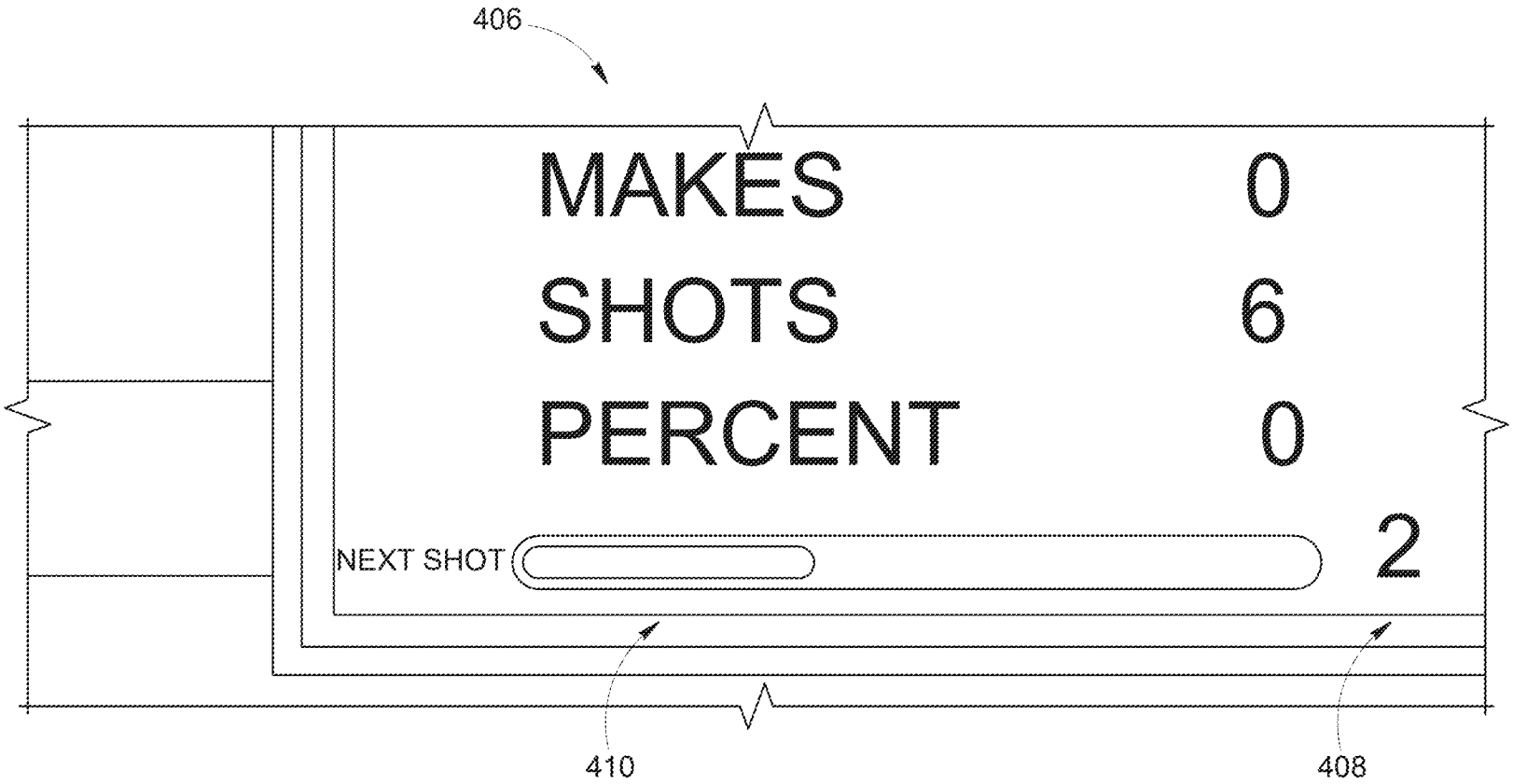
FIG. 35 is a detailed front view of a portion of the front display of FIG. 34.
Figure 36:
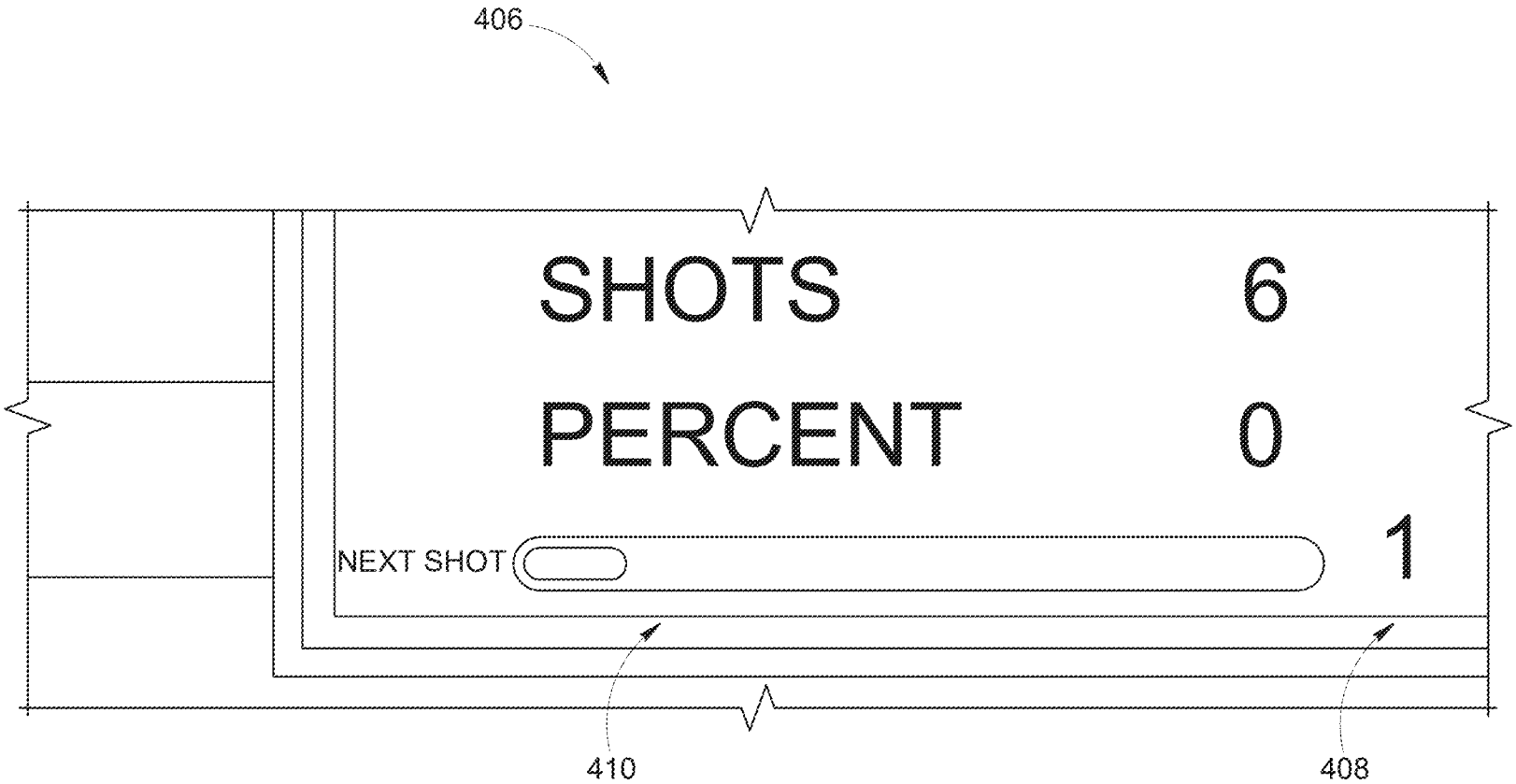
FIG. 36 is another exemplary embodiment of the portion of the front display of FIG. 34.
Figure 37:
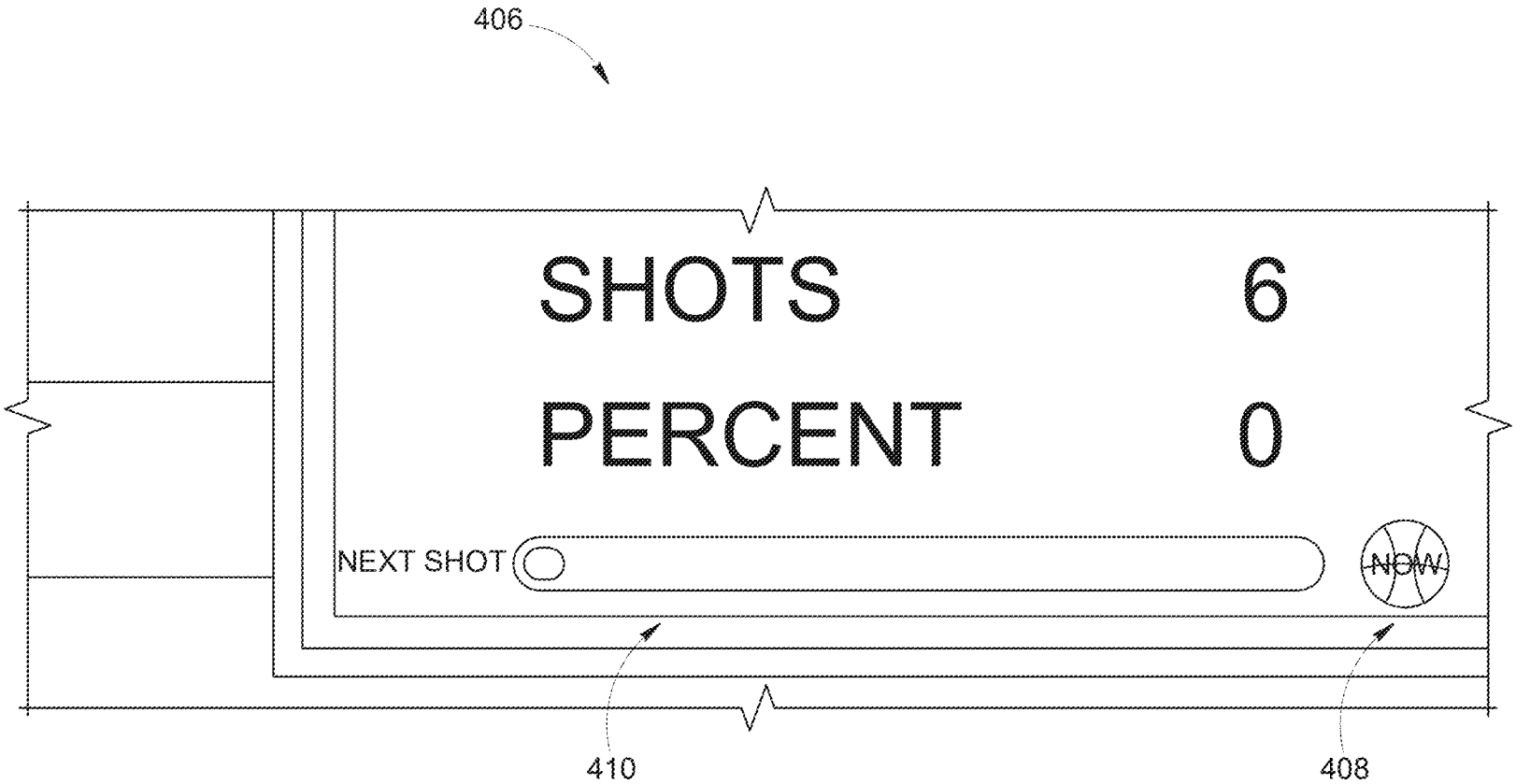
FIG. 37 is another exemplary embodiment of the portion of the front display of FIG. 34.

FIG. 35 through FIG. 37 illustrates an exemplary sequence of displays for the next pass status display 406. In exemplary embodiments, the next pass status display 406 may be provided along a bottom edge of the status display 400, though it may be provided elsewhere. The next pass status display 406 may comprise a timing display 408. The timing display 408 may comprise a numerical display of a number of seconds left until a next basketball is expected to be launched from the launching device 100.

The next pass status display 406 may comprise a graphical representation 410 of the number of seconds left until a next basketball is expected to be launched from the launching device 100. In exemplary embodiments, the graphical display 410 comprises a slider bar which decreases in length as the time for the next basketball to be launched nears. However, any type or kind of graphical display 410 may be utilized.

In exemplary embodiments, upon the timing display 408 reaching zero and/or the graphical display 410 reaching the anticipated next pass, the timing display 408 may display a graphic indicating the next pass is expected.

Figure 38:
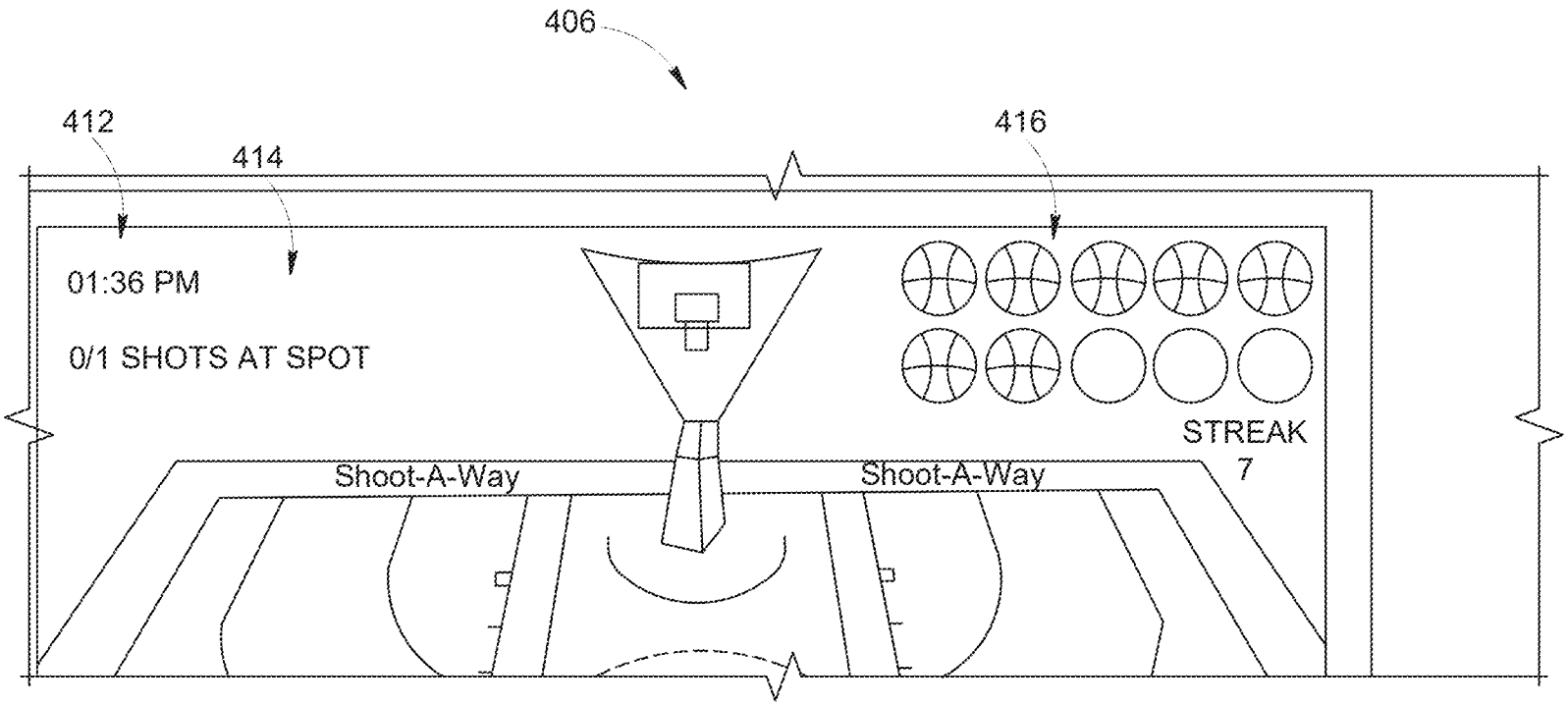
FIG. 38 is a detailed front view of another portion of the front display of FIG. 34.

FIG. 38 is a detailed exemplary streak display 402. In exemplary embodiments, the streak display 406 may comprise one or more of: a time display 412, a number of shots made/missed at a given pass receipt location display 414, and a number of shots made in a row display 416. The time display 412 may comprise the current time, which may be determined at the controller 154, which may comprise one or more timing devices. The number of shots made in a row display 416 may comprise a numerical representation of the player's current streak and/or a graphical representation. The graphical representation may comprise a number of basketball icons representing each of the made shots in a row, though any icon, symbol, or the like may be used.

Figure 39:
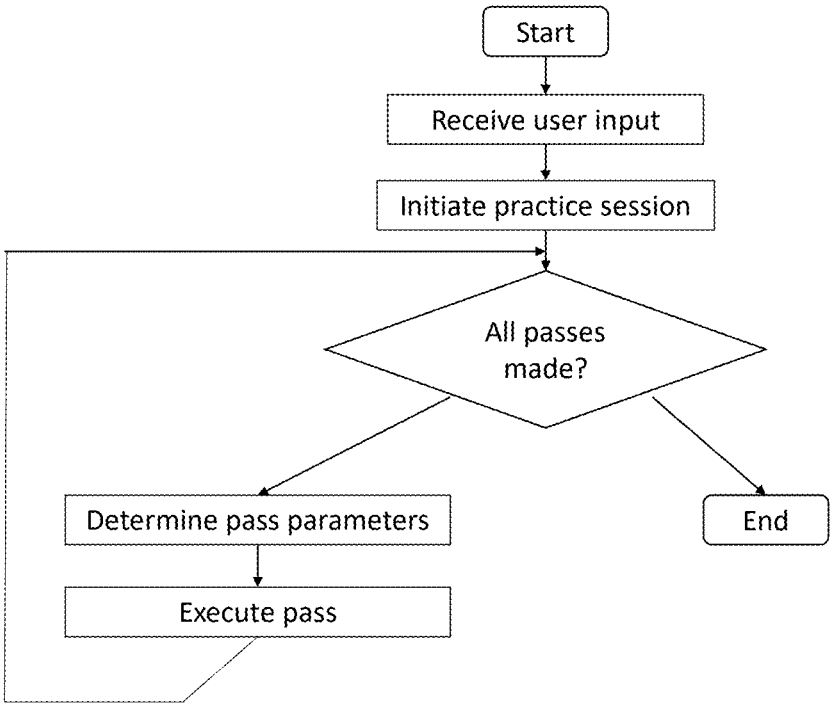
FIG. 39 is a flow chart with exemplary logic for operating the basketball rebound machine and/or component thereof.

FIG. 39 illustrates exemplary operations of the basketball rebound machine 200 and/or components thereof. User input for programming a practice session is received, such as by way of the user interface 256.

As discussed here, in exemplary embodiments but without limitation, such input may include touched locations at a rendering of at least part of a basketball court (e.g., three-point arc and/or key) which may vary in linear distance and angular position relative to a rendering of a basketball goal and/or of the machine 200 and/or other reference point at the user interface 256. The position of such touched locations (e.g., linear distance and angular position information) may be recorded and used, such as by the controller 154, to cause operations of the basketball launching device 100 and/or the automatic distance adjustment mechanism 152 to cause passes of basketball to corresponding locations (e.g., at relative linear distance and angular position to the machine 200) in the real world. In this way, the player may intuitively program the machine 200 and know where to stand to receive passes. Notably, as further explained herein, the position of such touched locations may vary in linear distance and angular position information from certain rendered objects and may be passed in the real world accordingly, but the machine 200 may be operated using a different reference point, such as but not limited to, a first pixel of the user interface 256 display or the like.

Figure 40A:
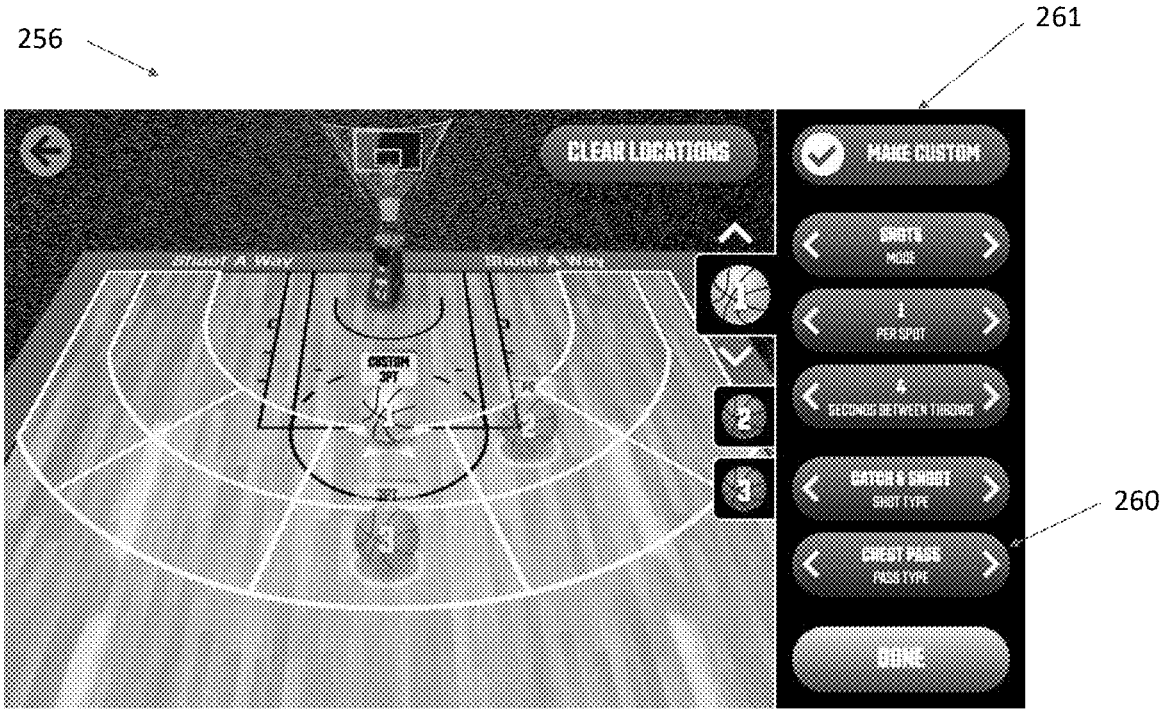
FIG. 40A is an exemplary user interface for providing at least some of the user input for use with the logic of FIG. 39.
Figure 40B:
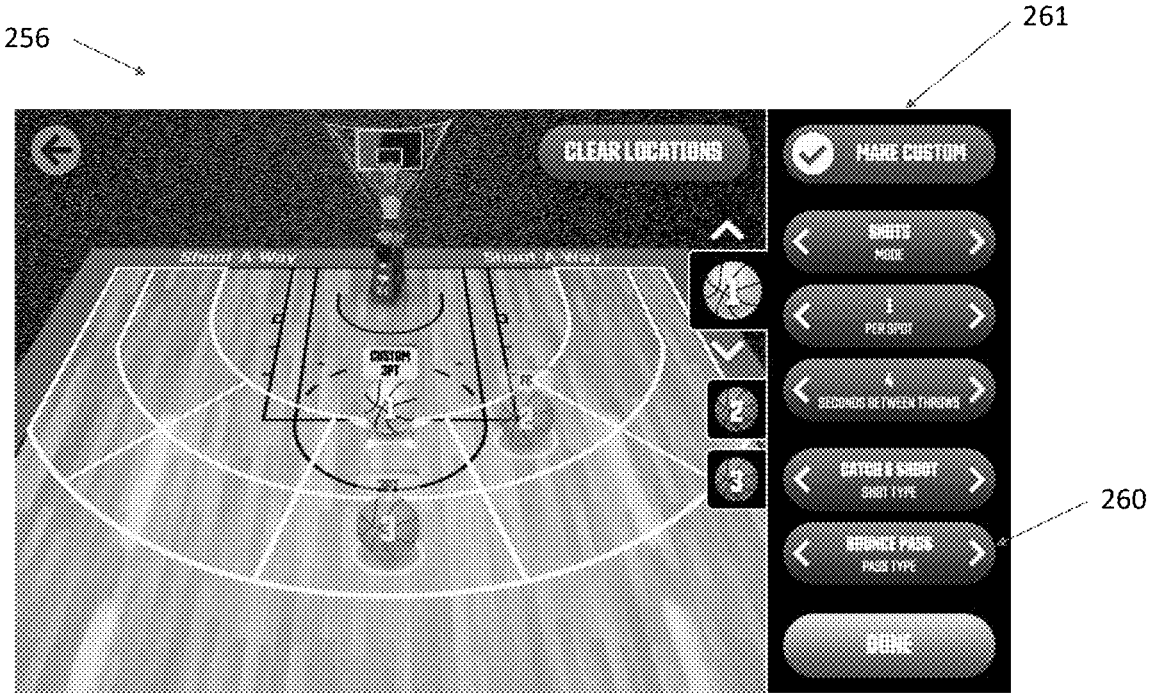
FIG. 40B is another exemplary embodiment of the user interface of FIG. 40A.
Figure 40C:
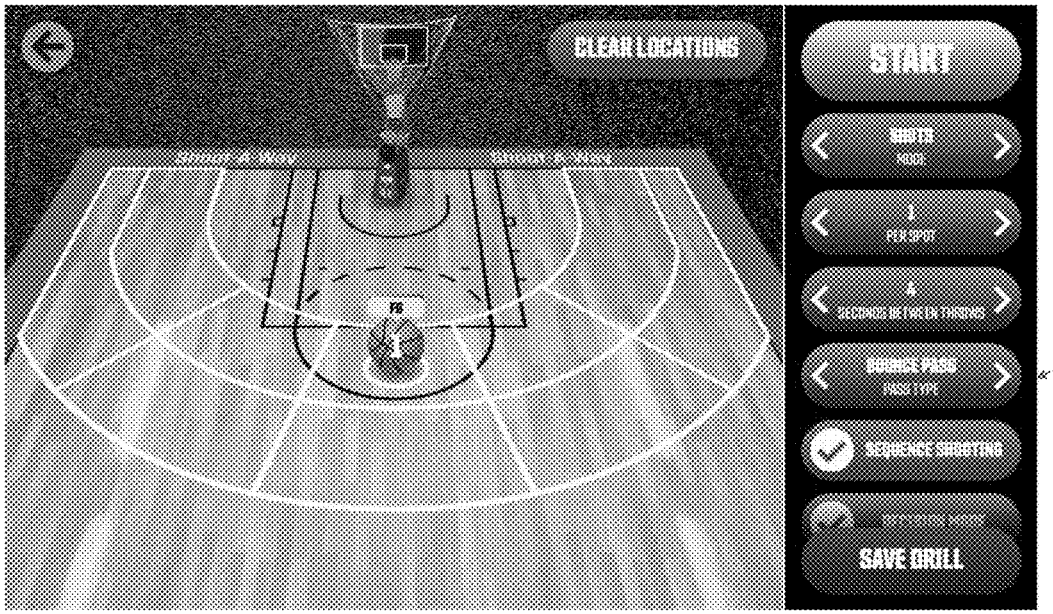
FIG. 40C is another exemplary embodiment of the user interface of FIG. 40A.

FIG. 40A through FIG. 40C, by way of non-limiting example, illustrates the user interface 256 with an exemplary a pass type option 260 for selecting a type of pass to be delivered by the machine 200 for a given location. This pass type option 260 may be provided as part of a customization option 261, which may include other options for pass-specific and/or drill specific characteristics (e.g., shot type, passes per location, time between throws, shot type), such as illustrated with particular regard to FIGS. 40A-40B. This may be used to customize new locations or existing (e.g., already selected) locations. Such changes, including but not limited to pass type 260, may be made on a location-by-location basis, such as by selecting the make custom option 261 for a given icon 258 and/or by way of the menu 259 which may be used to select a particular corresponding location/icon 258 for customization. Alternatively, or additionally, the pass type option 260 may be provided for each new location upon initial selection, such as illustrated with particular regard to FIG. 40C. Alternatively, or additionally, the pass type option 260 may be applied to an entire drill and/or multiple locations/icons 258. If no customization 261 and/or pass type option 260 is selected, a default pass type (e.g., chest pass) may be assigned by the controller 154. In other exemplary embodiments, the pass type option 260 may be provided independently, or as part of another option or prompt.

Types of passes available for selection may include, by way of non-limiting example, chest pass, bounce pass, overhead pass, combinations thereof, and the like. In exemplary embodiments, a user is able to select between a chest pass and a bounce pass.

The controller 154 may be configured to determine operations of the machine 200 (e.g., the basketball launching device 100 and/or the automatic distance adjustment mechanism 152) based on the received user input data and/or any default selections in accordance with the following exemplary, but non-limiting, analysis.

The position of the icons 258 may be determined relative to the rendering of the three-point arc at the interface 256 or another reference point, such as but not necessarily limited to, a first pixel of the user interface 256 display.

The following parameters may be utilized, by way of example, to determine passing operations on a location by location basis for the machine 200: court angle, court kind, distance, minimum analog to digital conversion (ADC) value, maximum ADC value, and player height. Other parameters may be used in addition or substitution and/or a subset of the parameters may be utilized in other embodiments. Different default and/or scaling/compensation values for such parameters may be utilized than illustrated and/or described herein. Exemplary embodiments for carrying out this analysis are provided herein.

A court type may be selected, such as by user selection at the interface 256 or default selection, which may be made based on player information (e.g., school affiliation and/or age information) and/or preprogramming. Court types may include, by way of non-limiting example, high school, NBA, and NCAA, which may reflect high school, NBA, and NCAA regulation three-point arc and/or other court line distances, by way of non-limiting example. Various regulatory or industry standards for such courts may be utilized.

The controller 154 may determine the angular position, by way of non-limiting example, as an angular degree between 0 and 179 degrees, where 0 degrees is the bottom left corner of the court (viewed facing a rendering of the court end line and/or rendering of the machine 200 and/or basketball goal at the interface 256), 179 degrees is the bottom right corner of the court, and intervening angular positions are evenly spaced therebetween. Angular position may be determined in 1 degree increments, though such is not required. While angles between 0 and 179 degrees are sometimes shown and/or described, other reference numbers may be used (e.g., 1 and 180 degrees, 30 and 160 degrees, etc.) such as based on pre-programmed criteria, user preferences, machine 200 capabilities, and the like. Exemplary analysis in this regard is further provided herein.

The controller 154 may be configured to determine the angle using X, Y coordinate position information, such as of touched locations and/or icons 258. More specifically, without limitation, the horizontal distance and vertical distance of a touched location and/or icon 258 relative to a predetermined reference point on the interface (a rendered object such as the three-point arc, machine 200, basketball goal, or the like), and/or another, predetermined location corresponding or not necessarily corresponding with a rendered object (e.g., a first pixel of the interface 256, a corner of the interface 256, or the like). In exemplary embodiments, the X and Y coordinate information may form sides (e.g., opposite and adjacent) of an imaginary triangle formed between the selected location and the reference point. Known trigonometric functions and/or relationships (e.g., tangent function) may be utilized to determine an angular value thereof. Other known coordinate translation, normalization, and/or trigonometric techniques may be utilized to find other, corresponding angular values, such as depending on where the reference point is provided at the interface 256. In this way, the reference point need not necessarily be tied to any one point at the interface 256. Exemplary analysis in this regard is further provided herein.

In other exemplary embodiments, without limitation, angular position and linear distance information may be provided from X, Y pixel information (e.g., pixel count between touched location and/or icons 258 to one or more reference points. The reference points may include, by way of non-limiting example, a corner or edge of interface 256 (e.g., first pixel), value for rendered end court line, basketball goal, machine 200, combinations thereof, or the like. The X, Y values may be an average, a least value, a highest value, combinations thereof, or the like. For example, without limitation, the touched location may span multiple pixels, but a minimum, maximum, average, or other value may be utilized as a representative value.

The controller 154 may be configured to cause the basketball launching device 100 to rotate in accordance with the determined angular position value accordingly. For example, without limitation, where an icon 258 is positioned at 75 degrees to a reference point at the interface 256, the controller 154 may correspondingly cause the basketball launching device 100 to rotate to 75 degrees based on the foregoing in the real-world for the respective pass. However, as described above, the relationship need not necessarily be one-to-one but can be normalized to various reference points and/or frames.

In exemplary embodiments, without limitation, the controller 154 may operate the basketball launching device 100 in accordance with the following equation:

$$\text{Impulse (for rotation of launching device 100)} = \text{angular value} * \text{compensation value} \qquad \text{Equation 1}$$

Where the impulse value is the value provided to the basketball launching device 100 by the controller 154, such as to cause corresponding motor or other mechanical operations resulting in corresponding rotation of the basketball launching device 100 and/or components thereof, such as relative to some or all of the frame 204. The compensation value may be a predetermined value configured to cause the basketball launching device 100 to rotate a predetermined amount to reflect the angular value of the location at the interface 256. The compensation value and/or impulse value may reflect a time of motor operation, an angular rotation value, a number of rotations, combinations thereof, or the like. Such rotation and/or other movement may be accomplished by way of motors, actuators, gears, chains, cams, combinations thereof, or the like.

The controller 154 may determine pass strength based on one or more of the following factors. The controller 154 may determine the linear distance (LD) of the touched location and/or icon 258 relative to a same or different reference point of the interface 256 (e.g., rendering of the machine 200, basketball goal, three point arc, base line, corner of the interface 256 (e.g., first pixel thereof), combinations hereof or the like). This may be the Y coordinate value, by way of non-limiting example.

The controller 154 may modify the LD value by a modifier to compensate for the scaled distance to real world locations. This scaling value (SV) may be predetermined. The SV may be a fixed value and/or equation which is applied to the LD value, such as based on the location relative to the reference point. The SV may vary based on the location relative to one or more rendered objects, such as the three point arc, free throw line, base court line, machine 200, basketball goal, combinations thereof, or the like. The SV may be provided as a lookup table, one or more equations, one or more fixed values, combinations thereof, or the like. The SV may be determined in accordance with one or more known trajectory equations for objects in flight.

The SV may vary with, and/or be further modified by, the selected court type (CT). For example, without limitation, where a touched location or icon 258 is positioned at half distance between the rendering of the machine 200 and/or basketball goal and the three-point arc, the controller 154 may scale the distance value differently if a high school court is selected compared to an NBA court as the two have different real-world distances between the basketball goal, where the machine 200 is presumably located, and the three-arc according to official regulations, and thus, the user may be standing at a different location in the real world depending on what type of court the user is playing at.

The controller 154 may be configured to compensate to anticipated drag (e.g., air resistance), such as using one or more equations and/or modifiers, which may be predetermined. Various known equations and/or modifiers may optionally be used which compensate for average drag factors for trajectory objects. This may sometimes be referred to as a drag value (DV). The DV may be applied as part of the SV or separately therefrom.

The controller 154 may be configured to compensate for pass type (PT), such as based on user selection and/or default values. For example, without limitation, the value used for a chest pass may be X, but the value for a bounce pass may be X/2, whereas the value for an overhead pass may be X+Y, where Y is a predetermined value. Other values and/or equations may be utilized. The PT may be applied as part of the SV or separately therefrom.

Optionally, the controller 154 may be configured to compensate for anticipated player height (PH), such as based on known information and/or default values. For example, without limitation, the SV may be set or modified based on player height so that each player may receive a pass at roughly pass height. A default value may be set for roughly 5' 9" for a roughly 6' player may be set, such that known player height above or below 6' may result in modifications to the delivered pass, by way of non-limiting example. The PH may be applied as part of the SV or separately therefrom.

In exemplary embodiments, without limitation, the controller 154 may operate the automatic distance adjustment mechanism 152 in accordance with the following equation:

$$\text{Impulse Value to Distance Adjustment Mechanism} = \text{function}(LD, SV, CT, DV, PT, PH) * \text{compensation value} \qquad \text{Equation 2}$$

Where the impulse value is the value provided to the automatic distance adjustment mechanism 152, such as to the linear actuator thereof, by the controller 154, such as to cause a change in distance to the spring 130, though the impulse value may be utilized for other types and kinds of launchers 100 and/or distance adjustment mechanisms 152, such as motorized wheel speed, piston force, pneumatic force (e.g., pressure values), combinations thereof, or the like. The compensation value may be a predetermined value configured to cause the automatic distance adjustment mechanism 152 (e.g., linear actuator, pneumatic system, and/or motor thereof) to actuate a predetermined amount to reflect the angular value of the location at the interface 256. The compensation value and/or impulse value may reflect a time of linear actuator operation, a position value, a pneumatic pressure value, a wheel speed value, a motor operation level, combinations thereof, or the like.

The impulse value, as described herein, may be a function of one or more of the LD, SV, CT, DV, PT, and PH, and each of which may be applied to one another by way of multiplication, addition, subtraction, division, factoring, combinations thereof, or the like, and each of which may utilized one or more multi-variable algorithms.

Additional or alternative analysis in this regard is further provided herein.

The controller 154 may have certain minimum and/or maximum parameter values, which may control the maximum or minimum operations of the machine 200 to throw basketballs.

Various coordinate transformations, viewpoint normalizations, and/or measurement normalizations may be utilized by the controller 154.

Operations of the machine 200 (e.g., the basketball launching device 100 and/or the automatic distance adjustment mechanism 152) may be performed simultaneously or sequentially.

Figure 41:
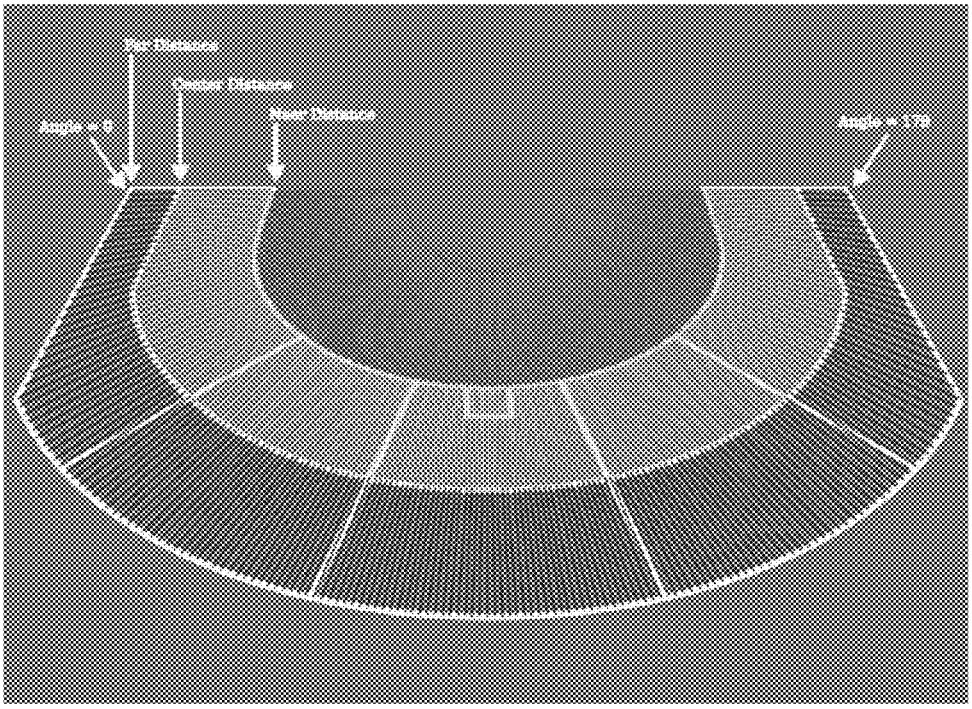
FIG. 41 is an exemplary visualization of certain precomputed court distance and angles for use with the logic of FIG. 39.

Alternatively, or additionally, the following exemplary embodiments may be utilized, in whole or in part, such as to control pass operations of the machine 200 to provide passes in the real world corresponding to the angular position and linear distance of selected locations at the user interface 256. As illustrated with particular regard to FIG. 41, a pre-computed database of distances for court angles may be provided, such as part of a list, table, or the like, in exemplary embodiments. This may speed up calculations so that passing operations can be timely computed for timely operations, such as without the need for more extensive computing resource and/or hardware.

Figure 42:
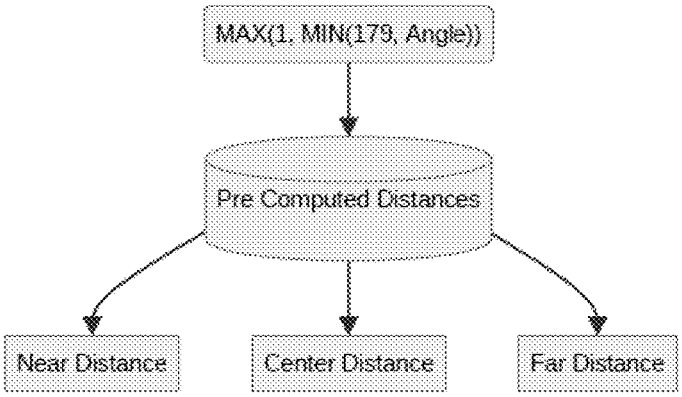
FIG. 42 is a flow chart with exemplary logic determining the precomputed court distances and angles of FIG. 41 and/or for use with the logic of FIG. 39.

In exemplary embodiments, each court angle is associated with three values, a near distance, a center distance, and a far distance, though other number of values may be utilized, such as illustrated at FIG. 42. Each of these distances may represent a distance (e.g., Y coordinate value), from a predetermined reference location, such as a top center of the representation at the user interface 256, though a different predetermined reference location may be utilized. For example, a court angle value of 1 may be associated with a near distance of 167, a center distance of 242, and a far distance of 281, a court angle of 2 may be associated with 168, 244, and 283, respectively, and so forth. Other relationships may be utilized, such as based on other size and/or shape user interfaces 256, different predetermined reference locations, and/or various size and/or shape representations. The pre-computed distances may be indexed with court angles between 1 and 179, by way of example. This pre-computed distance value may be utilize as further provided herein.

Figure 43:
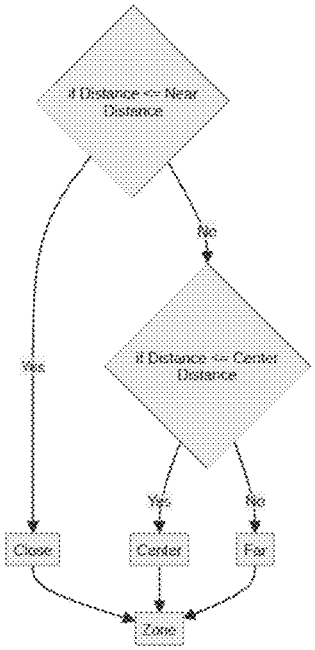
FIG. 43 is a flow chart with exemplary logic determining a zone for use with the logic of FIG. 39.

A zone for a particular location distance (e.g., Y coordinate value) may be determined as provided in FIG. 43, by way of example. For example, without limitation, a user selected location at the user interface 256 may have an X, Y coordinate value relative to a reference point. The angle of the coordinate value may be determined, such as using known geometric relationships as previously described. This value may be used to determine the corresponding pre-computed distances (near, center, far). The actual distance value (e.g., Y coordinate value) may be compared against the pre-computed distances for the respective court angle, such as provided in FIG. 43, though other analysis techniques may be utilized (e.g., compare against far distance first) in other exemplary embodiments.

Figure 44:
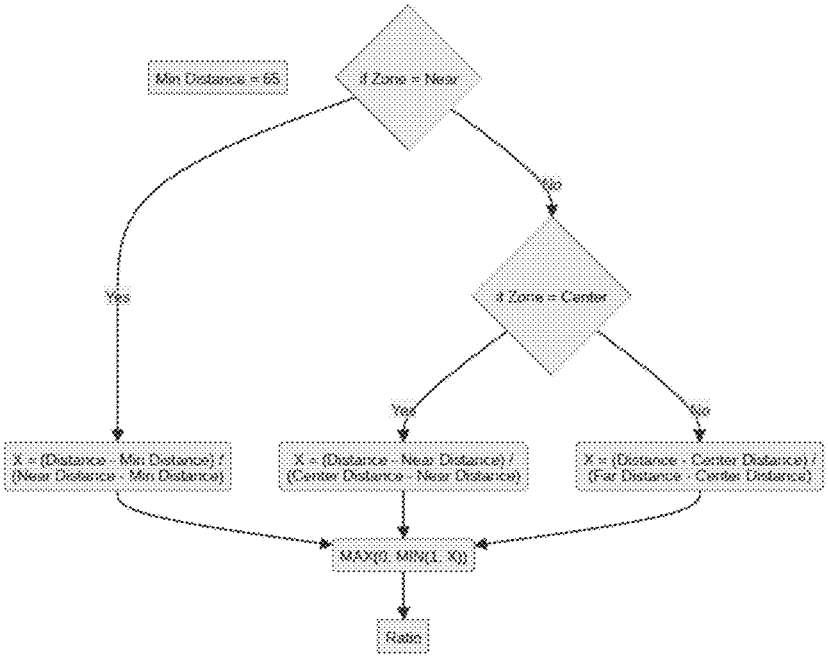
FIG. 44 is a flow chart with exemplary logic determining a ratio for use with the logic of FIGS. 39 and/or 43.

A ratio for a given zone may be determined as provided in FIG. 44, by way of example. As illustrated, the ratio determination may include zone specific algorithmic determinations. As illustrated, the ratio may be subject to maximum and/or minimum values. Other analysis techniques may be utilized, such as determining if the zone is the center or far value first in other exemplary embodiments.

Figure 45:
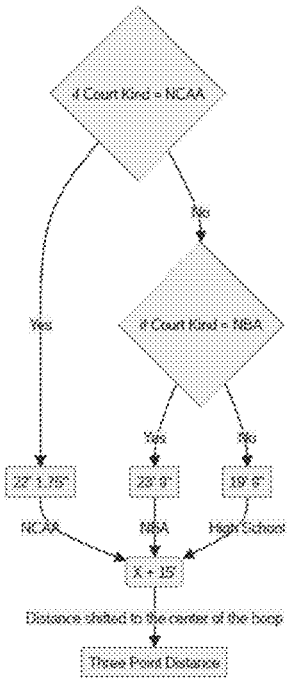
FIG. 45 is a flow chart with exemplary logic determining a three point distance for a given court type for use with the logic of FIG. 39.

The point distance for a given court kind may be determined as provided in FIG. 45. As illustrated, the three point distance may include a court kind specific adjustment and a shift to compensate for the presumed machine 200 location below the center of a basketball hoop, which is normally a distance from the end line. Other analysis techniques may be utilized, such as determining court type in a different order or manner.

Figure 46:
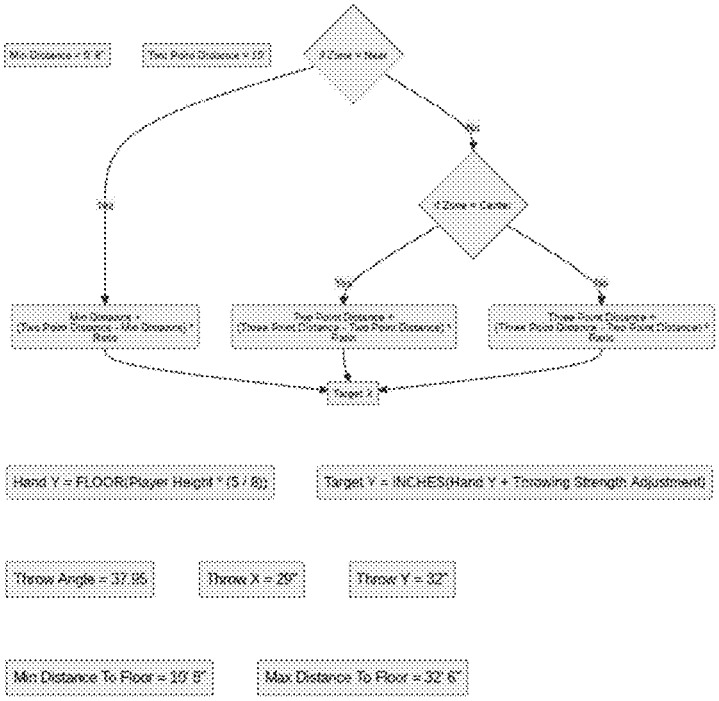
FIG. 46 is a flow chart with exemplary logic determining a target distance for use with the logic of FIG. 39.

A target distance may be determined as provided in FIG. 46. As illustrated, various input values may be provided, at least some of which may require certain algorithmic determination, such as based on various input criteria at the user interface 256 and/or by default value. Other analysis techniques may be utilized, such as determining zone type in a different order.

Figure 47:
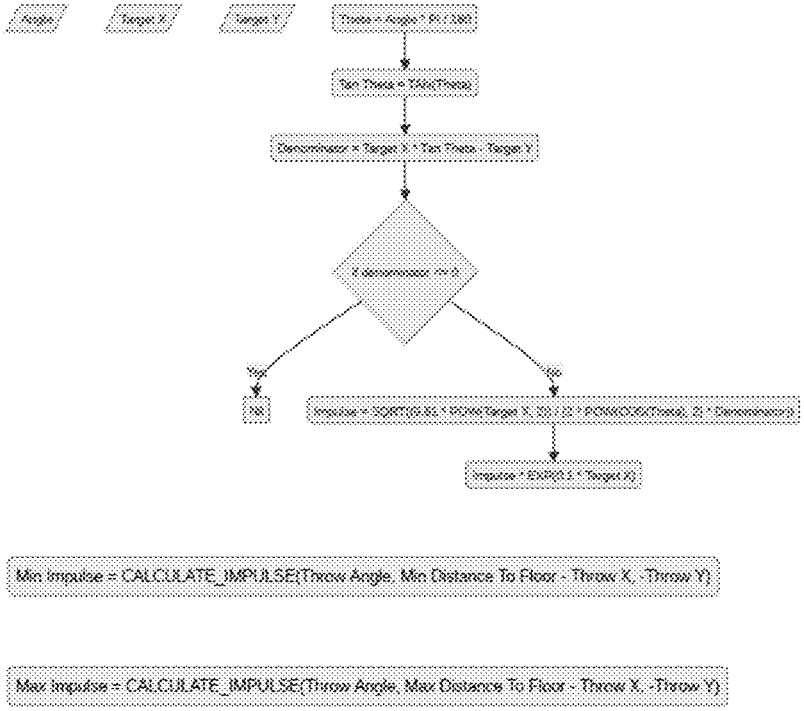
FIG. 47 is a flow chart with exemplary logic determining an impulse value for use with the logic of FIG. 39.
Figure 48:
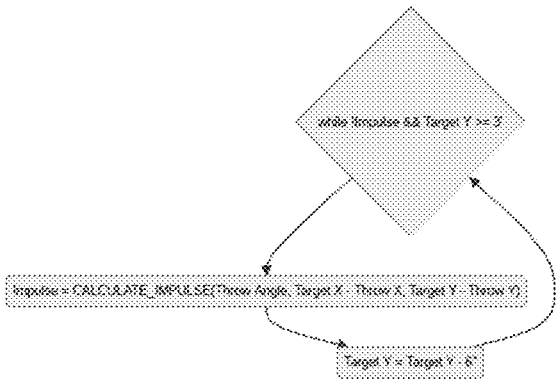
FIG. 48 is a flow chart with exemplary further logic determining the impulse value for use with the logic of FIGS. 39 and/or 47.
Figure 49:
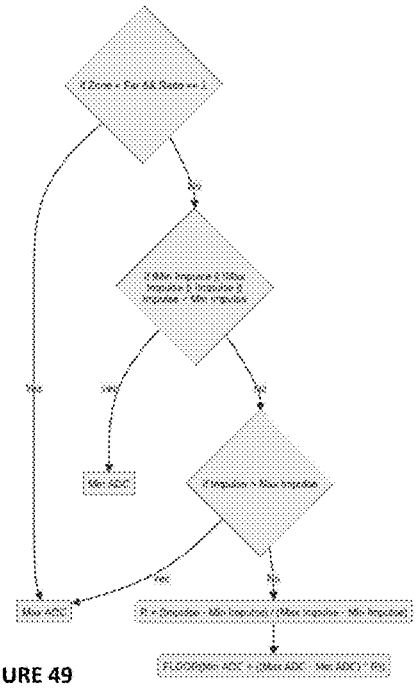
FIG. 49 is a flow chart with exemplary logic determining an analog to digital conversion value for use with the logic of FIG. 39.

An impulse value provided to the automatic distance adjustment mechanism 152 (e.g., linear actuator) may be determined as provide in FIG. 47 and FIG. 48, and may be subject to minimum an/or maximum values as provided in FIG. 49. As illustrated, various input values may be provided, at least some of which may require certain algorithmic determination, such as based on various input criteria at the user interface 256 and/or by default value. Other analysis techniques may be utilized, such as to provide compensation for various types and/or kinds of distance adjustment mechanisms 152 (e.g., different type and/or kind of liner actuator).

While the foregoing, including but not necessarily limited to, the description and/or illustrations of FIGS. 40A-49, provide an exemplary and advantageous approach to carrying out the claimed invention, the invention is not necessarily intended to be limited to exactly the embodiment(s) disclosed. Other parameters, algorithmic approaches, and/or other techniques may be utilized, for example, such as subject to various parameters (e.g., minimum and/or maximum values and so forth).

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

Certain operations described herein may be performed by one or more electronic devices. Each electronic device may comprise one or more processors, electronic storage devices, executable software instructions, and the like configured to perform the operations described herein. The electronic devices may be general purpose computers or specialized computing devices. The electronic devices may be personal computers, smartphones, tablets, databases, servers, or the like. The electronic connections and transmissions described herein may be accomplished by wired or wireless means. The computerized hardware, software, components, systems, steps, methods, and/or processes described herein may serve to improve the speed of the computerized hardware, software, systems, steps, methods, and/or processes described herein.

What is claimed is:

1. A basketball launching system providing multiple types of basketball passes, said system comprising:

a user interface;

a structural framework;

a throwing mechanism supported by said structural framework;

a distance adjustment mechanism supported by the structural framework; and a controller in electronic connection with said throwing mechanism, said distance adjustment mechanism, and said user interface, wherein said controller is configured to:

generate, at the user interface, one or more prompts requesting a user to select pass receipt locations and one or more options for the user to select a pass type;

receive data from the user interface indicating user input provided in response to the one or more prompts and any selection of the one or more options;

command the throwing mechanism to launch at least one basketball to each of the user selected pass receipt locations, including commanding the basketballs to be launched in accordance with the selection of the one or more options, where provided, regarding the pass type, said one or more options including a bounce type pass;

where the selection of the one or more options indicates selection of the bounce type pass for one or more of the user selected pass receipt locations ("bounce pass location(s)"), operate the distance adjustment mechanism to reduce a launch speed and/or force of the throwing mechanism for operations of the throwing mechanism associated with the bounce pass location(s), including by adjusting an impulse value provide to the throwing mechanism or a distance adjustment mechanism to reduce a throwing force and/or launch speed of the basketball upon launch.

2. The system of claim 1 wherein:

the controller is configured to provide the one or more options on a location-specific basis; and the data received from the user interface indicates selection of the pass type on the location-specific basis.

3. The system of claim 2 wherein:

the one or more options include a chest pass.

4. The system of claim 3 wherein:

the controller is configured to default to the chest pass for the user selected pass receipt locations where no selection of the one or more options is provided.

5. The system of claim 3 wherein:

the controller is configured to, for each of the bounce pass location(s), cause the throwing mechanism to launch the basketballs for the bounce pass location(s) at half speed and/or force relative to the speed and/or force for the user selected pass receipt locations where the selection of the one or more options indicates selection of the chest pass or a default selection is provided.

6. The system of claim 1 wherein:

the controller is configured to operate the distance adjustment mechanism to reduce the throwing force and/or launch speed of the throwing mechanism for operations of the throwing mechanism associated with the bounce pass location(s).

7. The system of claim 6 wherein:

the throwing mechanism comprises a catapult arm, a basketball holder provided at a first end of the catapult arm, and a spring having a first end connected to a second end of the catapult arm;

the distance adjustment mechanism comprises an actuator connected to a second end of the spring; and operations of the distance adjustment mechanism to reduce the launch speed and/or force of the throwing mechanism include operating the actuator to reduce a length of the spring.

8. The system of claim 7 wherein:

the distance adjustment mechanism comprises at least one pulley, and a flexible line extending about said pulley; and said flexible line connects said actuator to said second end of the spring.

9. The system of claim 1 wherein:

the controller is configured to undertake an analysis to determine the impulse value which is a function of a linear distance, the pass type, and a scaling value, along with at least one of: a court type, a drag value, and a player height, multiplied by a compensation value.

10. The system of claim 1 wherein:

the controller is configured to generate, at the user interface, as part of the one or more prompts requesting the user to select pass receipt locations, a rendering of a basketball three-point arc and of a basketball launching machine;

the data received from the user interfaces includes an indication of position of touched locations at the rendering relative to a predetermined reference point of the user interface;

the controller is configured to determine an angular position and linear distance of each of the touched locations relative to the predetermined reference point;

the controller is configured to operate the throwing mechanism and a distance adjustment mechanism to pass the basketballs to the user selected pass receipt locations based, at least in part, on the angular position and the linear distance of each of the touched locations, respectively relative to the predetermined reference point; and the controller is configured to cause an icon to be displayed at the rendering at the user interface for each of locations touched, at the touched location, to indicate the user selected pass receipt locations.

11. The system of claim 10 wherein:

the controller is configured to cause an indication of a selected pass type to be provided in association with each of the icons in accordance with the received data from the user interface indicating any selection of the one or more options.

12. The system of claim 10 wherein:

the predetermined reference point is a first pixel of the user interface.

13. The system of claim 1 wherein:

the user interface comprises a touch-sensitive electronic display supported by the structural framework; and the controller is supported by the structural framework.

14. The system of claim 1 wherein:

the user interface and the controller are provided, at least in part, as part of a remote electronic device.

15. A method of operating the basketball launching system of claim 1, said method comprising:

generating, at the user interface, the one or more prompts and the one or more options;

receiving the data from the user interface at the controller; and commanding, by way of the controller, the throwing mechanism to launch at least one basketball to each of the user selected pass receipt locations, including commanding the throwing mechanism and the distance adjustment mechanism to launch the basketballs in accordance with the selection of the one or more options, where provided.

16. A basketball launching machine providing multiple types of basketball passes, said system comprising:

a structural framework, including a frame;

netting supported by the frame;

a throwing mechanism supported by said structural framework and configured for pivoting movement, said throwing mechanism comprising a catapult arm having a basketball holder provided at a first end of the catapult arm and a spring having a first end connected to a second end of the catapult arm;

a linear actuator supported by said structural framework and connected to a second end of the spring such that operation of the linear actuator adjusts a length of the spring and thereby a launching speed and/or force of basketballs thrown by the catapult arm;

a housing supported by the structural framework and at least partially enclosing the throwing mechanism and the linear actuator;

a user interface comprising a touch sensitive electronic display supported by housing and/or the structural framework;

a controller supported by the structural framework and in electronic connection with said throwing mechanism, said linear actuator, and said user interface, wherein said controller is configured to:

generate, at the user interface, one or more prompts requesting a user to select pass receipt locations and one or more options for the user to select a pass type, said one or more prompts comprising a rendering of a basketball three-point arc and of a basketball launching machine, said pass type comprising a chest pass and a bounce pass;

receive data from the user interface indicating user input provided in response to the one or more prompts and any selection of the one or more options, said data including an indication of position of touched locations at the rendering relative to the rendering of the basketball launching machine to identify the user selected pass receipt locations;

cause an icon to be displayed at the rendering at the user interface for each of locations touched at the position touched to indicate the user selected pass receipt locations;

select the chest pass by default, such that the bounce pass is provided only where indicated in the data received from the user interface; and command the throwing mechanism to launch at least one basketball to each of the user selected pass receipt locations, operate the linear actuator to adjust a launching speed and/or force of the basketballs at the throwing mechanism in accordance with the position of the touched locations at the rendering relative to a predetermined reference point at the user interface such that a length of the spring is increased where the position of the touched locations at the rendering relative to the rendering of the basketball launching machine is relatively larger and the length of the spring is decreased where the position of the touched locations at the rendering relative to the rendering of the basketball launching machine is relatively smaller, and operate the linear actuator to adjust the launching speed and/or force of the basketballs at the throwing mechanism in accordance with the selection of the one or more options, where provided, such that the actuator is operated to decrease the length of the spring where the bounce pass is selected and to increase the length of the spring where the chest pass is selected.

17. A basketball launching machine providing multiple types of basketball passes, said machine comprising:

a structural framework;

a user interface connected to said structural framework;

a throwing mechanism connected to said structural framework for pivoting movement, said throwing mechanism comprising a spring-operated launch arm;

a distance adjustment mechanism connected to said structural framework and comprising a liner actuator connected to a spring of said spring-operated launch arm to adjust a length of said spring; and a controller connected to said structural framework and in electronic connection with said throwing mechanism, said distance adjustment mechanism, and said user interface, wherein said controller is configured to:

generate, at the user interface, one or more prompts requesting a user to select pass receipt locations and one or more options for the user to select a pass type;

receive data from the user interface indicating user input provided in response to the one or more prompts and any selection of the one or more options;

analyze the data from the user interface to determine a first impulse level to provide to said throwing mechanism and a second impulse level to provide to said distance adjustment mechanism; and command the throwing mechanism to launch at least one basketball to each of the user selected pass receipt locations, including commanding the throwing mechanism to pivot in accordance with an angular position of touched locations at the user interface and commanding the linear actuator to move in accordance with a liner distance of the touched locations and the selection of the one or more options, where provided, regarding the pass type.

18. A basketball launching system providing multiple types of basketball passes, said system comprising:

a user interface;

a structural framework;

a throwing mechanism connected to said structural framework; and a controller in electronic connection with said throwing mechanism and said user interface, wherein said controller is configured to:

generate, at the user interface, one or more prompts requesting a user to select pass receipt locations and one or more options for the user to select a pass type;

receive data from the user interface indicating user input provided in response to the one or more prompts and any selection of the one or more options; and command the throwing mechanism to launch at least one basketball to each of the user selected pass receipt locations, including commanding the basketballs to be launched in accordance with the selection of the one or more options, where provided, regarding the pass type said one or more options including a bounce type pass and a chest pass, wherein the chest pass is a default selection.

19. A basketball launching system providing multiple types of basketball passes, said system comprising:

a user interface;

a structural framework;

a throwing mechanism connected to said structural framework;

a distance adjustment mechanism supported by the structural framework; and a controller in electronic connection with said throwing mechanism, said distance adjustment mechanism, and said user interface, wherein said controller is configured to:

generate, at the user interface, one or more prompts requesting a user to select pass receipt locations and one or more options for the user to select a pass type including a rendering of a basketball three-point arc and of a basketball launching machine;

receive data from the user interface indicating user input provided in response to the one or more prompts and any selection of the one or more options, including an indication of position of touched locations at the rendering relative to a predetermined reference point of the user interface, said predetermined reference point corresponding to at least one predetermined pixel of the user interface;

cause an icon to be displayed at the rendering at the user interface for each of locations touched, at the touched location, to indicate the user selected pass receipt locations;

determine an angular position and linear distance of each of the touched locations relative to the predetermined reference point; and command the throwing mechanism to launch at least one basketball to each of the user selected pass receipt locations, including in accordance with the selection of the one or more options, where provided, regarding the pass type, including operating the throwing mechanism and the distance adjustment mechanism to pass the basketballs to the user selected pass receipt locations based, at least in part, on the angular position and the linear distance of each of the touched locations, respectively relative to the predetermined reference point.

* * * * *